US010946683B2

(12) United States Patent
Zlotnick et al.

(10) Patent No.: US 10,946,683 B2
(45) Date of Patent: Mar. 16, 2021

(54) SYSTEMS AND METHODS FOR INTERRUPTING TRADITIONAL COUNTERFEITING WORKFLOWS

(71) Applicant: The Government of the United States of America, as represented by the Secretary of Homeland Security, Washington, DC (US)

(72) Inventors: Joel Zlotnick, Washington, DC (US); Troy Eberhardt, Washington, DC (US); Jordan Brough, Washington, DC (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 304 days.

(21) Appl. No.: 16/146,124

(22) Filed: Sep. 28, 2018

(65) Prior Publication Data

US 2019/0100046 A1 Apr. 4, 2019

Related U.S. Application Data

(60) Provisional application No. 62/565,654, filed on Sep. 29, 2017.

(51) Int. Cl.

| | |
|---|---|
| ***B41M 3/14*** | (2006.01) |
| ***B41M 3/00*** | (2006.01) |
| ***B42D 25/29*** | (2014.01) |
| ***B42D 25/30*** | (2014.01) |
| ***B44F 1/10*** | (2006.01) |
| *B41F 31/02* | (2006.01) |
| *B41F 31/18* | (2006.01) |
| *B41F 11/02* | (2006.01) |

(52) U.S. Cl.

CPC ..... *B41M 3/008* (2013.01); *B41M 3/14* (2013.01); *B42D 25/29* (2014.10); *B42D 25/30* (2014.10); *B44F 1/10* (2013.01); *B41F 11/02* (2013.01); *B41F 31/027* (2013.01); *B41F 31/18* (2013.01)

(58) Field of Classification Search

None

See application file for complete search history.

(56) References Cited

U.S. PATENT DOCUMENTS

| | | | | |
|---|---|---|---|---|
| 282,995 A * | 8/1883 | Lee | B41F 9/02 | 101/152 |
| 618,793 A * | 1/1899 | Gledhill et al. | B41F 31/18 | 101/208 |
| 2,227,877 A * | 1/1941 | Cox | B41F 3/00 | 101/254 |
| 2,520,688 A * | 8/1950 | Meyer | B41F 31/15 | 101/348 |

(Continued)

*Primary Examiner* — Jill E Culler

(74) *Attorney, Agent, or Firm* — Lavanya Ratnam; Kelly G. Hyndman

(57) ABSTRACT

This application relates generally systems and methods for interrupting counterfeiting workflows, and more specifically to methods for adequately concealing aspects of printer configuration, such as number of plates used to print a document or a setup of inks and split fountains. It is therefore possible to obscure the individual plate images and application of ink to those plate images, thereby impeding accurate redrawing of security artwork.

29 Claims, 37 Drawing Sheets
(36 of 37 Drawing Sheet(s) Filed in Color)

(56) References Cited

U.S. PATENT DOCUMENTS

| | | | | |
|---|---|---|---|---|
| 5,651,316 | A * | 7/1997 | DeMoore | B41F 7/02 101/424.1 |
| 6,029,574 | A * | 2/2000 | Richards | B41F 31/00 101/210 |
| 6,206,429 | B1 * | 3/2001 | Cull | B42D 25/29 283/114 |

* cited by examiner

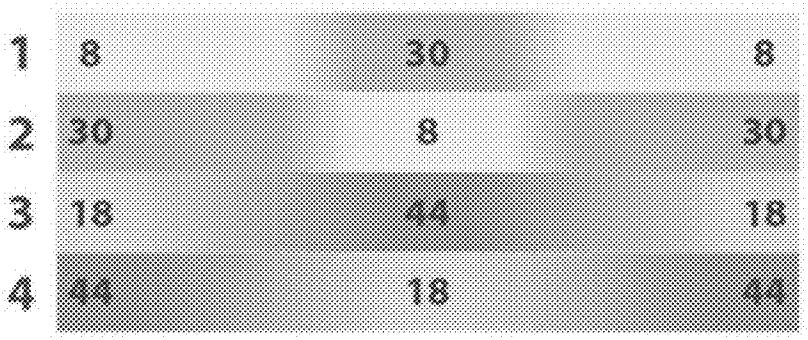
FIG. 77
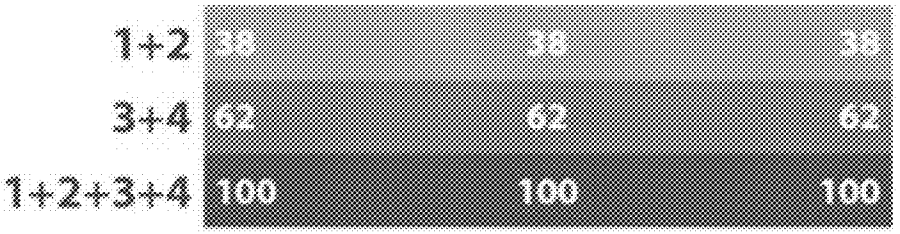
FIG. 78
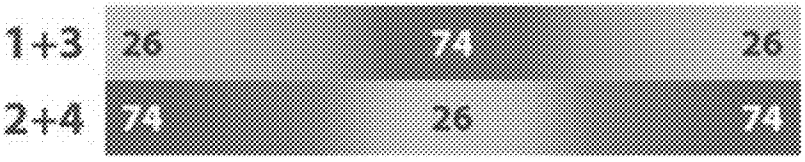
FIG. 79
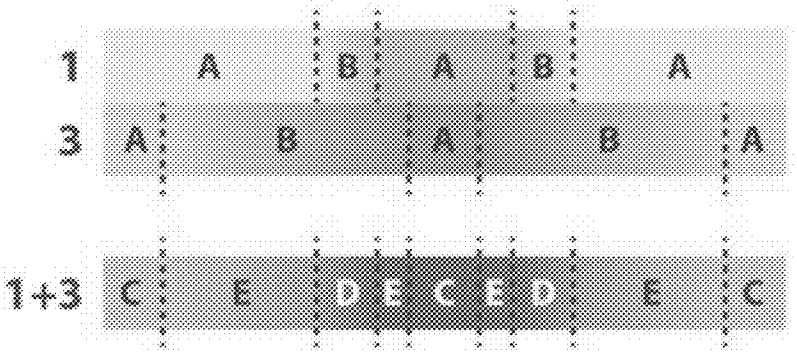
FIG. 80
FIG. 81
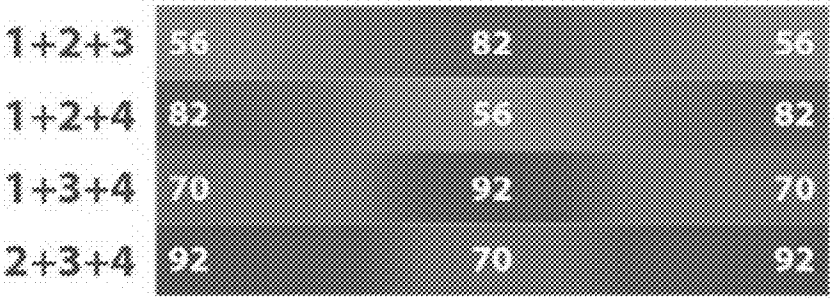
FIG. 82

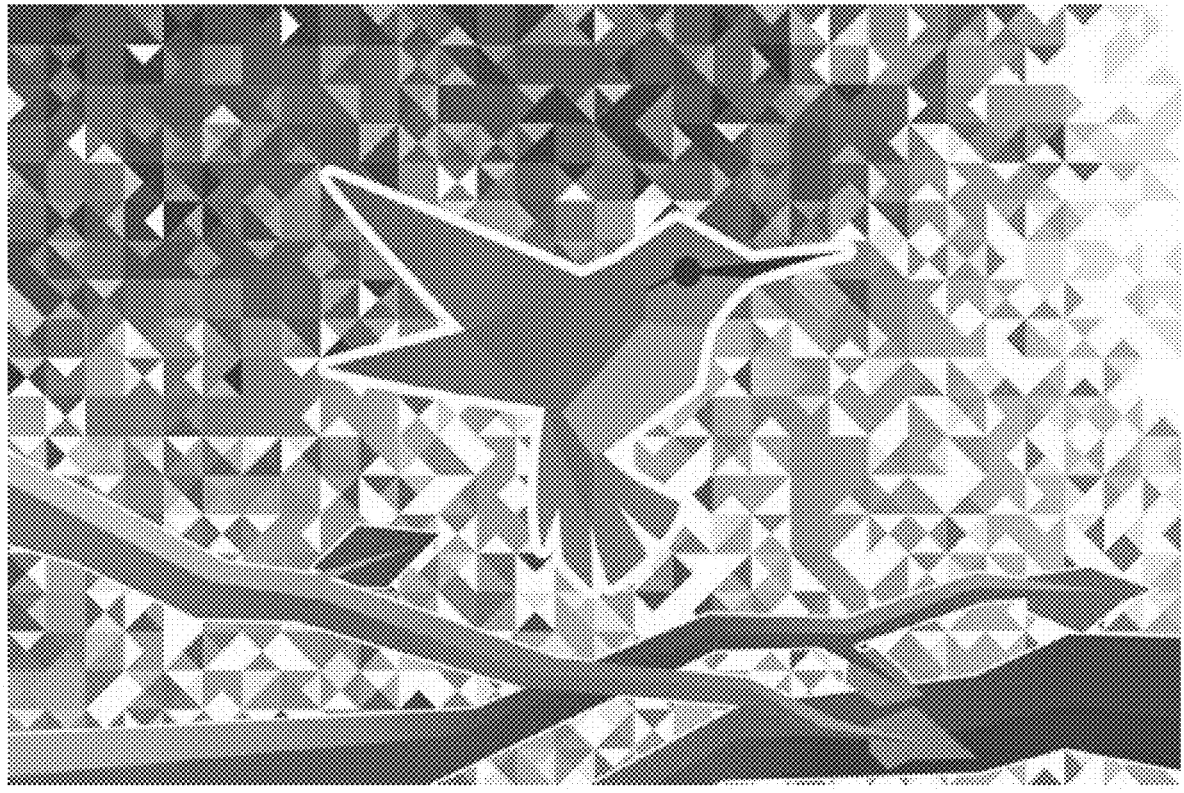
FIG. 87
| | | | |
|---|---|---|---|
| 1 | 8 | 30 | 8 |
| 2 | 30 | 8 | 30 |
| 3 | 18 | 44 | 18 |
| 4 | 44 | 18 | 44 |
FIG. 88
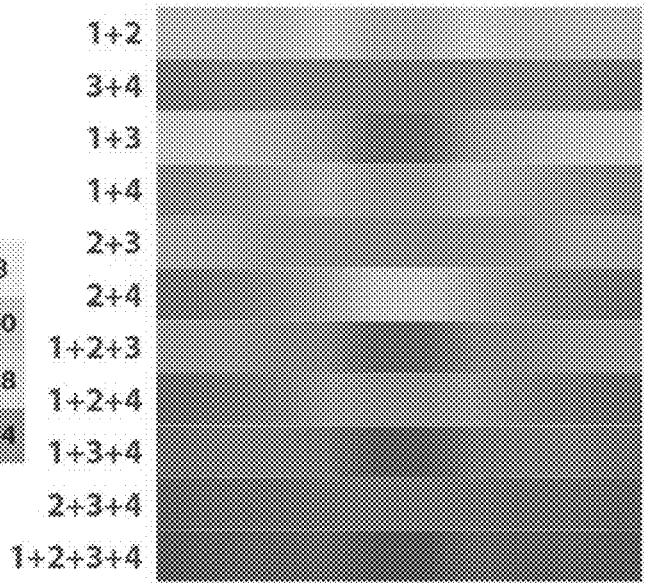
FIG. 89

SYSTEMS AND METHODS FOR INTERRUPTING TRADITIONAL COUNTERFEITING WORKFLOWS

GOVERNMENT RIGHTS

This invention was made with United States Government support. The Government has certain rights in this invention.

BACKGROUND

Field of the Disclosure

This application relates generally to systems and methods for interrupting counterfeiting workflows, and more particularly, to systems and methods for adequately concealing the number of plates used to print a document for the purposes of impeding accurate redrawing of security artwork.

Description of the Related Art

Line art, microprinting, guilloche patterns, security halftones, transparent registers, and other features based on printed artwork are common counterfeit deterrence features that are based on the design of a document, rather than the technology used to develop the document. However, counterfeit deterrence features based on printed artwork rely primarily on a resistance to redrawing due to the high image complexity of the artwork, and common anti-counterfeiting techniques have limited emphasis on defeating counterfeiting in the prepress stage.

Counterfeiting of document artwork is typically done according to either a digital counterfeiting workflow or according to a traditional counterfeiting workflow. In the digital counterfeiting workflow, a counterfeiter utilizes a scan-and-print process, which is popular because of its simplicity, though technically limited because inkjet and toner devices can only simulate line artwork with process colors and halftones. In contrast, in a traditional counterfeiting workflow, a counterfeiter attempts to replicate details found in the genuine document's artwork, such as by painstakingly redrawing the design on each of the different printing plates, and printing the counterfeit using a press setup that has been determine to match the press setup that was used to print the genuine document. This traditional counterfeiting workflow has the potential to produce a better quality fake, even though it requires more time, more sophisticated graphic arts skills, and more expensive printing equipment. Common steps associated with each of these workflows are depicted in Table 1.

TABLE 1

Comparison of steps in digital and traditional counterfeiting workflows

| Digital Counterfeiting Workflow | Traditional Counterfeiting Workflow |
|---|---|
| 1. Obtain a template genuine document | 1. Obtain a template genuine document |
| 2. Scan or photograph the genuine document | 2. Separate/isolate printing plate images from one another. |
| 3. Edit digital image in raster image editing software. | 3. Rebuild plate artwork in vector image drawing software. |
| 4. Output counterfeits using CMYK office equipment | 4. Manufacture offset and/or intaglio printing plates |
| | 5. Output counterfeits on press, in-line art, and spot color |

To perform steps two and three of the traditional counterfeiting workflow described in Table 1, a counterfeiter must separate the printing plate images within a genuine document as a precursor to redrawing the artwork. The separation of images may be accomplished with the help of digital imaging software, or with visual examination. In either instance, the counterfeiter's goal is to understand how many printing plates were used in the creation of the document, and the specific artwork and colors of ink used on each of the printing plates. Without this information, there is no way to accurately replicate the original artwork and color arrangement for each print plate.

In most printing workflows, ink of one color originates from a single print plate. FIG. 1 depicts a green and light green geometric line pattern, which suggests this design was produced by two plates, one for each color. Continuity of lines in artwork is another important visual cue, and in FIG. 1 the lines within each color form a continuous, unbroken pattern. This background artwork is protected by an amplitude-modulated security halftone that modifies the line widths. Importantly, this security halftone impacts the difficulty of redrawing the image, but not the difficulty of distinguishing between the plate images. This illustrates how impeding plate separation requires an entirely different design strategy than impeding artwork replication.

A single offset print plate usually delivers just one ink color, except for the use of split fountains, which smoothly blend two or more colors of ink on press before inking the plate. The visual effect in the final print is a seamless color transition across the artwork in a single direction (usually horizontal). The significance of this technique is that a multicolored image can be created from a single plate. If the split fountain artwork contains continuous lines or another repeating pattern, the color transition can be visually traced as if the ink were a single color. For example, FIG. 2 was printed with two plates, but it contains more than two colors of ink. One pattern is printed only with a light blue ink, and the continuity of the lines and the consistency of the color confirm this pattern is from a single plate. However, the second line pattern slowly changes from a darker blue at the left, to purple in the center, and finally pink at the right. The continuous lines in the blue-pink line pattern reveal that it originates from one plate, even though the art contains several distinct ink colors. The extra colors from the split add complexity, but are not designed to prevent reverse engineering of the plate artwork.

Some security documents add complexity by employing two, three or even four split fountain images. The example in FIG. 3 shows many colors of ink, and contains three separate split fountains: purple to dark green, yellow to light green and blue to orange, from left to right. This background design is a product of three separate printing plates and six inks. Each color can be traced from left to right by following the unbroken lines in the artwork. Furthermore, the artwork shapes may be different for each plate and correspond to the ink colors. Despite the many colors present, this example contains many visual cues that help an observer understand how the design was created.

Split fountain transitions are usually regarded as press capabilities that not all counterfeiters can mimic. However, split fountains can also be used to print the same or similar color(s) of ink from two or more plates to confuse the plate setup. For example, FIG. 4 requires more than just an examination of color to understand the plate setup. The right side of the enlargement shows a dark orange ink in the design of 'C' shapes and a light orange ink in the connected line pattern which encompasses the 'C' shapes. However, both inks are part of two different split fountain transitions that are a similar grey color on the left of FIG. 4. As the left side of FIG. 4 suggests only a single plate because there is only one color, a viewer has to study the colors throughout FIG. 4 to understand that the total artwork is from two different plates. The use of the same color of ink (grey) on more than one plate complicates a counterfeiter's use of software color selection tools to isolate the plate images, because in this example it is no longer true that each plate contains ink colors that are visually different from the other plates, as was the case in FIGS. 1 through 3.

Other ways to hinder reverse engineering include decoupling the ink colors from the artwork. For example, instead of one plate containing the 'C' shapes and the second containing continuous thin lines, both shapes could be commingled on each plate with breaks in the continuous line pattern to impede line tracing.

The background print shown in FIG. 4 contains two plate images that share a color of ink, but the complementary elements from each plate are independent and do not overlap spatially. In FIG. 5, the artwork contains two overlapping line patterns, one from purple to pink, and the other from brown to blue. The colors in the center of the background design are sufficiently similar to complicate separation based on color alone. The easiest path to decoding this pattern lies at the left and right edges, where the color differences help predict the line patterns used on each plate. The line patterns can then be traced through the rest of the design to understand the changing colors in both of the splits, and demystify the more confusing center of the design. To make reverse engineering more difficult, the associations between color and artwork could be delinked, and frequent breaks introduced along the horizontal pattern to prevent tracing.

For example, FIG. 6 illustrates a design that integrates breaks to interrupt line tracing. First, each of the geometric shapes is separated from the others by non-printed areas of white paper, so would-be counterfeiters cannot simply follow lines to trace out a plate image. Secondly, this design employs a split fountain to transition from a bright, vibrant orange at the left to a darker orange at the right. Thirdly, the designer has manufactured the illusion of additional spot colors by registering similar shapes from two different plates. As seen in FIG. 7, slight misregistrations of the shapes reveal that what appears to be a single dark orange (#1) spot color ink is actually overlapping green and orange spot inks. Similarly, spot blue and orange are overlapped to create a dark green (#2), and what looks like teal (#3) is actually overlapped blue and dark green shapes. These overlapping shapes, which contain hard edges and small registration variations, may provide clues to the counterfeiter that these new colors aren't the result of a separate plate image.

Observing small misregistrations to identify the specific plate setup is harder in the next example, which uses fine rough-edged parallel line patterns instead of geometric registered shapes as seen in FIG. 7. This design, in FIG. 8, contains numerous diamond shapes from different print plates that share a common color gamut (such as in FIGS. 4 and 5), as well as art printed from different plates that overlap spatially (as in FIGS. 3, 5, 6 and 7). Decoding FIG. 8 is difficult because the overall appearance of each of the diamond shapes is a product not just of multiple ink colors from different plates, but also of varying line thicknesses that allow ink coverage, and image density, to be varied within a single color.

Additionally, the overlap of one ink with another creates the illusion of additional spot colors without the need for perfect registration. There are no large continuous patterns in this design and each diamond shape is bounded by a non-printed area of white paper, which prevents the tracing of lines. The patterns of parallel lines are oriented in various directions within each diamond shape; therefore, it is difficult for an observer to rely on the line direction or other facets of the artwork to understand the plate setup. Split fountains are indeed used in this design, but are extremely difficult to identify at this scale and with this particular artwork. As in FIGS. 6 and 7, the macrovisual effect is, instead, of an increased number of discrete spot colors. Finally and importantly, the use of fine line patterns instead of block shapes makes the edges of the diamond shapes indistinct compared to the hard edges of the designs shown in FIGS. 6 and 7. This makes this design more tolerant of small variations in registration on press and prevents a would-be counterfeiter from using minor registration variation as a cue to understanding how the document was printed.

Overall, the artwork shown in FIG. 8 prevents a more challenging reverse engineering problem than FIGS. 1 through 7 and introduces several valuable strategies, but even FIG. 8 does not fully explore the potential of design strategies to inhibit artwork reverse engineering. Therefore, in view of the foregoing, there is a need for improved and novel design methods specifically targeted to make the traditional counterfeiting process as difficult as possible.

SUMMARY

In one example embodiment, a system may include a plurality of printing plates each having a plate image corresponding to at least a portion of a composite image. The system may further include a plurality of split fountains each corresponding to a respective one of the plurality of printing plates and each containing ink of a same color at a plurality of different opacity levels, wherein each of the plurality of split fountains is configured to provide to its respective printing plate a unique arrangement of ink relative to other split fountains. The system may also include a plurality of oscillator rollers each configured to control a width of at least one opacity level transition between the plurality of different opacity levels of a respective corresponding split fountain, and to transfer ink from the plurality of split fountains to the plurality of printing plates. The system may further include a press for applying each of the plurality of printing plates to a substrate to create the composite image.

In another example embodiment, a system may include a plurality of printing plates each having a plate image corresponding to at least a portion of a composite image. The system may further include a plurality of split fountains each containing a plurality of inks of different opacity levels of a same color. The system may also include a plurality of oscillator rollers for controlling widths of opacity level transitions of the plurality of split fountains and for transferring ink from the plurality of ink fountains to the plurality of printing plates. The system may further include a press for applying each of the plurality of printing plates to a substrate to create the composite image, wherein the printing plates are configured to generate the composite image to have a greater number of different opacity levels than the plurality different opacity levels contained in the plurality of split fountains.

In another example embodiment, a system may include a plurality of printing plates each having a plate image corresponding to at least a portion of a composite image. The system may further include a plurality of split fountains each containing a plurality of inks of different opacity levels of a same color and configured to generate a plurality of opacity level transitions. The system may also include a plurality of oscillator rollers for controlling widths of the plurality of opacity level transitions of the plurality of split fountains and for transferring ink from the plurality of ink fountains to the plurality of printing plates. The system may further include a press for applying each of the plurality of printing plates to a substrate to create the composite image, wherein the printing plates are configured to generate the composite image to include at least one simulated opacity level transition different from any one of the plurality of different opacity levels that the plurality of split fountains are physically configured to generate.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Reference will now be made to the accompanying drawings showing example embodiments of this disclosure. In the drawings:

FIGS. 77-87 illustrate artwork demonstrating paired split fountains to simulate three flat tones and eight false split fountains.

FIGS. 88-96 illustrate artwork demonstrating three additional false split fountain effects without the use of paired split fountains.

DETAILED DESCRIPTION

When viewed through the eyes of a counterfeiter attempting to understand how a genuine document was printed, a designer of security document artwork must consider additional novel design methods that go beyond simple cosmetic considerations. Choices about how color, split fountains and artwork are implemented can have significant counterfeit deterrence implications in disguising the press setup used to produce a genuine document. As set forth above, counterfeiters are able to rely on certain artwork cues found in security artwork in order to facilitate effective reverse engineering of the pre-press process that was used to create the genuine document artwork. Such artwork cues may include: 1) the printing of different ink colors from each plate, 2) use of large continuous line patterns that can be visually traced, 3) delivery of complete visual elements from a single printing plate, and 4) use of different artwork styles on different plates. Accordingly, with the goal of making plate image separation and artwork replication as hard as possible, the following description details security artwork strategies that help obscure the press setup used to print the original genuine document. These strategies attempt to minimize the artwork cues that may be relied upon in reverse engineering.

Figure 112:
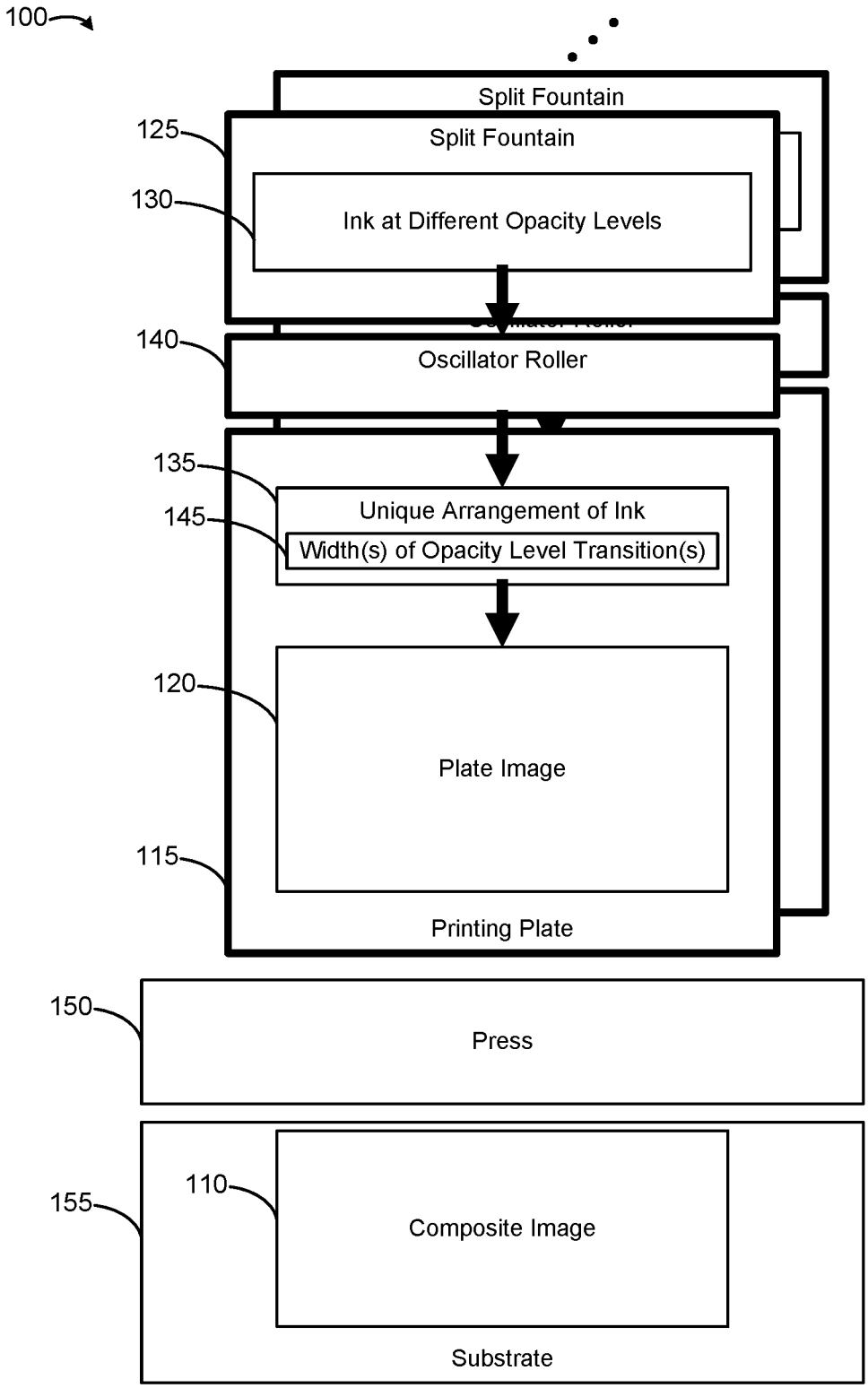
FIG. 112 illustrates a system to create a composite image in accordance with an embodiment.

FIG. 112 illustrates a system 100 to create a composite image 110 in accordance with an embodiment. The system includes a plurality of printing plates 115 each having a plate image 120 corresponding to at least a portion of the composite image 110. A plurality of split fountains 125 each correspond to a respective one of the plurality of printing plates 115. Each split fountain 125 contains ink of a plurality of different opacity levels 130 based on pigment of a same color. Each of the plurality of split fountains 125 is configured to provide to its respective printing plate 115 a unique arrangement of ink 135 relative to other split fountains 125. A plurality of oscillator rollers 140 are each configured to control a width of at least one opacity level transition 145, between the plurality of different opacity levels of a respective corresponding split fountain 125, and to transfer ink from the plurality of split fountains 125 to the plurality of printing plates 115. A press 150 applies each of the plurality of printing plates 115 to a substrate 155 to create the composite image 110.

Figure 1:
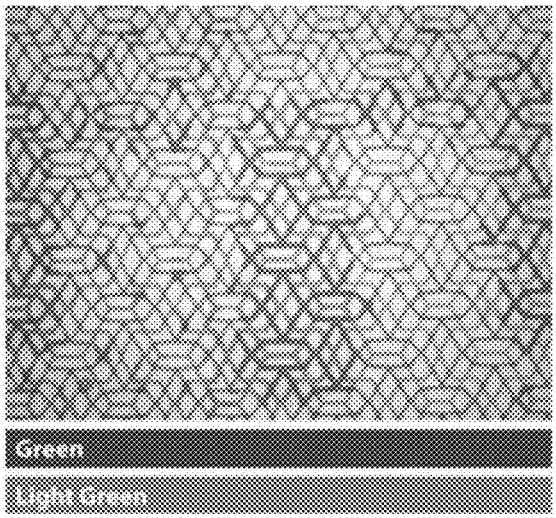
FIGS. 1-28 illustrate sample artwork in accordance with example embodiments.
Figure 2:
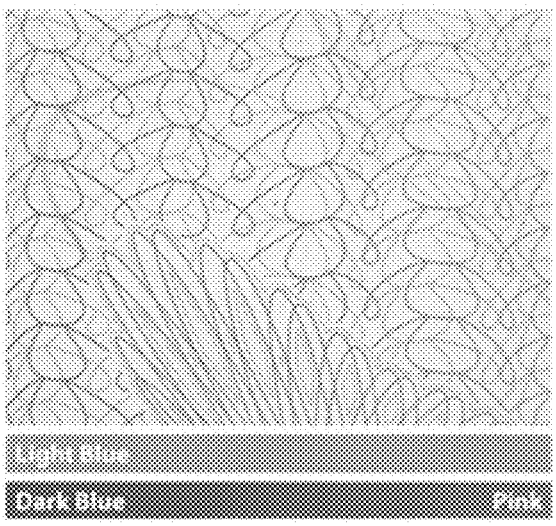
Figure 3:
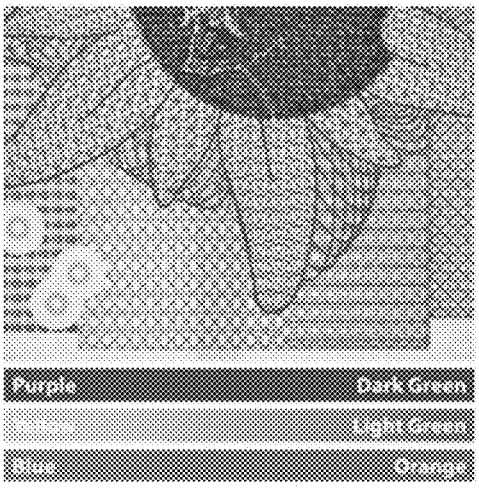
Figure 4:
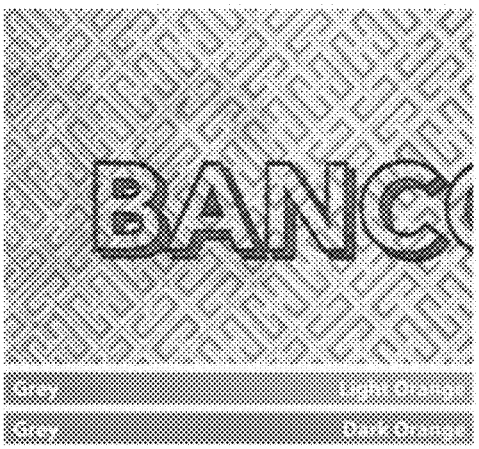
Figure 5:
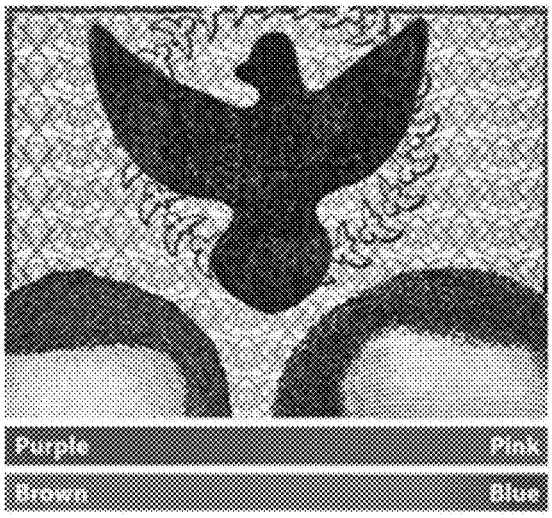
Figure 6:
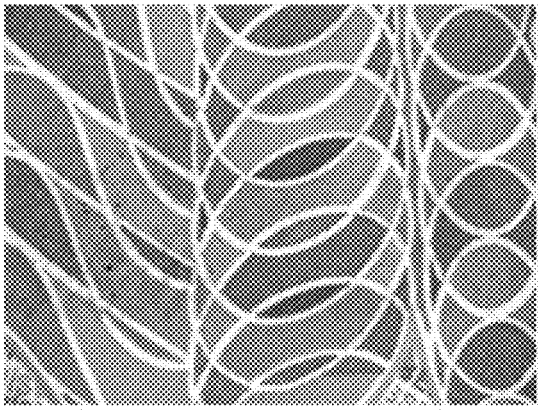
Figure 7:
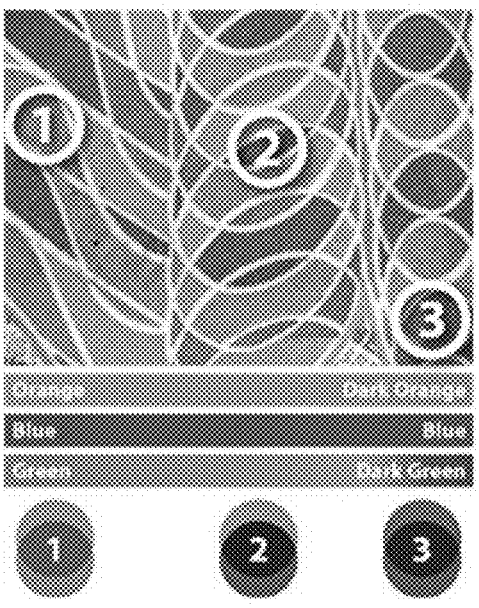
Figure 8:
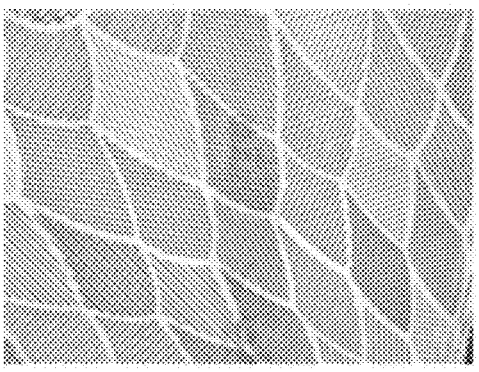
Figure 9:
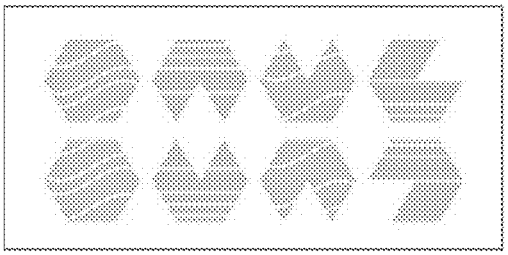
Figure 10:
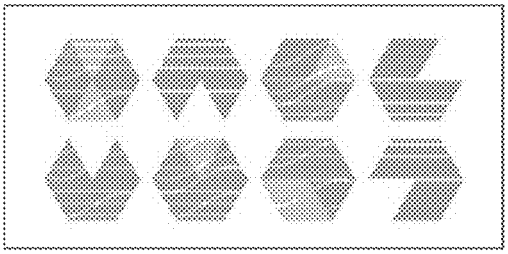
Figure 11:
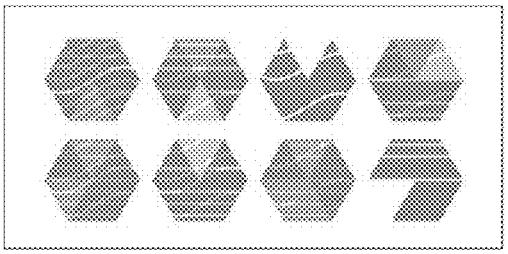
Figure 12:
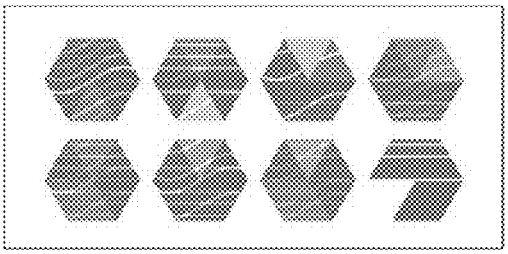

In one embodiment, an overlapping monochromatic artwork approach can be used to obscure the press setup, in which layers of artwork from multiple offset plates are printed in a single color of ink. This strategy is demonstrated using the hexagon graphics shown in FIGS. 9 through 12. The translucent ink in FIGS. 9 through 12 is formulated so that up to four sequential layers of this pale ink produce a visibly darker monochromatic image, just as each translucent ink in a CMYK process increases image density as additional colors are printed. FIG. 9 shows four unique hex designs, each of which contains a unique interior pattern, and four more hexes that are rotated versions of the first four. Each hex covers approximately the same surface area of the substrate, regardless of the details of its design. If two of the hexes shown in FIG. 9 are printed on top of one another from two different offset plates, some possible image combinations are shown in FIG. 10. Similarly, FIGS. 11 and 12 show how three or even four of the hex designs from FIG. 9 could be printed over one another to create even more complex patterns. Areas where the patterns overlap become incrementally darker, and the hexes in FIG. 12 can show as many as four different layers of ink overlap. Additionally, the graphics shown in FIGS. 10 through 12 are just a sample of a much larger number of possible combinations, which are not all displayed due to space limitations.

FIG. 12 therefore represents a challenge to counterfeiters attempting to reverse engineer the press setup that produced the artwork, as it can be difficult to determine how many separate plate images are present, and the specific graphics associated with each plate. If the number of plates cannot be determined, then the artwork on each individual plate cannot be identified, and each unique plate design cannot be replicated. While counterfeiters are left with some alternatives for simulation of the artwork, the results of such simulations are likely to be subpar without knowledge of the actual plate design.

Furthermore, the use of hexagonal shapes in the foregoing examples are purely exemplary, and FIGS. 9 through 12 are a considerable simplification of what is possible with such a monochromatic strategy, which could employ significantly more complex artwork, an unlimited number of unique graphic elements, a greater number of overlapping images and even more complex use of monochromatic color.

Figure 13:
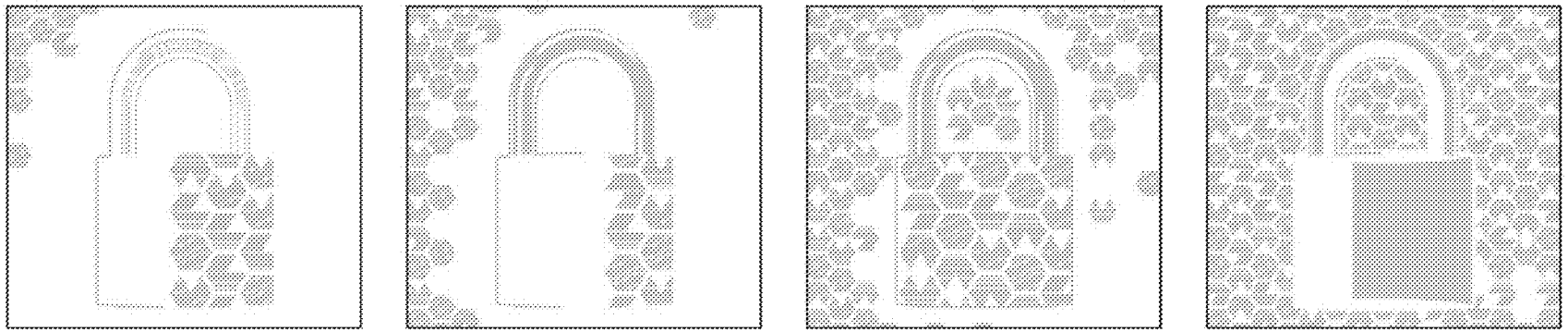
Figure 15:
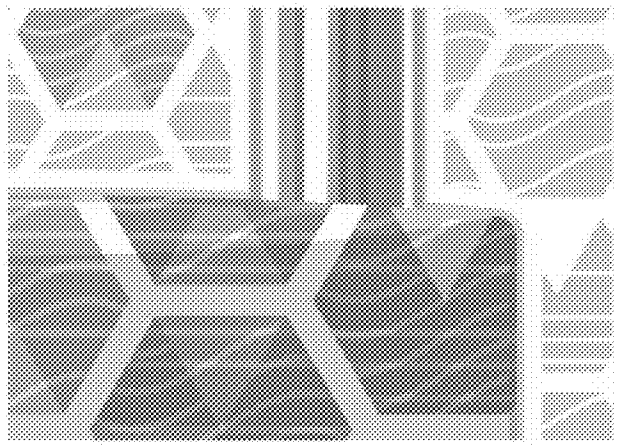
Figure 14:
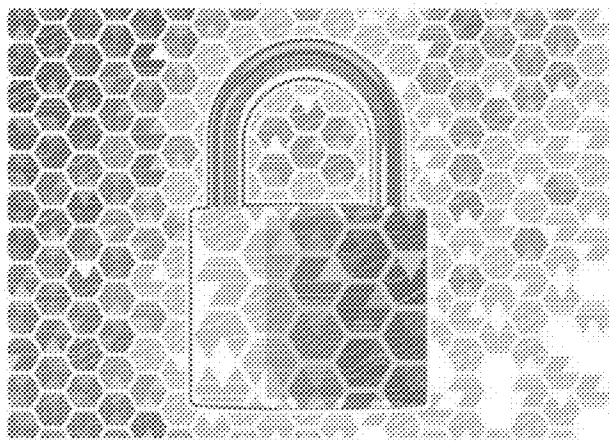

Following the hex example above that used as many as four overlapping monochromatic designs to obfuscate the press setup and plate artwork, such monochromatic strategies can be implemented in a larger and more complex design based on the hex theme. FIG. 13 shows the artwork on each of the four printing plates in a hypothetical four-station offset press. FIG. 14 shows the composite artwork that results when all four plates of FIG. 13 are printed together, and FIG. 15 depicts a magnified view of the composite image of FIG. 14.

As in the hex example, the same translucent green ink is printed from each of the four fountain units, so a counterfeiter cannot differentiate between plates on the basis of color. Further, the designs do not contain large continuous traceable line patterns, since the hexes are separated by white space, so understanding the artwork of one hex does not necessarily help with understanding the artwork of other hexes.

Additionally, many of the hex designs in the composite artwork in FIG. 14 are composed of two, three or four plate images overlapped with one another, though some are printed from only one plate. Finally, the same basic pool of hex designs is used on all of the four plates shown in FIG. 13, so each plate does not contain graphical cues that help distinguish one plate from another plate.

In terms of image density, FIG. 14 contains areas of low and high density even though the surface area covered by at least one layer of artwork is consistent through most of the design, as is the spacing between the hexes. In contrast, conventional security printing strategies use a single layer of ink per color, and image density is increased by covering more of the substrate with ink (by widening lines, for example). The magnified view in FIG. 15 shows how areas of higher density in this example are produced not only by covering more substrate with ink, but also by layering ink to darken the print. This again makes it difficult for potential counterfeiters to determine how many plates are present, and the specific artwork used on each plate.

The monochromatic design example described above requires a more specific explanation of how it disrupts counterfeiting workflows. Although simulation will always be possible, deliberately designed genuine artwork can work to limit simulation quality. This monochromatic design strategy forces counterfeiters to choose between achieving accurate artwork detail and accurate tonal reproduction in simulations, if they fail to accurately replicate the plate artwork. First, the composite artwork in FIG. 13 denies counterfeiters access to information that facilitates high quality artwork replication, including the use of color, line tracing and artwork style as cues to distinguish between artwork from different plates. If a determined counterfeiter cannot isolate and accurately replicate the individual plate artwork, options for artwork simulation may include: 1) simulating the composite line art design with a dot halftone, 2) printing the entire monochromatic design from a single plate (instead of four plates), or 3) reverse engineering only the density levels in the final printed artwork instead of the actual plate images.

Figure 16:
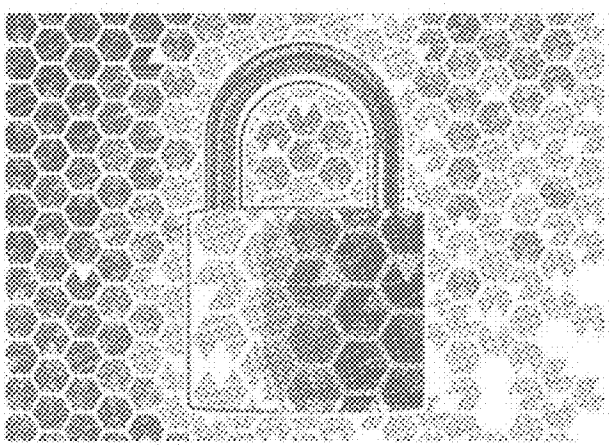

Simulating security artwork with a halftone process converts the design into one or more patterns of dots that vary in size (amplitude-modulated halftones) or spacing (frequency-modulated halftones). Halftones make it possible to preserve the general tonal values of an image at a macro level, while causing loss of image detail at the microscopic level. For example, FIG. 16 shows the artwork from FIG. 14 as it could appear if simulated with an amplitude-modulated halftone process. FIG. 14 required four printing plates to display the various density levels, but in FIG. 16 the counterfeiter has collapsed the artwork onto a single plate. Although the overall density values are preserved by the halftone, the line art is not, and the dots are particularly visible in the lightest areas of FIG. 16. Detection of the counterfeit in FIG. 16 is easy with a magnifier, since the detail in the artwork is compromised.

Figure 17:
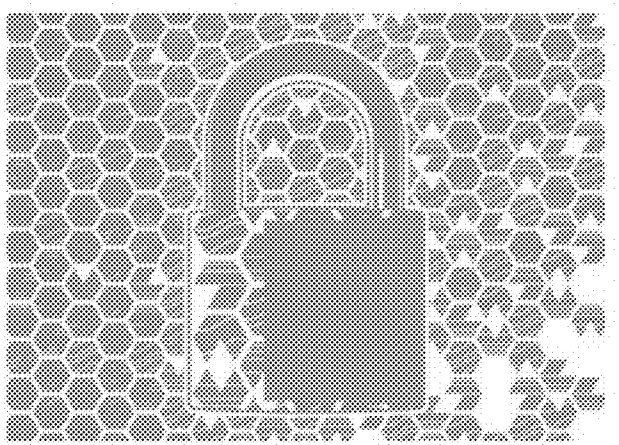

In the second option, a counterfeiter could redraw the line art and print it from a single plate, because the design contains only one color. While the fidelity of the line art in this example can be preserved to a greater extent than with a halftone process, a single plate is not capable of replicating the several density values shown in FIGS. 14 and 15. A single-plate counterfeit of the image in FIG. 14 is shown in FIG. 17, which demonstrates how some of the microscopic artwork detail has been preserved, but the tonal variation has been lost, causing FIG. 17 to appear posterized and flat compared to FIG. 14. The halftone process shown in FIG. 16 preserves more of the tonal variation at the cost of artwork fidelity, while the line art strategy shown in FIG. 17 preserves more of the line artwork at the cost of the tonal variation.

Figure 19:
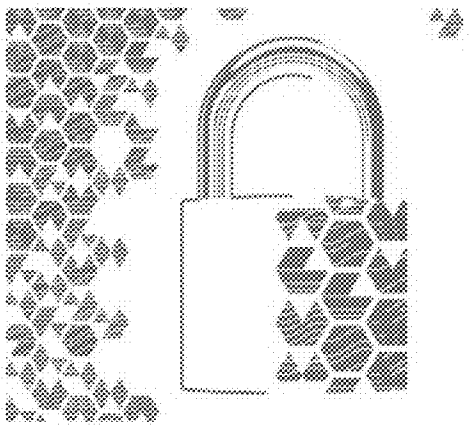
Figure 21:
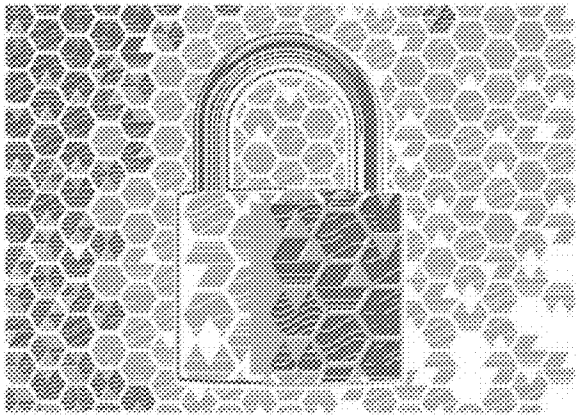
Figure 18:
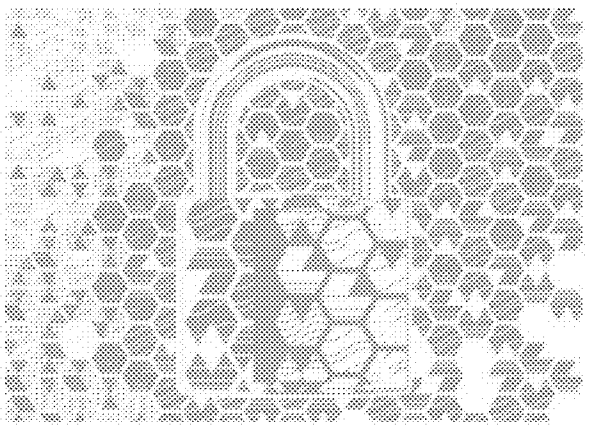
Figure 20:
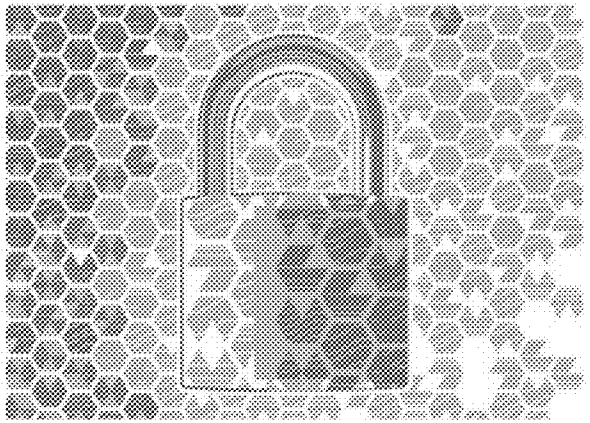

The third counterfeiting option is to simulate the density levels present in the genuine image. The counterfeiter creates a single plate for each discrete density level and prints using multiple inks of the same color but different densities. A simple example of such a counterfeit executed on only two plates (instead of four) is shown in FIGS. 18 through 20, where FIG. 18 prints a light green ink, FIG. 19 prints a dark green ink and FIG. 20 shows the two plates printed together in register. Although the approach shown in FIG. 20 offers better simulation of both artwork and density values than the simulations in FIGS. 16 and 17, the process is more technically complex and can introduce registration problems if four density levels are simulated on four plates, instead of just two density levels as shown in FIGS. 18 through 20. Counterfeiters attempting to simulate density (instead of the real plate artwork) risk the appearance of gaps between plate images if registration is not perfect. FIG. 21 shows the same two-plate image as in FIG. 20, but with the plates slightly out of register.

A density simulation attack more sophisticated than the one shown in FIGS. 18 through 20 is possible if a counterfeiter can identify how many discrete density levels are present in the image. Solutions to this issue may involve increasing the number of discrete density levels available where the plate images overlap. This can be accomplished by delivering inks of the same color but different translucencies or opacities from the four fountains, and by utilizing split fountains for transitioning ink translucency instead of color, which can expand the number of density levels available, resulting in increased image complexity and better resistance to reverse engineering.

Printing ink formulations include pigments, vehicles, solvents and a number of other chemical components that control the color, rheology, drying mode and other properties of the finished ink. The pigment component is most responsible for the ink color, though pigments may compose only a fraction of a printing ink formulation (approximately 15-20%, as a general example). The translucency of an ink is a function of its formulation, with higher pigment volumes corresponding to greater opacity for a given ink layer thickness, and lower pigment volumes producing an ink of greater translucency. When inks of different pigment concentrations are deployed in each of four stations in a typical offset press setup, each plate prints an image of different opacity.

Consider a hypothetical maroon ink formulation in which the pigment volume can be adjusted to produce inks of varying opacity, up to a maximum opacity of 100%. Four maroon inks are prepared that possess 8%, 18%, 30% and 44% of the formulation's maximum opacity. Further assume that ink opacities are additively linear, such that printing an ink of 8% opacity on top of an ink of 18% opacity results in a combined opacity of precisely 26%, regardless of which ink is printed first (of course, print order does matter in real applications). Following this logic, layering all four inks produces a final image of 8%+18%+30%+44%=100% density. The example percentages were contrived to sum conveniently to 100%, and may not represent an optimal set of real densities. Real-world ink opacities (and an optimal real-world print order) could be determined empirically.

Figure 22:
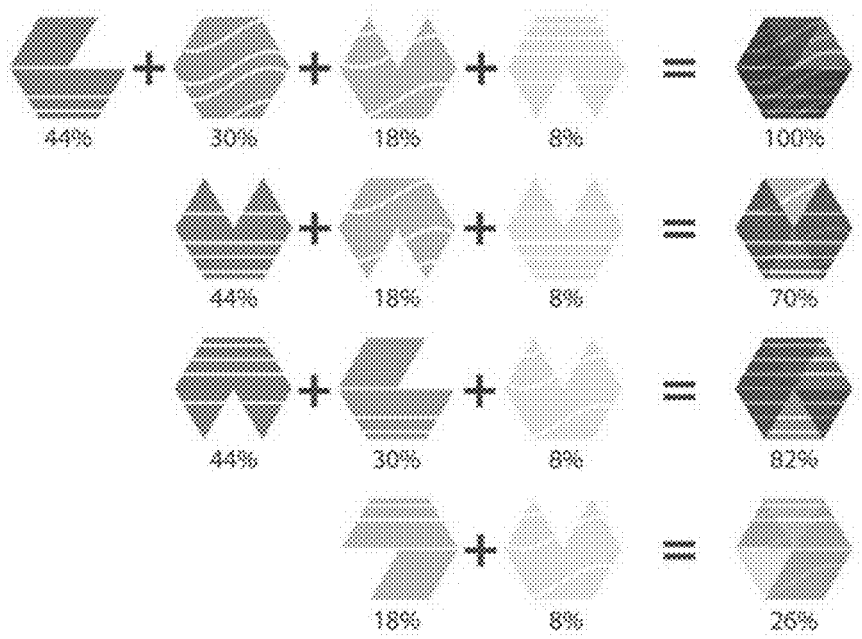
Figure 23:
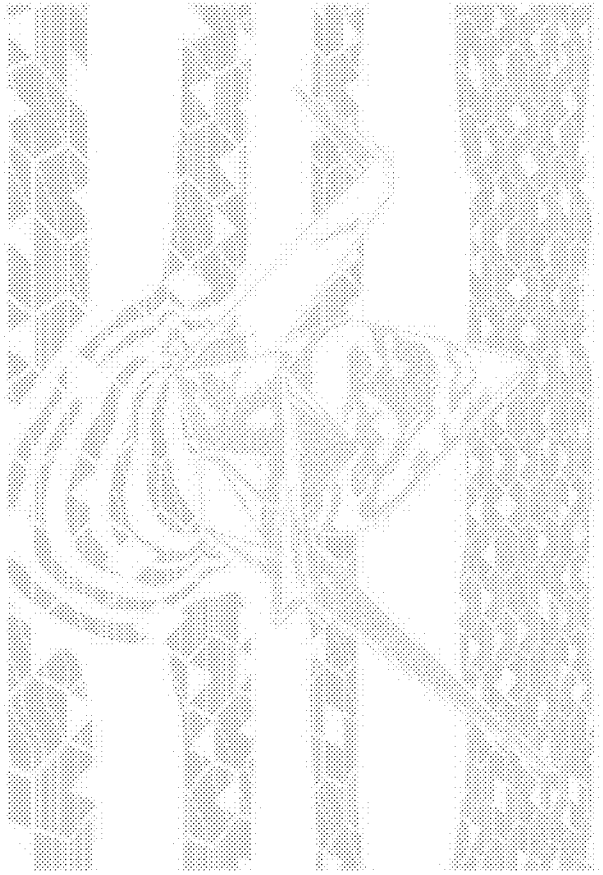
Figure 24:
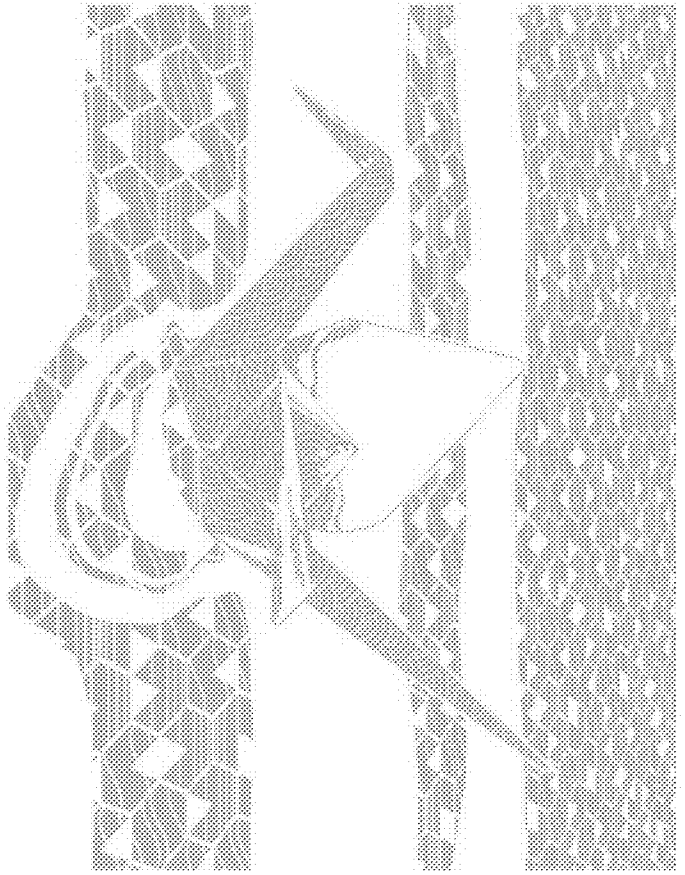
Figure 25:
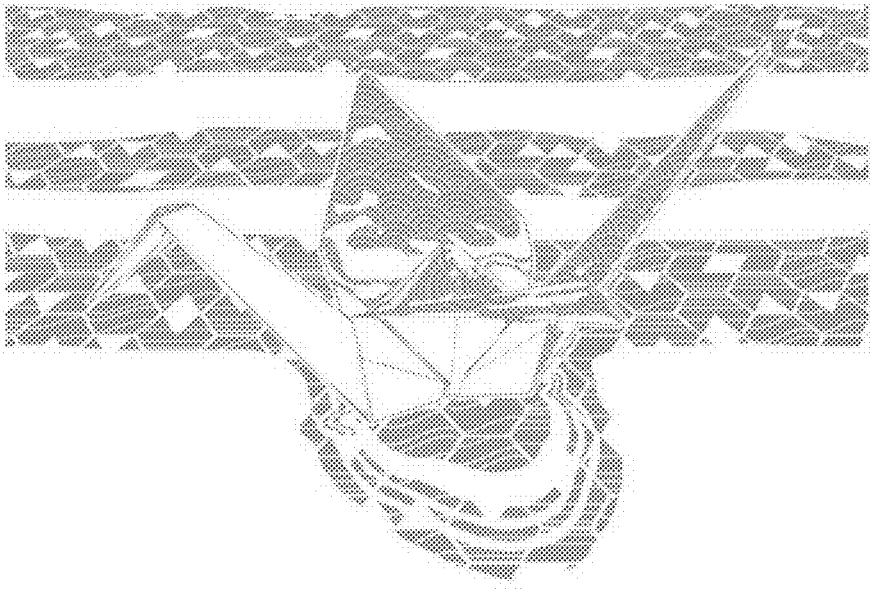
Figure 26:
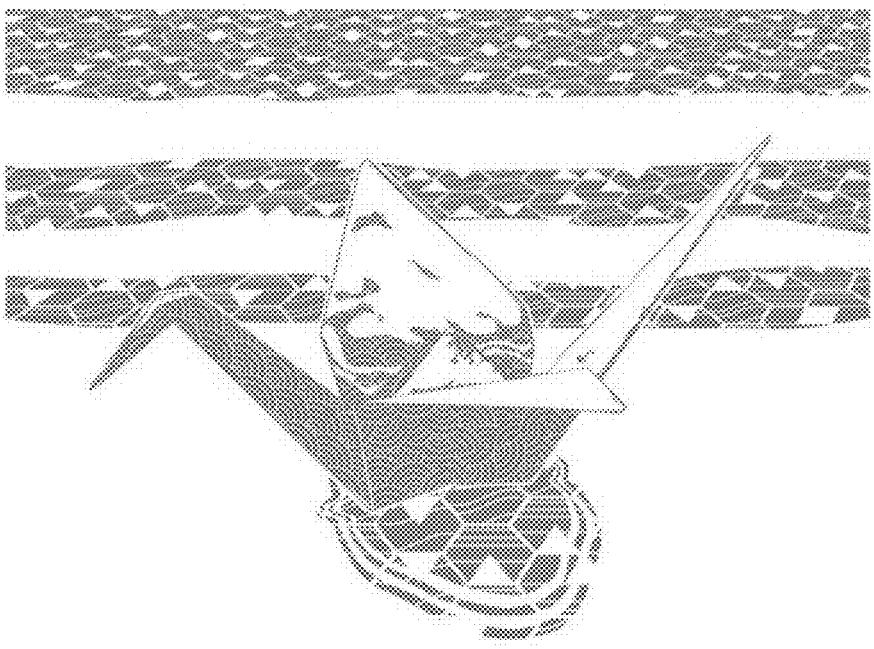

Each of these maroon inks is deployed in one of four stations in a hypothetical offset press, so each plate prints an image of a different opacity. FIG. 22 shows how a set of hex elements with similar (but not identical) artwork, each printed using inks of different opacities, combine so the interior of each hex contains several different image densities, up to a maximum opacity determined by which inks are combined. FIGS. 23 through 26 show four hypothetical document artwork designs based on a crane and hex theme, where each segregated shape is separated from the others by white space (to prevent line tracing) and contains a slightly different combination of artwork and opacities from nearby shapes. Display of darker print in the composite image shown in FIGS. 27 and 28 (depicting a magnified view of FIG. 27) relies on applying multiple translucent ink layers to the same substrate area (instead of covering more of the substrate surface with a single ink formulation). Each shape in FIGS. 27 and 28 contains images from as many as four plates, but not always all four.

Figure 27:
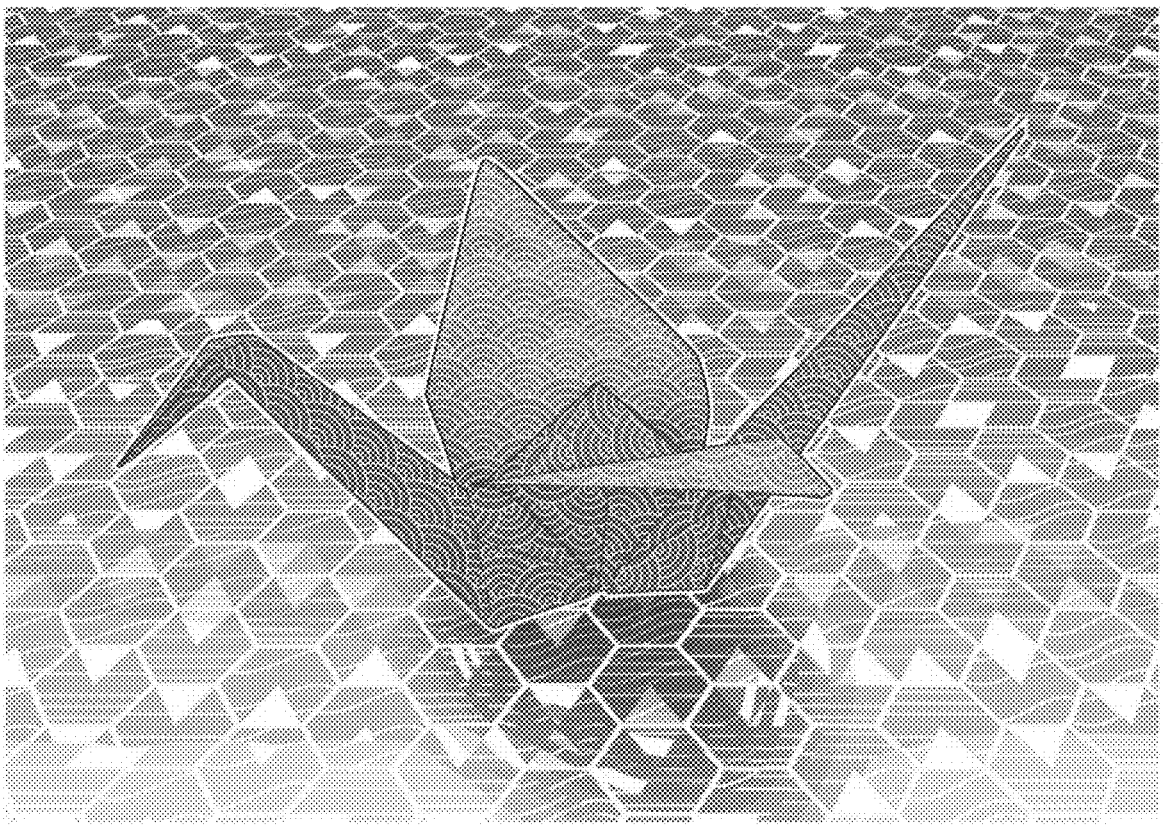
Figure 28:
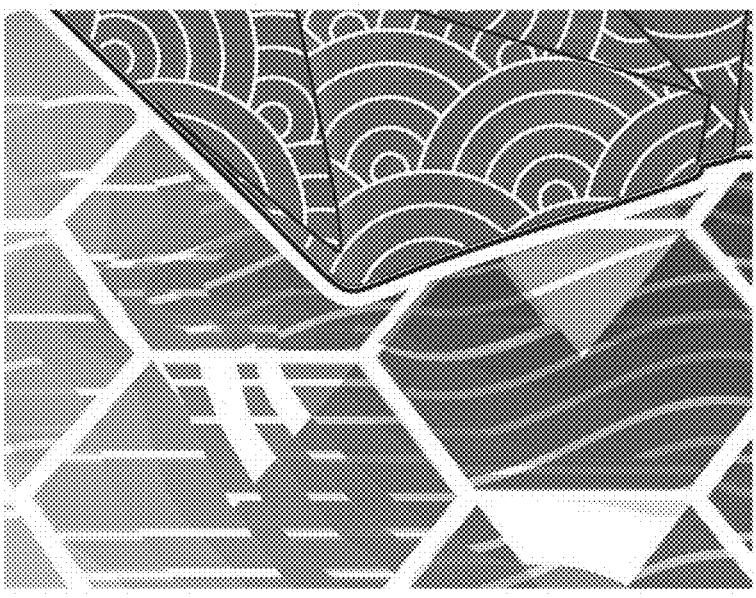
Figure 29:
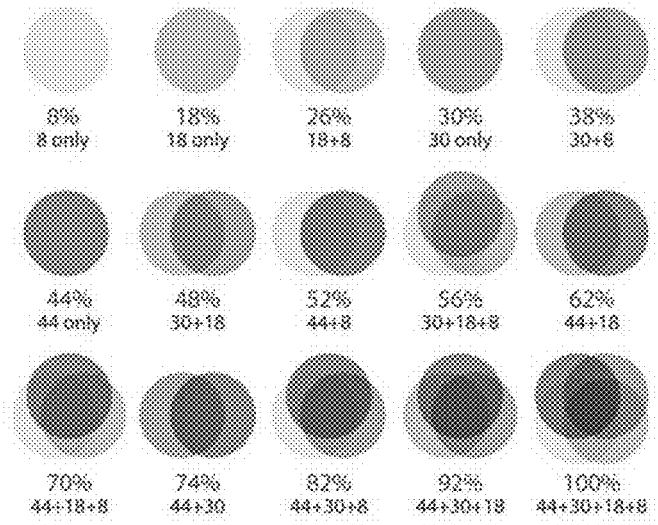
FIGS. 29 and 30 illustrate example opacity combinations for use in sample artwork, in accordance with example embodiments.

FIGS. 27 and 28 contain fifteen discrete densities that depend not only on the number of plate images overlapped, but also which particular inks have been combined. FIG. 29 shows the fifteen possible combinations, from each plate alone up to all four plates in combination. Some of the shape elements shown in FIG. 27 are printed from only one plate, and for those the opacity of the ink layer can only correspond precisely to the opacity of one of the individual inks: 8%, 18%, 30% or 44%. Some areas are printed by all four plates, producing a maximum combined opacity approximating 100% as four images overlap in the darkest areas. For shape elements composed of two or three plate images the potential opacity combinations become more varied, resulting in a total diversity of ink opacities that ranges from 8% up to 92%, with other values distributed in between (see FIG. 29).

Although the hex elements in FIG. 27 are of a similar exterior shape, their interiors contain different patterns of lines or cutouts that provide multiple density levels in the interior art of each hex. If artwork were designed with greater complexity than the simple hexes and semicircles in this example, it would even be possible to incorporate all fifteen opacity levels, and unique artwork, into the interior of every isolated shape in FIG. 27. Contrast this with the basic monochromatic design strategy described earlier, which can only produce a number of density levels equal to the number of plates, if all fountains contain identical inks. A greater number of density levels allows for more design flexibility and more artwork complexity, and potentially a higher resistance to reverse engineering. The key question is whether it is possible to work backwards from FIG. 27 to isolate its component images, FIGS. 23 through 26. Although FIG. 27 could be originated and printed by a genuine document issuer, the design makes it hard for counterfeiters to deconstruct FIG. 27 into its component parts, which prevents replication of individual plate artwork and the production of high-quality counterfeits.

Varying ink opacity as described above can increase the number of discrete densities available, but does come with some potential drawbacks. For example, a few of the shapes in FIG. 27 are printed from only one plate, which shows each individual ink in isolation and could help a dedicated counterfeiter to understand the artwork where multiple plate images do overlap. Allowing counterfeiters this insight is contrary to the stated purpose of the monochromatic strategy, which is to systematically deny access to information about the press setup and thereby prevent reverse engineering of the artwork.

There are three potential solutions to this challenge, all of which work to conceal not only the number of plates and the plate artwork, but also the opacities of the inks. One option is to minimize the amount of artwork printed only by one plate and maximize the amount of artwork composed of two or more overlapping plates. However, this approach cannot fully eliminate small areas of single plate art inside the individual shapes without also causing undesirable design redundancies and reducing the availability of lighter opacity levels, so it is of limited utility. The second possibility is to use split fountains to transition between two inks of similar color but of different opacities, instead of for the conventional purpose of transitioning between two different colors. This would allow multiple ink opacities to be deployed in each fountain, which prevents counterfeiters from associating a fountain to a single ink formula based only on examination of a small area of artwork printed by one plate. The third option, reducing visible opacity differences between the four inks in the set, is addressed in more detail below.

In the previous example, an association can be drawn between ink opacity and plate artwork because each fountain contains its own unique ink opacity. In theory, anything that helps a counterfeiter differentiate between the artwork on different plates could be exploited in a reverse engineering process. Therefore, the benefits of using inks of different opacities appear to conflict with the more fundamental goal to eliminate cues that could help a counterfeiter isolate the artwork on various printing plates. These competing priorities can be reconciled by choosing four inks with less disparate opacities that appear more visually similar, but can still be overlapped to generate a larger number of opacity combinations.

Figure 30:
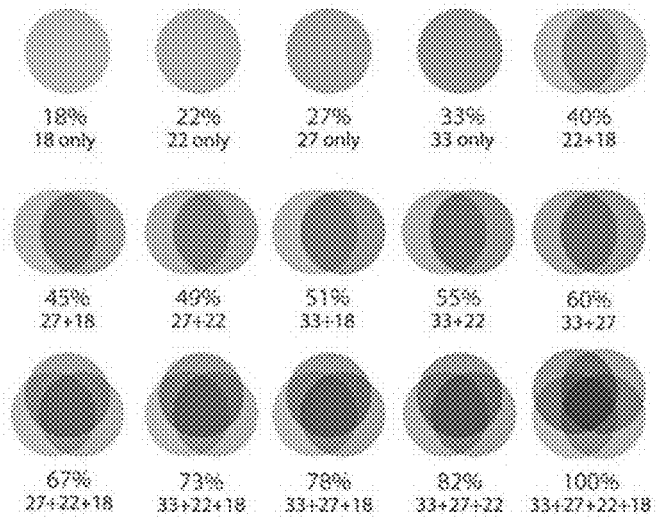
Figure 31:
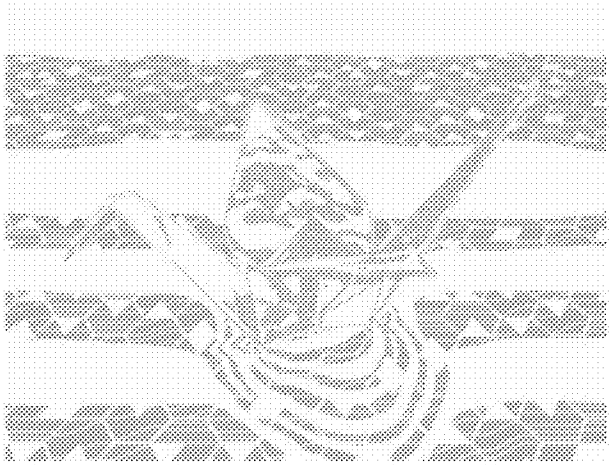
FIGS. 31-45 illustrate sample artwork in accordance with example embodiments.
Figure 32:
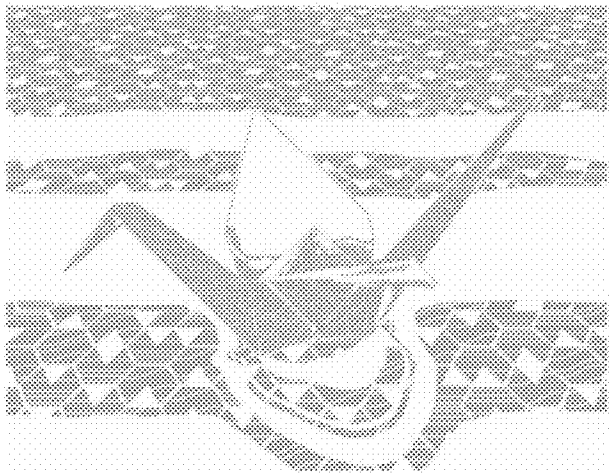
Figure 33:
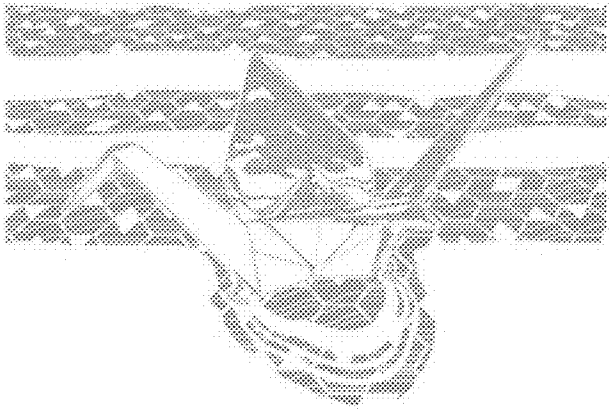
Figure 34:
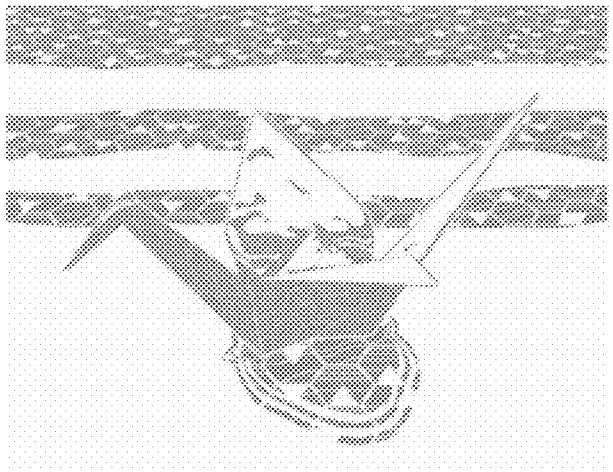

The four individual inks shown in FIG. 29 (8%, 18%, 30% and 44%) are easy to distinguish visually because they differ substantially in opacity. In contrast, FIG. 30 shows a different set of four inks with subtly different opacities (18%, 22%, 27% and 33%) which are visually similar and more difficult to distinguish. For example, the 18% and 22% inks appear similar to one another, as do the 22% and 27% inks, and the 27% and 33% inks. The possible midlevel densities available in FIG. 30 encompass a smaller range than those in FIG. 29 (from 18% to 82%, instead of from 8% to 92%), so the use of more similar inks comes at the cost of some design flexibility, since the scope of middle values is reduced. FIGS. 31 through 35 illustrate how the more similar ink opacities shown in FIG. 30 translate into a composite image that still contains fifteen different maximum densities, though they are constrained to a more compressed range.

Figure 35:
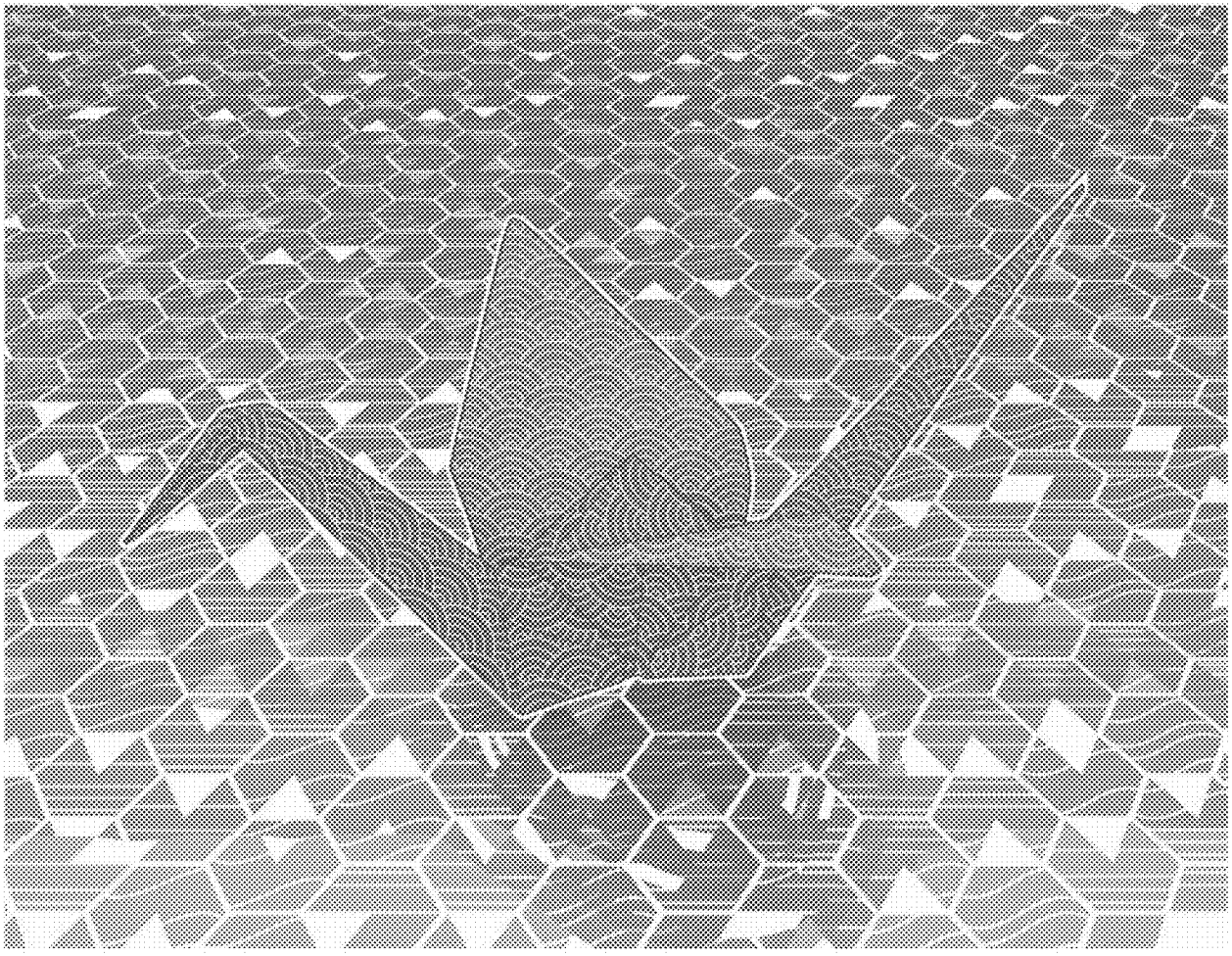

When comparing FIG. 27 to FIG. 35, both would be very complicated to reverse engineer, but each of these competing approaches has advantages and limitations. In FIG. 27 the individual inks are easier to discriminate, which provides more design flexibility and a wider range of combination opacity values when artwork is overlapped. In FIG. 35 the individual inks are harder to discriminate, which restricts the availability of some lighter and darker middle tones, but helps to further conceal the artwork on the individual plates. A hybrid approach, such as using a particular opacity more than once, is also an option (for example, opacities of 20%, 20%, 27% and 33%).

As set forth above, one potential limitation of the purely monochrome design strategy described earlier is its inability to produce a large number of discrete density values. Thus, by varying the opacity of inks within the monochrome design strategy, a larger range of densities can be created using a fixed number of printing plates. However, associating specific ink opacities with specific printing plates could risk providing information to a counterfeiter about the press setup. To capture the benefits afforded by multiple ink opacities while reducing reverse engineering risk, a relatively narrow range of ink opacity values and liberal overprinting of plate artwork help mask the opacities of individual inks. Furthermore, the link between a single plate and a single discrete ink opacity can be broken by using split fountains to place multiple ink opacities in each fountain.

Figure 36:
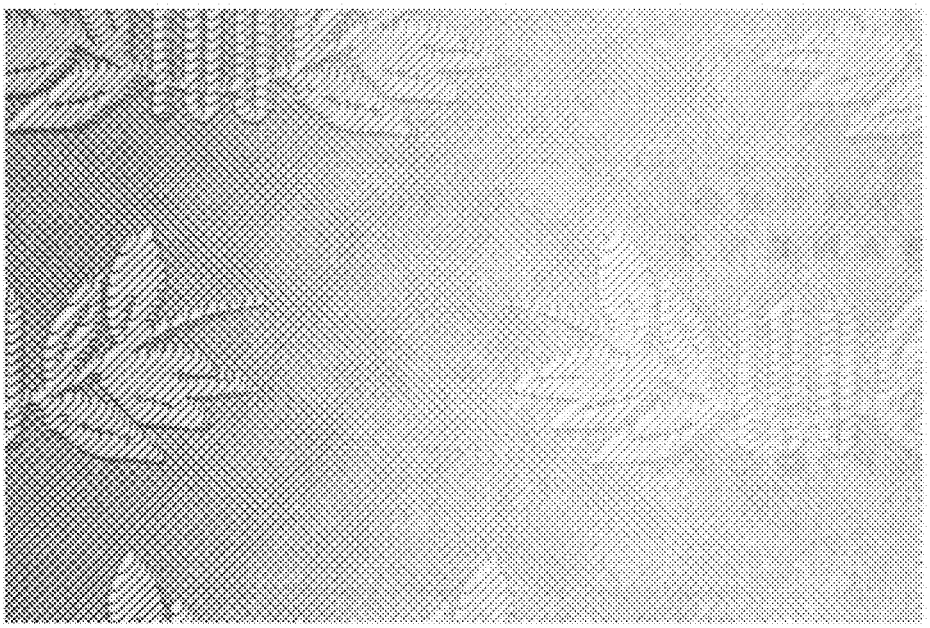
Figure 37:
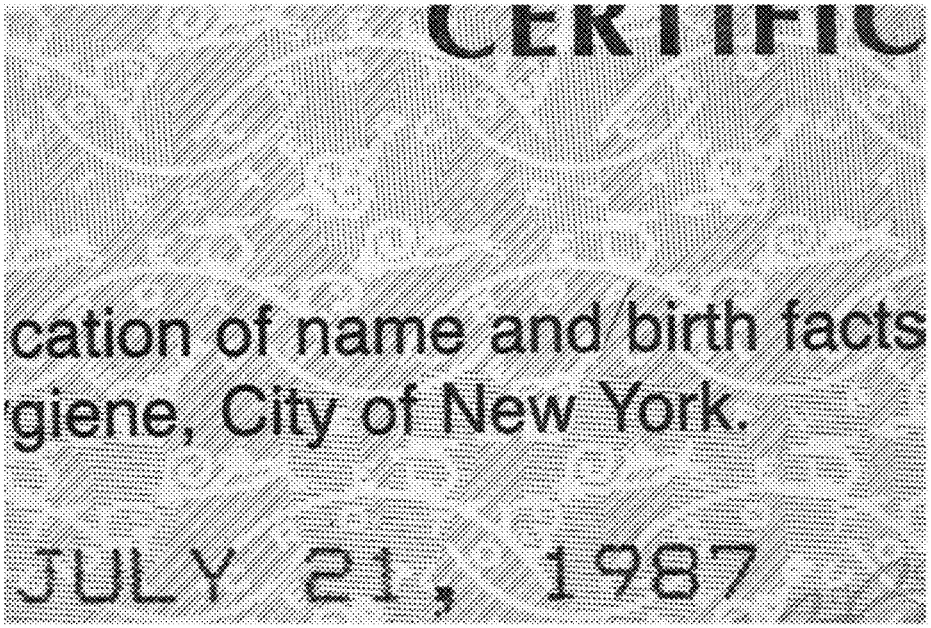
Figure 38:
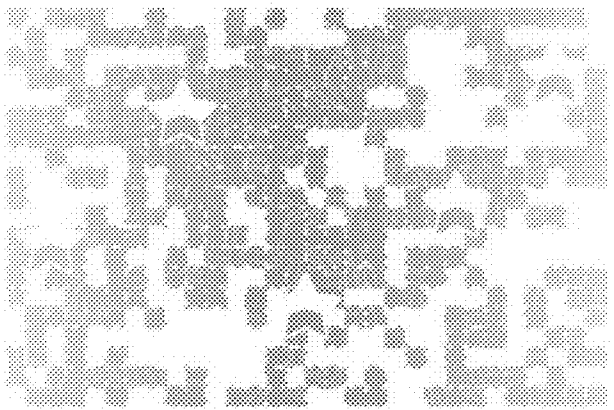
Figure 39:
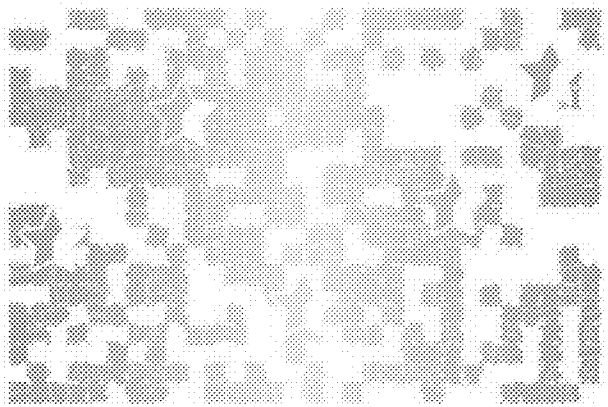
Figure 40:
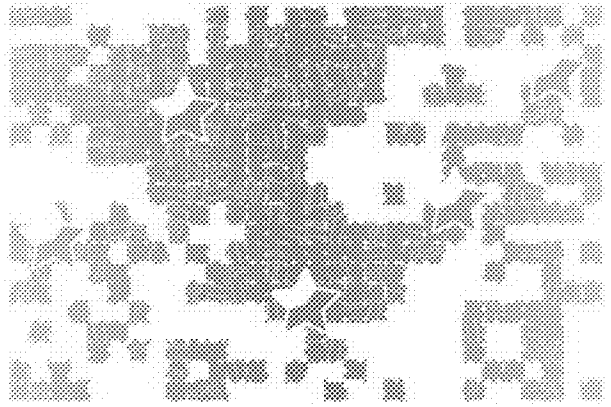
Figure 41:
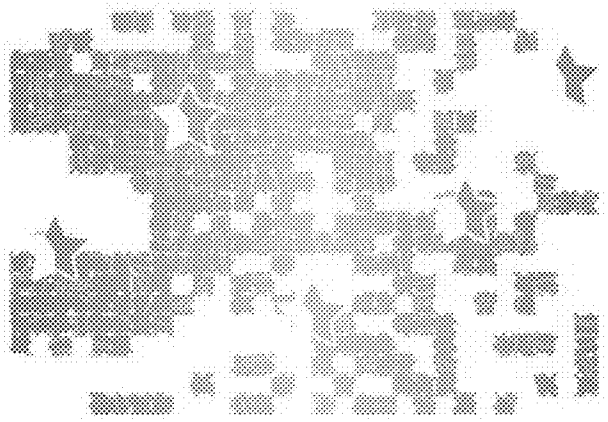

To achieve this level of split fountain printing, split fountains must be fundamentally rethought if they are to be adapted for this new function. Typically, split fountain printing involves blending one color of ink with another on press before a plate is inked, which creates a seamless color transition in the printed artwork. Some examples are shown in FIGS. 36 and 37, which show color transitions only in the horizontal direction, which is a consequence of printing press mechanics, and horizontal transitions can be seen in the majority of security documents.

Despite this limitation, split fountain press hardware is customizable across a broad range of other variables. For example, the pure inks can be placed in various horizontal locations, and in bands of varying widths, across each fountain. The transition areas across which the pure inks are blended can also be of varying widths and placement. The number of inks and ink transitions can also vary, from two pure inks up to five or more inks in a single fountain.

The examples provided herein have been discussed in the context of using only one color of ink, but techniques for color transition (as demonstrated in FIGS. 36 and 37) may also be applied in a monochromatic design. Since the ink formulations described earlier differ by opacity, not color, a split fountain could be used to transition between two ink opacities instead of between two colors. This is the fundamental adaptation that converts split fountains into a tool for combating artwork replication, and in this usage split fountains serve two functions.

First, each split fountain can print a continuum of "spot" ink opacities that vary continuously as the pure inks blend across the horizontal width of the split, producing a theoretically infinite number of discrete opacities within each individual fountain. When all plates are printed, the combined artwork displays many more opacity levels than the fifteen discrete opacities possible using the strategy described earlier.

Secondly, split fountains permit inks of many opacities (instead of only one) to be delivered from each individual printing plate, and also permit inks of the same opacity to be delivered from different printing plates. The link between ink opacity and plate artwork is therefore severed. If no relationship associates each pure ink to only one plate, then studying small areas of print in a finished document does not provide insight about the inks in other parts of that fountain, or the artwork on other parts of that plate. If the individual plates cannot be decrypted, the artwork cannot be replicated accurately.

In one example, a process may utilize a four-station offset press, with split fountain hardware mounted on all four stations, where the split fountain hardware is configured the same way in all four fountains. The only element that is changed between fountains is the placement of various pure ink formulations. The four sets of individual plate artwork shown in FIGS. 38 through 41 each utilize a split fountain transition between two inks of the same color, but different (theoretical) opacities.

The first fountain may contain inks of 8% opacity at the edges and 30% opacity at the center, the second 30% opacity at the edges and 8% at the center, the third 18% opacity at the edges and 44% at the center, and the fourth 44% opacity at the edges and 18% at the center. These opacities are purely selected as examples for ease of explanation, and the formulations are not intended to be restricted to such opacities.

Figure 43:
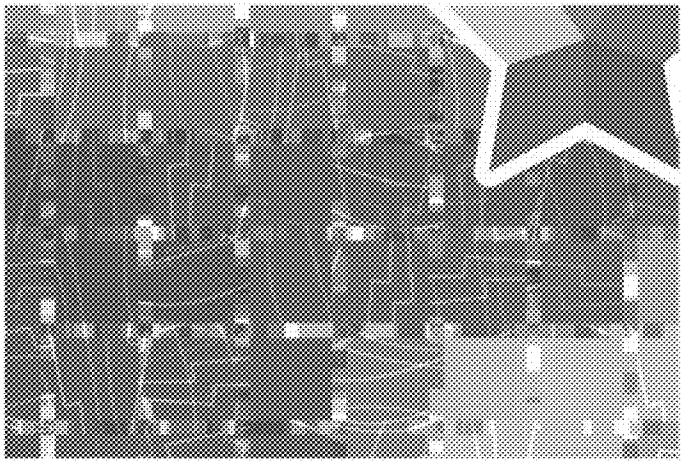
Figure 42:
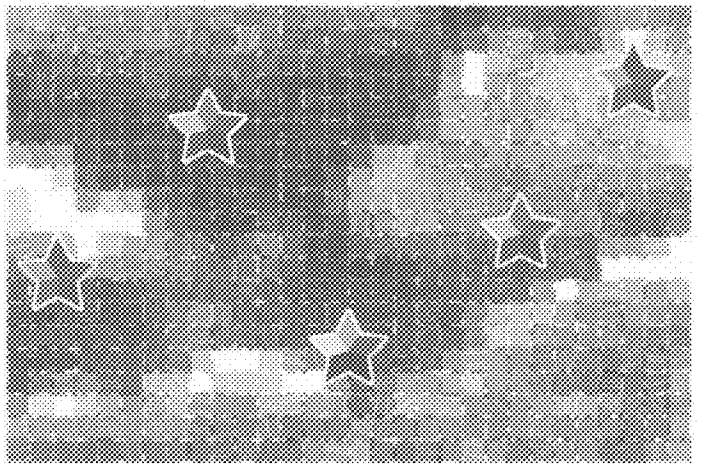

Based on the four sets of individual plate artwork as shown in FIGS. 38 through 41, the composite artwork of these four plates is shown in full in FIG. 42, and magnified in FIG. 43. Inks with exaggerated opacity differences were chosen to make the transitions easy to see in FIGS. 38 through 41, but as discussed earlier, inks that are more similar in opacity (18%, 22%, 27% and 33% instead of 8%, 18%, 30% and 44%, for example) may provide better protection against redrawing of the artwork. Split fountain transitions between inks of more similar opacities could be appropriate in a real security document, because it would more effectively mask the presence of the splits.

The transitions in FIGS. 38 through 41 each produce a continuum of "spot" opacities that span between each pure ink. When the plates combine in FIG. 42, the number of density combinations is theoretically infinite, and in any practical case still exceeds the maximum of fifteen discussed earlier. Furthermore, each of the four pure inks (8%, 18%, 30% and 44%) is deployed on two different plates in the set shown in FIGS. 38 through 41, and each plate prints a similar range of opacities to the other plates. Such a process greatly disrupts a counterfeiters attempts to isolate the four original plates. Not only is color denied as a point of reference, as it was in the monochromatic strategy presented above, but ink opacity has also been denied because each ink opacity in this configuration is no longer associated to just one printing plate. Counterfeiters attempting to circumvent replicating the plate artwork by trying to reproduce the density values in FIG. 42 directly will find such an attack considerably more difficult and will be further pushed to simulate the artwork, rather than replicate artwork, assuming the difficulty does not derail the attack completely.

Finally, the split fountains can be seen clearly in FIGS. 38 through 41, but are disguised in FIG. 42. In this example the concealment of the splits is intentional, because a counterfeiter that cannot identify the presence, placement, or composition of the splits cannot replicate the plate artwork or the press setup. However, alternative design strategies that deliberately display the presence of the splits in specific ways may also be utilized for certain advantageous purposes.

The artwork shown in FIGS. 38 through 41 complies with the basic monochromatic design strategies described earlier. As previously discussed, these strategies include a restricted color gamut, the same artwork style on every plate, darkening areas by overprinting multiple plates instead of widening lines, and limiting use of continuous artwork patterns. Additionally, the artwork in FIGS. 38 through 41 consists of two components that illustrate different concepts related to the presence of the split fountains: five large star graphics and a background pattern composed of squares. The stars are less complicated than would be appropriate for a real security pattern, and have been included primarily because they provide an easy way to illustrate how the printed appearance of identical artwork changes depending upon its horizontal location within the split fountain design.

Figure 44:
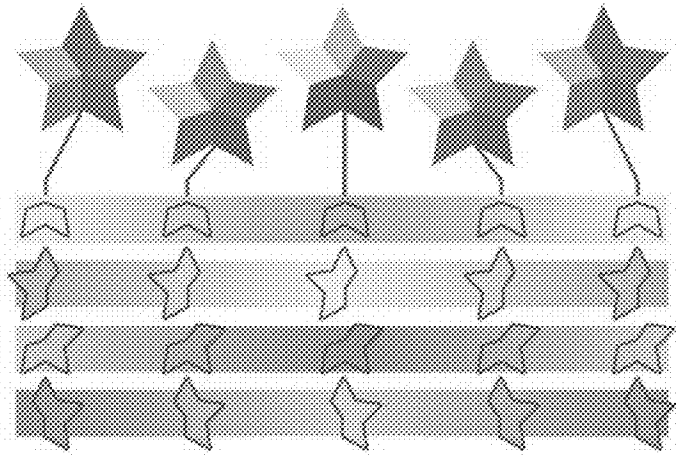

FIG. 44 shows how the five stars at the top, which have been extracted from FIG. 42, were created by the overlap of the same basic plate artwork printed with inks of different opacities. Each star at the top of FIG. 44 looks different from the others because the ink opacities printed from each plate are different for each star location, as a result of the split fountains. This is also true for the squares in the background pattern, which, unlike the stars, were more deliberately designed to deter reverse engineering.

The background design in FIG. 42 derives from an arbitrary image of a sky with clouds that contains lighter and darker areas, and has been converted to a pattern of overlapping non-identical squares. Darker areas of the background pattern are created not by widening lines or covering more of the paper with ink, but by layering multiple plate images. The appearance of each composite square in FIG. 42 depends on how many plates, and which plates, were overprinted in that particular location based on which ink opacities must be combined to approximate that part of the cloud image. Although each square in FIGS. 38 through 41 covers approximately the same surface area, each composite square in FIG. 42 shows different interior artwork and a complex edge contour where they overlap. The generation of the composite squares from plate overlap is shown magnified in FIG. 45.

Figure 45:
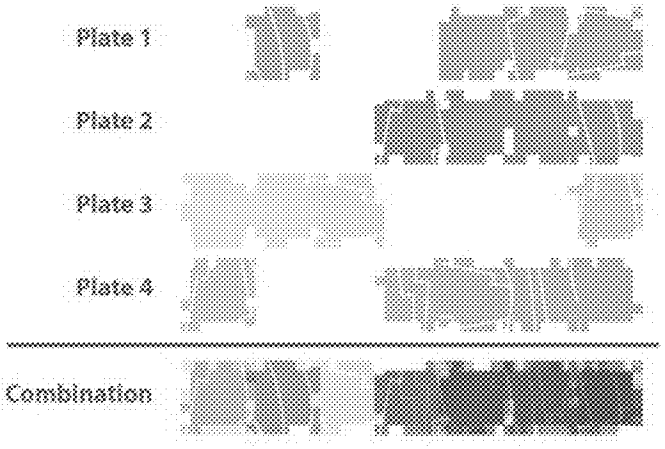

Unlike the hex elements that form the background pattern in the examples provided earlier, which have hard edges and are bounded by unprinted white space, the squares shown in FIG. 45 have erratic contours that extend into the white borders. This produces irregular overlap between the squares, increasing artwork complexity while still inhibiting tracing of patterns across the design.

These developments change the microscopic appearance of the squares in several ways. First, in the earlier examples, the density of the cutouts and lines in the interior artwork of each of the hex elements was always limited to one of the discrete density values available (four or fifteen, respectively). In contrast, the areas of the squares shown in FIGS. 42 and 43 that do not match between different plate images—specifically, the erratic edge contours and the patterns of jagged or curved lines through the interiors—show opacities that change dynamically across the width of the design, and are no longer limited to a short list of certain values. This has the visual effect of changing the contrast between the opacity of the main body of each square, and the edges and lines, such as exhibited by the lines inside the squares shown in FIG. 43. In some cases, the lines show high contrast with the body of the square, and in other cases, the lines show low contrast and are barely visible, and the same effect can be seen where the square edges overlap.

The split fountain strategy therefore increases artwork complexity beyond what is possible using the design strategies discussed earlier, and can make reverse engineering of document artwork even more complex and tedious. Additionally, split fountain printing offers a large number of variables that can provide additional options for split fountains to prevent artwork reverse engineering. Although the strategies described above include the goal of concealing the presence and placement of the splits, other design strategies that showcase and emphasize the presence of the splits also have advantages and can provide added security against certain counterfeiting strategies. Furthermore, techniques for optimizing split fountain variables, such as the width, location and quantity of split fountains in a four-station press, may also be utilized.

Split fountain strategies can be used to increase ink opacity gamut, without needing to conceal the split fountains. For example, overt ink opacity transitions can be used that can be inspected visually like traditional split fountain designs, but which do not correspond to the actual split fountain configurations on the press. This strategy conceals the real press setup from counterfeiters while retaining the traditional counterfeit deterrence benefits of a visible split fountain.

The application of split fountain techniques in security printing produces a seamless transition between two colors, but split fountains can be applied differently for the prevention of artwork reverse engineering. By rethinking split fountain techniques, monochromatic example designs were provided above, in which the split fountains were visible on each of four individual plate images, but were deliberately concealed in the composite image. This concealment of the split fountains is consistent with design priorities which endeavor to prevent counterfeiters from understanding or replicating the individual plate artwork. However, split fountain printing offers additional strategies, such as a goal of simulation of overt, but false, split fountain transitions that do not actually exist on press, preventing counterfeiters from understanding or replicating the individual plate artwork.

In contrast to the strategy of split fountain concealment, in conventional security printing many split fountains are an overt part of the design intended to be inspected both visually and with magnification. The security value of a split fountain derives in part from physical split fountain hardware mounted on each press station to control the supply and placement of multiple inks within a single fountain, which creates microscopic print characteristics that are specific to this method of printing color transitions. Some counterfeiters do not possess split fountain hardware, or choose to counterfeit with digital printing equipment; in either case, a simulated split fountain in a counterfeit document does not look like a true split, and can be detected with a magnifier.

Figure 46:
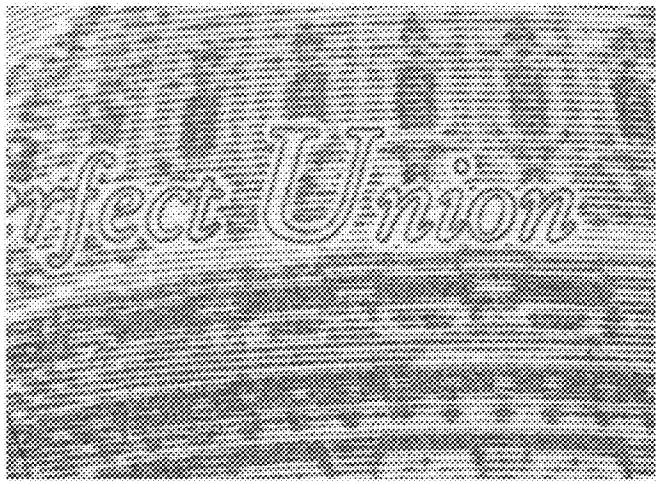
FIG. 46 illustrates genuine split fountain artwork transitioning between different colors in accordance with example embodiments.

FIG. 46 illustrates genuine split fountain artwork printed from a single printing plate, showing a seamless and gradual transition between true green and brown inks. The presence of the split is obvious and the split is designed to be inspected visually and with magnification. True split fountains in typical genuine security documents (and some sophisticated counterfeits) show a smooth, continuous transition from one color of ink to another. The genuine document shown in FIG. 46 shows a split fountain transition from green ink on the left to brown ink on the right. The green and brown inks are blended together in the press before being printed from a single printing plate, so the transition between the two colors is seamless across the plate artwork. In contrast, a counterfeiter without access to split fountain capabilities may simulate the visual effect of the split fountain by printing the design with two separate printing plates in two separate printing steps, with one plate for each color.

Figure 47:
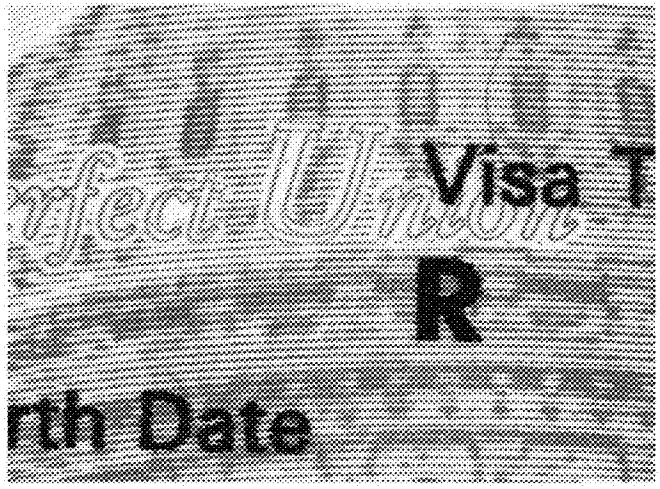
FIGS. 47 and 48 illustrate counterfeit sample artwork simulating split fountain transitions between different colors in accordance with example embodiments.

FIG. 47 illustrates counterfeit artwork containing a simulated split fountain. Unlike FIG. 46, the green and brown inks in the image of FIG. 47 were printed from two different plates. Misalignment of these two plates can be seen most easily in the letter 'U' and nearby areas. In the counterfeit shown in FIG. 47 the green and brown prints are not in register with one another, which presents as a double image in the letter 'U' and nearby areas where the green and brown impressions are not well-aligned. The presence of the split fountain in FIG. 46 drives the need for the method of simulation shown in FIG. 47, and allows for its use as a counterfeit detection point.

Figure 48:
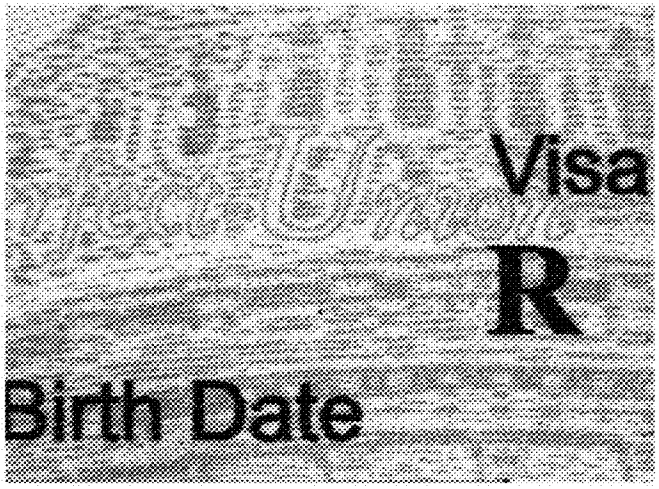

Other methods of simulating split fountains include digital printing, as shown in FIG. 48, which exhibits the pattern of cyan, magenta, yellow and black (CMYK) process color dots that is evidence of digital counterfeiting. The green and brown inks shown in FIG. 46 have been simulated here with CMYK process color dots corresponding to digital counterfeit artwork printed by inkjet. This print does not actually contain any green or brown ink. Compare to FIG. 46. Although colored dots are a feature of process color digital counterfeits even in documents that do not contain split fountains, the split fountain contributes additional value because the printing device must simulate a continuum of colors, which can help increase the visibility of the dots and make detection easier.

FIGS. 46-48 illustrate that split fountains can be inspected for the presence of a seamless microscopic transition between colors, and that the presence of double images or colored dots in the area of the split can indicate a counterfeit. This approach suggests that split fountains should be incorporated into documents in visible ways that make them easy to locate and examine. However, as described above, it can also be desirable to conceal the presence and placement of split fountains, because concealing the splits helps to obfuscate the plate artwork and press setup, which inhibits artwork reverse engineering. In the following discussion, these competing priorities will be reconciled in a design that includes visible splits that can be inspected microscopically, but which simultaneously conceal the real split fountains in the press configuration.

Figure 49:
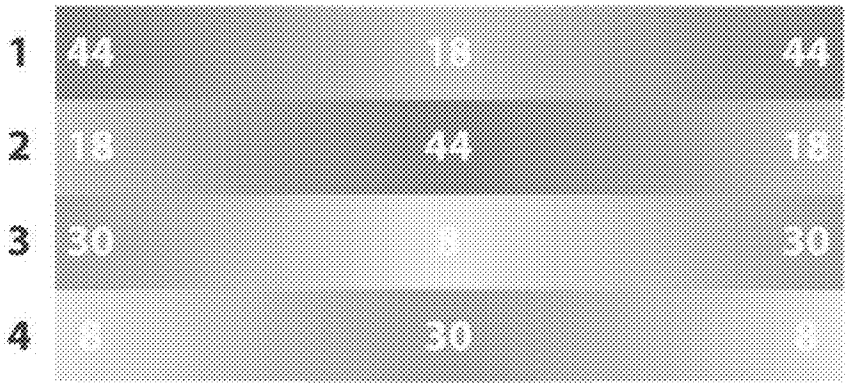

Certain paired split fountain configurations can simulate the presence of non-split ink stations, making it appear that the press setup includes up to three fountains that print ink of constant opacity. A four-station offset press, with the physical split fountain hardware configured the same way in each station, can be used as an example press setup. FIG. 49 shows the distribution of ink densities across the width of the form rollers in each of the four stations, illustrating opacities of pure inks delivered from each of four fountains on press. Unlike split fountains in security printing using different colors, here the split fountains transition between inks of the same color, but different opacities. The first plate shows a split fountain transition between inks of 44% opacity at the edges and 18% opacity at the center, the second plate between 18% and 44%, the third plate between 30% and 8%, and the fourth plate between 8% and 30%. Note that FIGS. 49 through 51 depict only the placement and distribution of ink opacities across the width of each fountain, and do not include plate artwork designs.

The first two stations contain the same pair of inks (44% and 18%) but the inks are placed in opposing positions, such that the first station has the 44% ink at the edges and the 18% ink at the center, and the second has the 44% ink in the center and the 18% ink at the edges. The third and fourth stations are similarly opposites of one another (but using 30% and 8% opacity inks). Given previously stated assumptions that for this explanation ink opacities add linearly when overprinted, printing these opposing pairs together mimics the presence of one station that prints a single constant opacity. For example, FIG. 50 illustrates how overlapping the first two stations approximates a constant opacity of 44%+18%=62%, and the third and fourth stations combine to approximate a constant opacity of 30%+8%=38%. In concept this is true across the full width of the fountain, since where one plate of the pair prints ink of a higher opacity, the other plate prints ink of a lower opacity to compensate. If all four stations are similarly overprinted, the inks theoretically approximate a constant opacity of 100% (44%+18%+30%+8%). Thus, the overlap of paired split fountain inks in FIG. 50 approximates the presence of a non-split fountain. When combined, the first two plates approximate a combined opacity of 62% and the third and fourth plates approximate a combined opacity of 38%. When all four plates are combined, the opacity approximates 100%. Compare to FIG. 49. The placement and width of the physical split fountain hardware must be identical in all four fountains for the combined opacities to approximate 100% at all horizontal points in this model.

Figure 50:
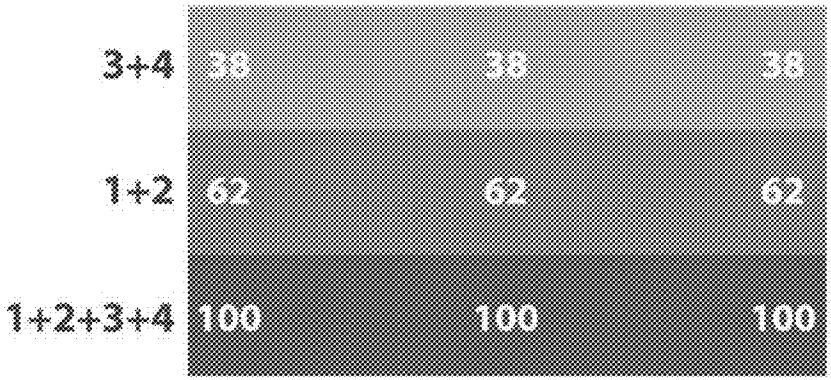
FIG. 49-51 illustrates artwork transitioning between different opacity levels from four printing plates corresponding to four ink fountains in accordance with example embodiments.
Figure 51:
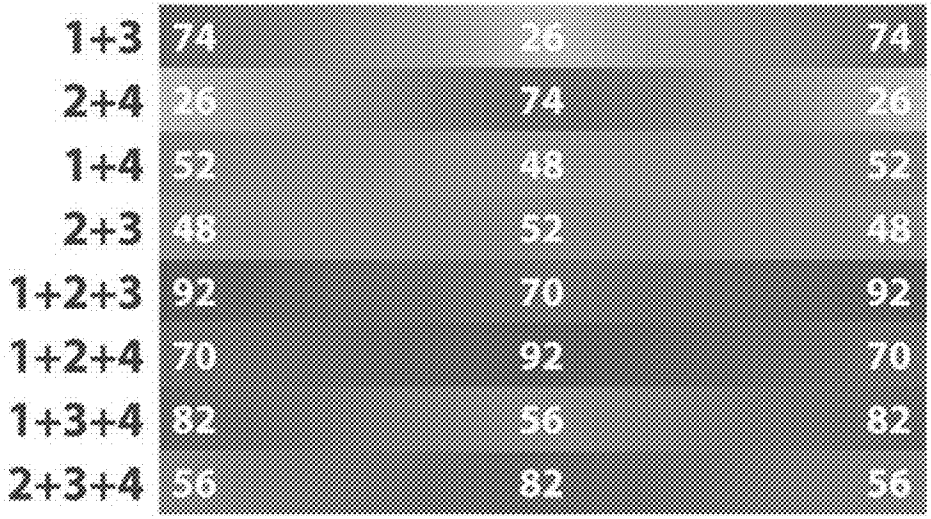

As illustrated in FIGS. 49 and 50, paired split fountains with opposing ink placements (FIG. 49) can simulate the presence of ink fountains that do not contain splits (FIG. 50). However, this approach conceals the presence of the split fountains, so they cannot be inspected overtly. Because an overt, visible split fountain can facilitate counterfeit detection (FIGS. 46 through 48), it can be desirable to incorporate some visible split fountain effects while still concealing the press setup. This section describes how overlap of two or more split fountain configurations that are not opposing pairs can present false split fountain transitions. These false opacity transitions are overt and can be inspected visually or microscopically like a conventional split fountain, but at the same time conceal the true configuration of the actual split fountains in the press setup, which makes it more difficult to reverse engineer the document artwork.

As set forth above, paired split fountains can be used to approximate three flat opacity levels (38%, 62% and 100%, using the arbitrary opacities in the example), but as many as eight false split fountains can be mimicked by overprinting two or more split fountains that are not configured with opposing ink placements. The eight combinations are shown in FIG. 51, and result from overprinting of any two or three stations other than the paired opposites shown in FIG. 50. In some cases, the opacity change of the combined split fountains in FIG. 51 is in the same direction, resulting in a combination that shows even larger opacity differences than the individual fountains (for example, 26% to 74%). In other cases, the splits partially compensate for one another and almost simulate a constant opacity (for example, 48% to 52% is hardly a change at all). Again, the opacities and math used above are for illustrative purposes only, and actual values would be optimized for use with actual designs and real printing workflows.

Figure 53:
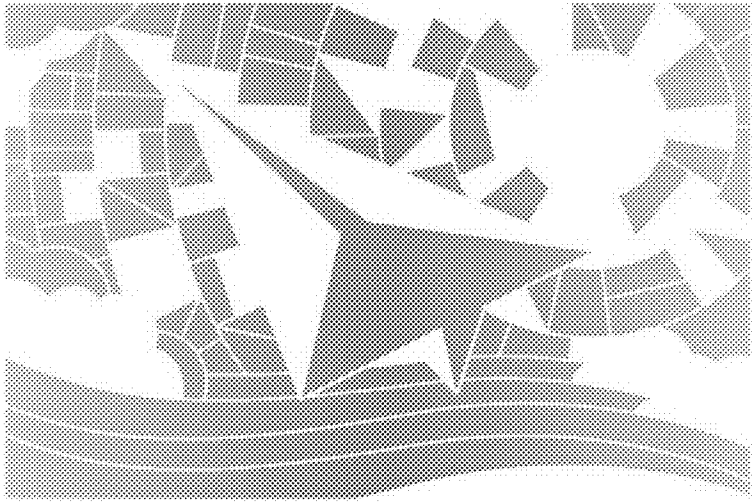
FIGS. 52-57 illustrate artwork demonstrating security design concepts in accordance with example embodiments.
Figure 55:
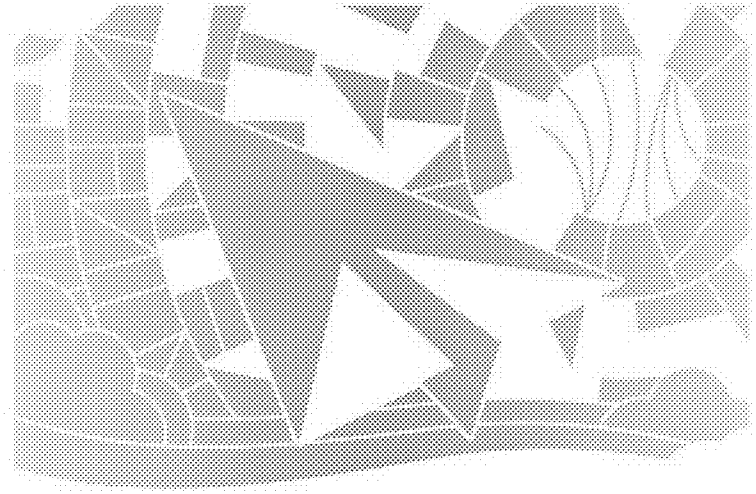
Figure 52:
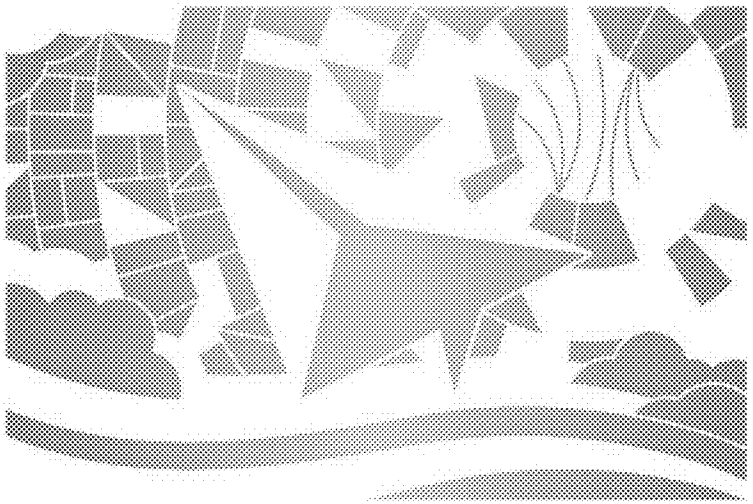
Figure 54:
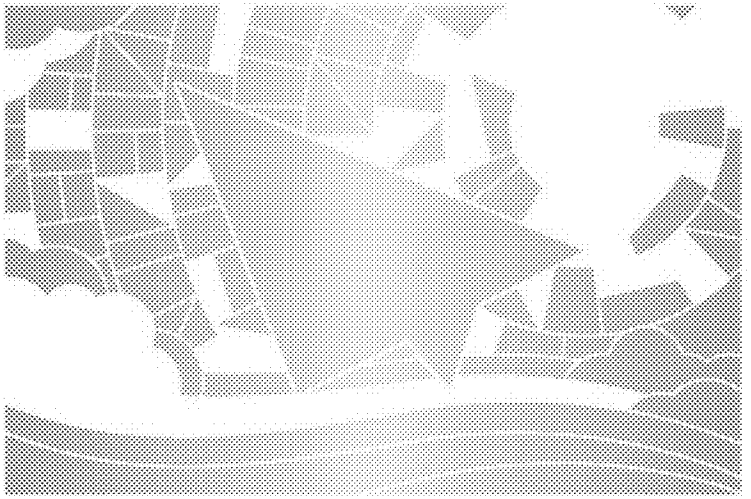
Figure 56:
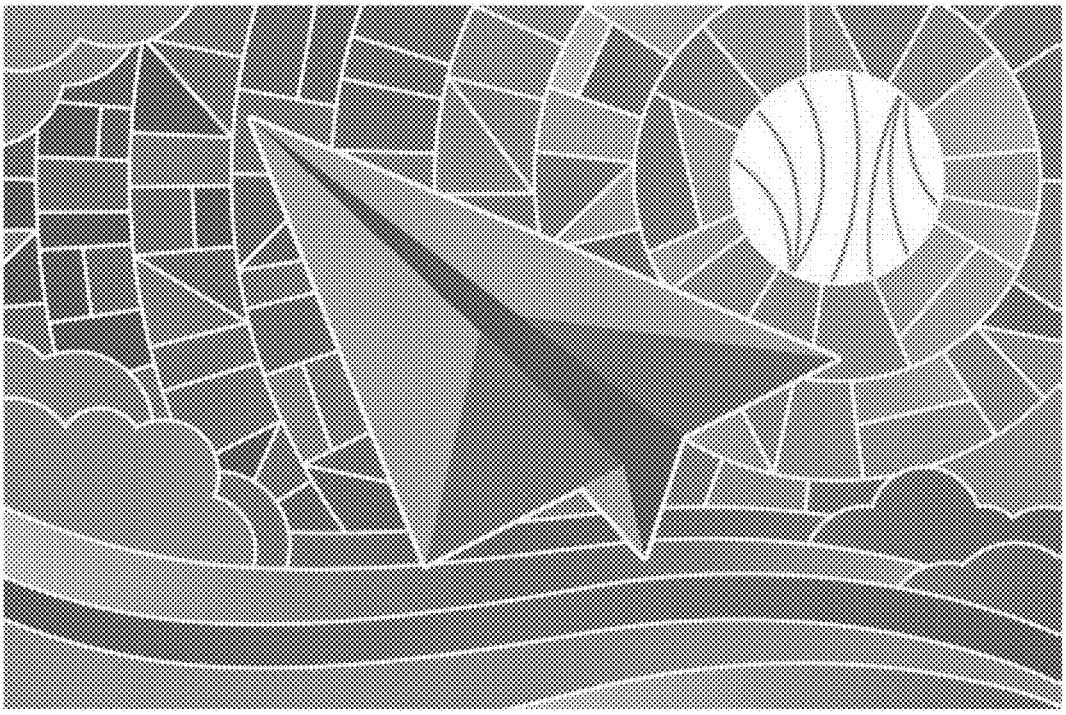
Figure 57:
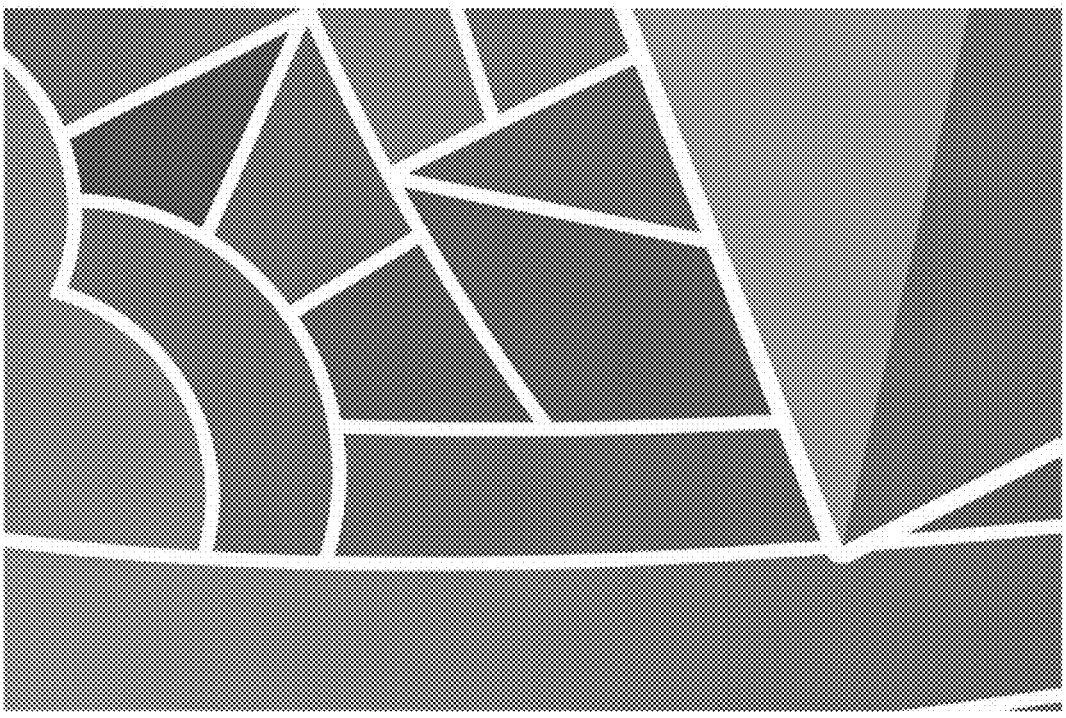

The sections above have described how four monochromatic split fountains can be combined in different ways to simulate the use of eleven stations that do not actually exist in the press setup: three fountains containing non-split ink (FIG. 50), and eight false split fountains (FIG. 51). FIGS. 49 through 51 focused on ink distribution within the press and circumvented a detailed discussion of the artwork. To introduce the critical role of artwork in this strategy, FIGS. 52 through 57 demonstrate an example security design concept that has several distinctive characteristics. FIG. 52 illustrates split fountain artwork composed of an ink of 44% opacity at the left transitioning to an ink of 18% opacity at the center, and back to 44% opacity at the right. FIG. 53 illustrates split fountain artwork composed of an ink of 18% opacity at the left transitioning to an ink of 44% opacity at the center, and back to 18% opacity at the right. FIG. 54 illustrates split fountain artwork composed of an ink of 30% opacity at the left transitioning to an ink of 8% opacity at the center, and back to 30% opacity at the right. FIG. 55 illustrates split fountain artwork composed of an ink of 8% opacity at the left transitioning to an ink of 30% opacity at the center, and back to 8% opacity at the right. FIGS. 52 through 55 can be combined to produce the illustration of FIG. 56. FIG. 56 illustrates the composite artwork produced by overprinting of FIGS. 52 through 55. The image of FIG. 56 shows three distinct opacities of nonsplit artwork and eight different false split fountain opacity transitions, none of which actually exist in the real press setup shown in FIG. 49. FIG. 57 illustrates a magnified view of a portion of the composite image shown in FIG. 56, illustrating how the split fountains are explicitly visible and can be inspected microscopically for the presence of a seamless opacity transition.

As described above, four physical stations (e.g., plates and/or fountains) can provide eleven simulated combinations different from any one of the individual stations. This approach can be generalized for a given number of physical stations, according to the following expression to calculate the sum of the combinations of available physical plates, starting with two plates and calculating the combinations up to the combination of the total number of plates:

$$S = \sum_{k=2}^{n} \left( \frac{n!}{k!(n-k)!} \right)$$

where n represents the total number of physical stations (or plates, fountains, etc.), and S represents the simulations, i.e., the sum of the combinations of, e.g., (n choose 2)+(n choose 3)+ . . . +(n choose n). For example, using n=4 plates, the total sum of combinations of simulated combinations equals (4 choose 2)+(4 choose 3)+(4 choose 4)=(6)+(4)+(1)=11 total simulated combinations available based on 4 physical plates.

A description of the multiple illustrated security design concepts follows. First, the real split fountains on the press (shown in FIG. 49) are not visible anywhere in the composite artwork of FIG. 56, which is the sum when FIGS. 52 through 55 are printed together. Stated differently, every artwork element shown in FIGS. 56 and 57 is printed from two or more plates, which prevents a counterfeiter from seeing any part of a single plate design in isolation. Second, FIGS. 56 and 57 appear at a glance to contain more than four printing plate images, and the design shown in FIGS. 56 and 57 draws entirely and only from the eleven combinations shown in FIGS. 50 and 51. Third, because the concept of FIGS. 52 through 57 is designed to put the false split fountains on display for visual inspection, the artwork contains some large, continuous horizontal designs. For example, the paper airplane is made only of the three flat non-split opacities produced by the combinations shown in FIG. 50, and the continuous waves at the bottom of the image include several of the eight false split fountains shown in FIG. 51. Continuous horizontal designs were identified above as a reverse engineering risk, because counterfeiters can trace them to distinguish between the artwork on different plates. However, some use of larger continuous designs is appropriate here to allow the split fountains to be viewed over longer horizontal widths.

Because of the presence of the hard white borders surrounding the individual shapes, actual printing of the design shown in FIGS. 52 through 57 would be highly dependent on accurate registration, though this artwork is only for discussion and actual security artwork could be designed to be more tolerant of registration variations. The illusion of eleven fountains could be revealed by examining microscopic registration differences that would occur naturally in a hardcopy print of FIG. 56, though detailed reverse engineering would still be difficult; counting plates is just one step of successfully working backward from FIG. 56 to replicate FIGS. 52 through 55. The waves in FIG. 56, which make use of overt split fountains, could be combined with other artwork styles that deliberately conceal the presence of the splits (such as the sky pattern in FIG. 56, or the square design discussed above with reference to FIGS. 38 through 45) such that the total artwork incorporates both approaches.

By building upon split fountain fundamentals described above, it is possible to use, e.g., four split fountain ink stations to simulate the presence of as many as eleven nonexistent ink station configurations. These false split fountains conceal the actual press setup used to produce a security document, and allow overt split fountain effects to be included in a security design without revealing the actual press configuration to counterfeiters. However, these additional techniques still do not express the full capabilities of split fountain printing to support artwork that resists reverse engineering. As set forth below, split fountain hardware configurations can include additional variations, including split fountain width, location and quantities in a four-station press, and the use of multiple colors of ink in secure ways that improve design possibilities while also denying counterfeiters the use of color to reverse engineer the plate artwork.

The above descriptions provide examples of addressing the threat of reverse engineering genuine document artwork, and introduced security design strategies to combat reverse engineering, including the use of a monochromatic color gamut and varying the opacities of inks within that gamut. Split fountain printing can be used as a technique for prevention of artwork replication and for presentation of false split fountain opacity transitions. The following description includes an exploration of split fountain hardware, focusing on how the variable of split fountain placement can support the creation of artwork resistant to reverse engineering.

Monochromatic design paradigms can prevent individual plate images from being extracted from a security document, which forces counterfeiters to simulate, rather than replicate, individual plate artwork. Such paradigms can use layering of monochromatic inks of different opacities, and split fountain printing for transitioning opacity instead of color. Expanding on the concepts of split fountain concealment and false split fountains described above, examples will be presented to illustrate the effects of different split fountain hardware variables, including the positioning of split fountain hardware across the width of each ink station.

The results presented herein are described for the sake of simplicity and understanding, such that implementations of these concepts in real security artwork and printing environments can be accomplished by press testing and other quality control approaches, such as inspections, plate registration, and other factors important in printing workflows. For simplicity the opacities of overlapping layers of inks will be treated as if they are linearly additive regardless of print order or ink layer thickness.

Examples described herein can customize several hardware variables in split fountain printing, such as: the locations where different pure inks are applied to ink rollers; the amount of movement of the oscillator rollers that control the width of the transitions between the pure inks; and the number of pure inks deployed in each fountain.

As described above, split fountain discussions have considered four ink stations with identical split fountain hardware configurations, and did not change hardware variables between ink stations. The following description will discuss examples involving changing of the horizontal placement of split fountains, e.g., each split fountain involving two pure inks, in each of four ink stations with identical roller oscillation. The hardware variables of roller oscillation, and the number of split fountains in each station, will also be examined further below.

The following examples illustrate how changing the placement of split fountain hardware in a four-station offset printing press, featuring two inks per fountain, can conceal the press setup by simulating false split fountains that appear to be composed of more than two pure inks. The example shown in FIGS. 58 through 67 uses sets of paired opposing split fountains, which allows simulation of three flat tones in the interest of design flexibility. The second example (FIGS. 68 through 74) does not use paired split fountains, so it offers additional false split fountains and greater print complexity at the cost of the flat tones. The ink opacities and the general placement of those inks will be similar to earlier examples, with the variable changed being the split fountain position.

Figure 58:
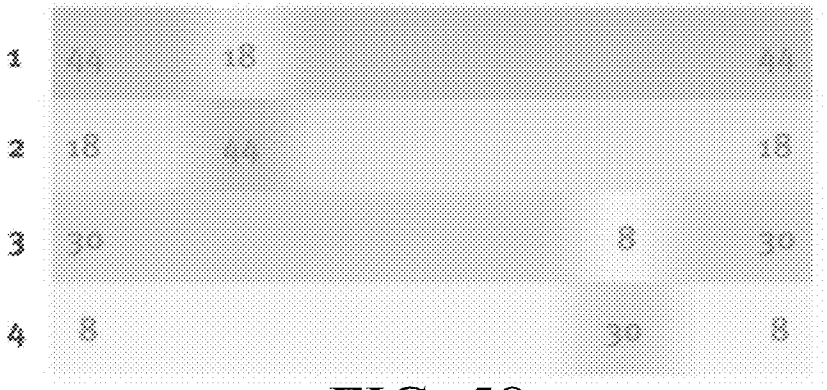
FIGS. 58-67 illustrate artwork demonstrating sets of paired opposing split fountains in accordance with example embodiments.

FIG. 58 shows the distribution of inks across the four ink stations in a hypothetical offset printing press, using inks of the same color but of different opacities. Split fountains are thus used in this example to transition between ink opacities, not between different ink colors. The first station features a split fountain transition between pure inks of 44% opacity at the edges and 18% left of the center of the roller, and so on for the other stations and ink placements. The same two inks (44% and 18% opacity) are used in opposite positions in the first two fountains and the same two inks (30% and 8% opacity) are used in the third and fourth fountains, again with opposite placements. As mentioned before, these percentages are contrived for purposes of illustration and would be replaced with optimal real ink formulations in an actual print workflow. Thus, FIG. 58 illustrates opacities of pure inks delivered from each of four fountains on press, expressed as various combinations of inks of 8%, 18%, 30% and 44% opacity. The first two fountains are opposites of each other in terms of ink placement and split fountain position, as are the third and fourth fountains.

Earlier described examples (e.g., FIGS. 49 and 50) illustrate the simulation of three discrete flat tones by overprinting identical solid artwork from two paired split fountain printing plates. The example will be revisited here to affirm that three flat tones can still be simulated, even if not all of the split fountains share the same position.

Figure 59:
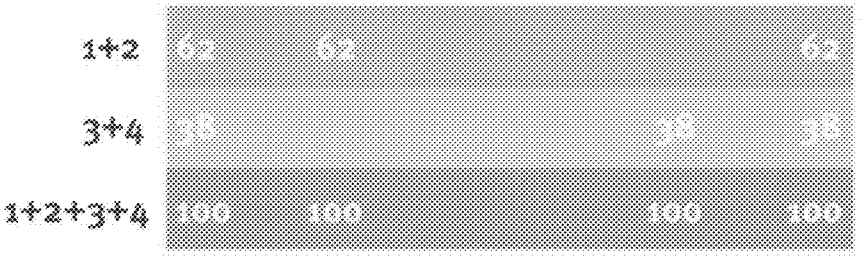

Unlike the example in FIGS. 49 and 50, in which all split fountains were centered across the width of the roller, FIG. 58 shows that the first two fountains have opposite ink placements and show the position of the middle ink shifted left, while the third and fourth fountains are also opposites and similarly show the middle ink shifted right. FIG. 59 shows that three discrete flat tones can be simulated by overprinting only the first two fountains, only the third and fourth fountains, or all four fountains. If two split fountains are configured with opposing ink opacities and identical split fountain positioning, in concept a flat tone can be simulated regardless of where the split fountain transition occurs across the width of the rollers. The simulated flat tones in FIG. 59 mimic the presence of only one ink in a fountain, but FIG. 58 shows that every fountain on press actually contains two pure inks. Thus, the overlap of split fountain inks from FIG. 58 is used to simulate flat tones of constant opacity. These flat tones depend on certain fountains in FIG. 58 being configured as opposites of one another.

Figure 60:
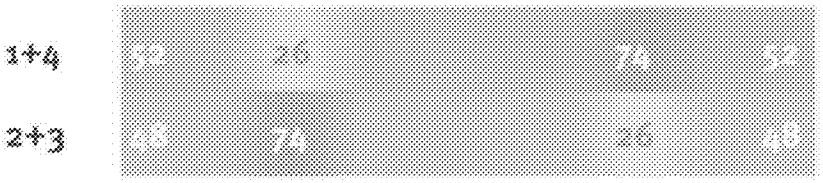

Next, consider the overlap of the first and fourth fountains of FIG. 58 (or the second and third fountains). In FIG. 60, a fountain with more opaque ink at the edges is paired with another fountain that has more translucent ink at the edges, or the reverse. Unlike the combinations that simulate the flat tones in FIG. 59, the combinations in FIG. 60 combine fountains where the ink opacities are not exact opposites of one another, and where the split positions are different. Thus, FIG. 60 illustrates overprinting of the first and fourth fountains, and the second and third fountains, from FIG. 58. These combinations simulate splits involving three inks, instead of only two.

The overlap of the first and fourth fountains shown in FIG. 60 produces an area left of center that shows a combined opacity that is lower than at the edges of the rollers, and another area right of center that shows a combined opacity that is higher than at the edges of the rollers. The visual effect is reminiscent of (but not exactly like) a single fountain that contains three pure inks of different opacities. The overlap of the second and third plates (also shown in FIG. 60) creates a similar effect, though the higher opacity region is to the left of the roller center and the lower opacity region to the right. FIG. 60 illustrates how two overlapping split fountain plates with different split fountain positions can simulate the presence of three pure inks, blended with split fountains and printed from a single ink station.

Figure 61:
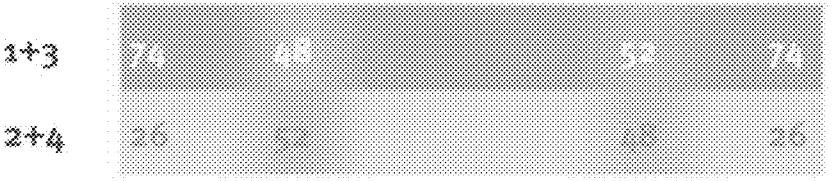

From FIG. 58, consider the overlap of fountains one and three, or fountains two and four, to produce the combinations shown in FIG. 61. Both fountains in these pairs feature a higher opacity ink at the edges and a more translucent ink in the middle (fountains one and three) or the reverse placement (fountains two and four).

When overprinted as shown in FIG. 61, combining the first and third fountains simulates a visual effect similar to four pure inks of different opacities printed from a single split fountain. The general appearance is of a more opaque orange with two less opaque bands, but on close inspection the left band is slightly lighter than the right because the opacities combined on the left and right sides are subtly different. The degree to which this difference is apparent is a design choice, and is a function of the specific ink opacities selected by the designer. A similar effect is produced by overlap of the second and fourth fountains, with the left band being somewhat more opaque than the right. Accordingly, the combinations in FIG. 61 appear to simulate the presence of four pure inks, blended with split fountains and printed from a single ink station.

Figure 62:
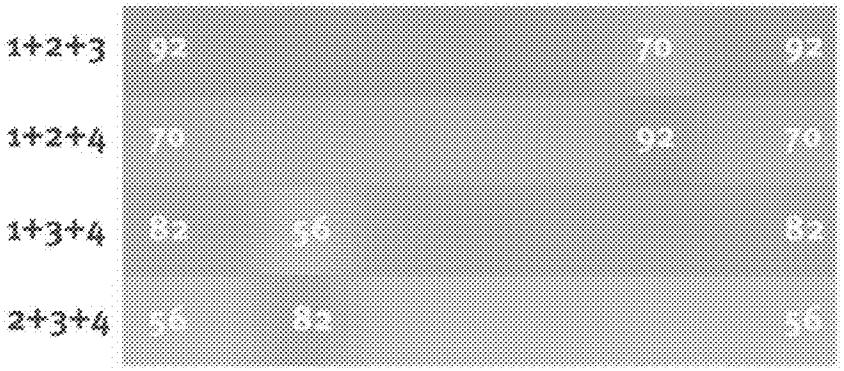

While FIGS. 60 and 61 illustrate various combinations of two fountains, FIG. 62 shows combinations of three fountains. Each combination shown in FIG. 62 is composed of one of the flat tones shown in FIG. 59, plus one additional fountain from FIG. 58. The result is that the false split fountain transitions shown in FIG. 62 appear to be between exactly two pure inks, not three or four. Overall, the transitions in FIG. 62 look much like those in FIG. 58, though darker and with reduced contrast. Although these combinations are important additions to the press gamut because they offer additional false split fountain effects, the three-fountain combinations in FIG. 62 do not simulate the use of additional pure inks like the two-fountain combinations shown in FIGS. 60 and 61. Thus, FIG. 62 illustrates combinations of three of the fountains shown in FIG. 58. Individually, each of these combinations just looks like a darker version of one of the split fountains shown in FIG. 58 and does not simulate the presence of more than two inks.

FIGS. 59 through 62 illustrate the distribution of inks across four rollers and the combinations that can be created by layering them, but they do not show plate artwork. To disguise the press setup shown in FIG. 58, security artwork should not display in isolation any of the real ink distributions of FIG. 58 because doing so would allow a counterfeiter to view individual plate artwork and ink placements, and potentially exploit these for reverse engineering. Instead, a more secure design could be created entirely and only from the combinations shown in FIGS. 59 through 62.

Figure 64:
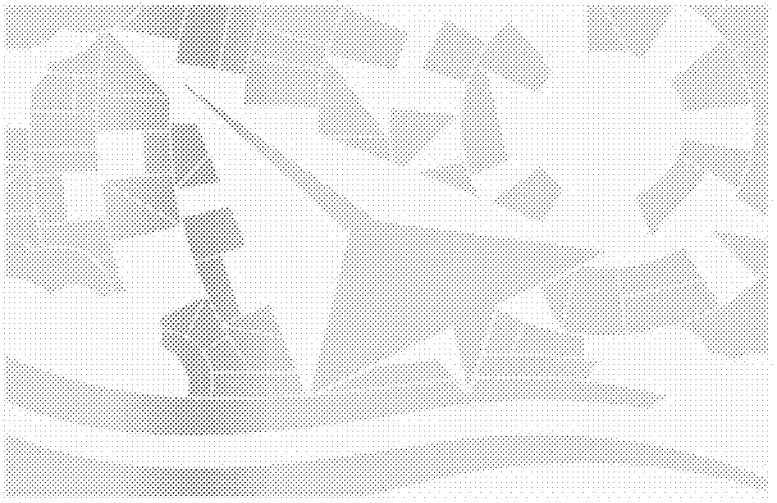
Figure 66:
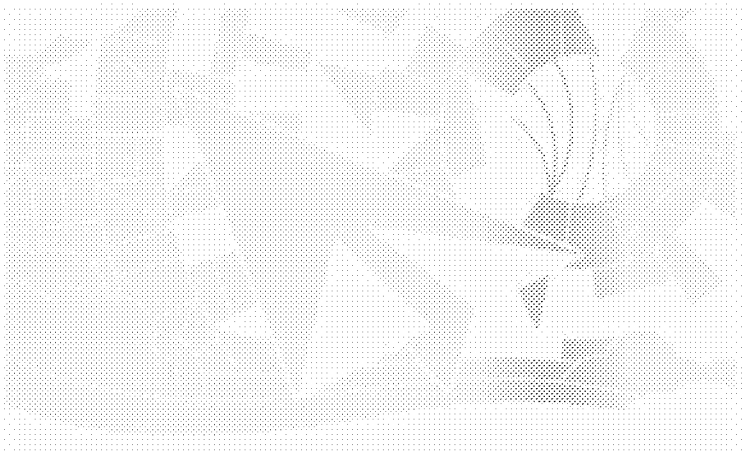
Figure 63:
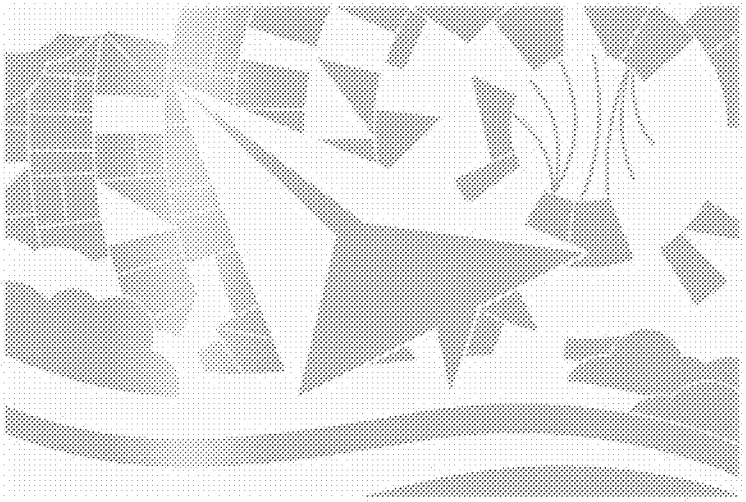
Figure 65:
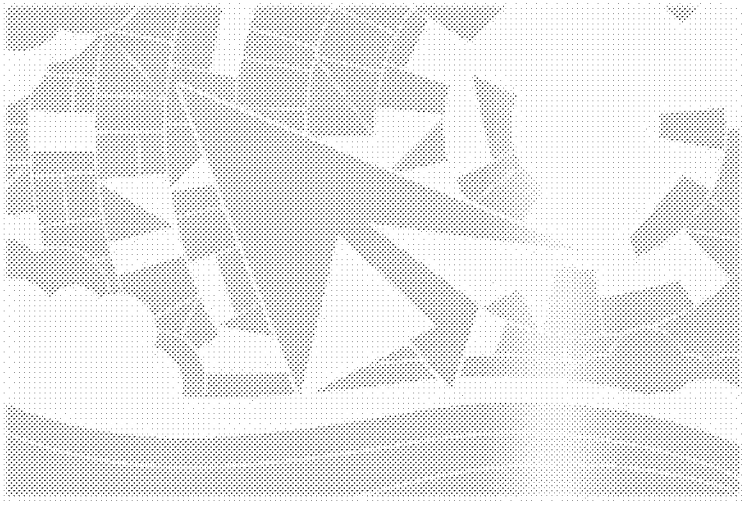
Figure 67:
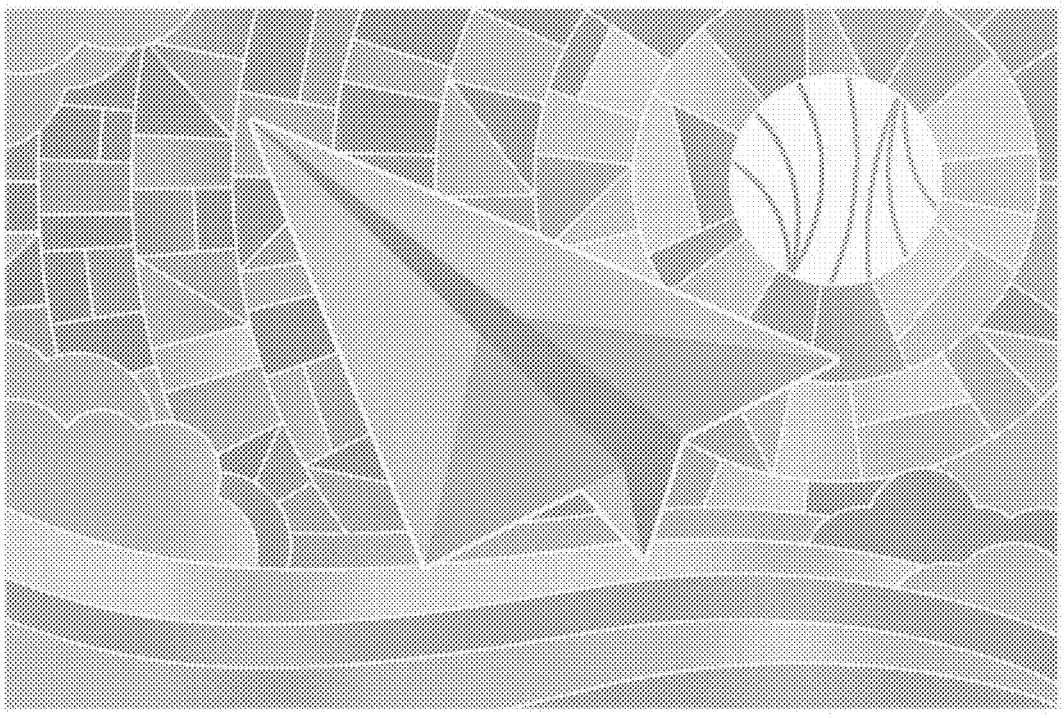

As an example, individual plate artwork designs are shown in FIGS. 63 through 66, and are combined in FIG. 67. FIG. 63 illustrates split fountain artwork composed of inks of 44% opacity at the edges and 18% opacity in the middle. The split fountain places the 18% ink to the left of the center of the roller. This split position is the same as in FIG. 64. FIG. 64 illustrates split fountain artwork composed of inks of 18% opacity at the edges and 44% opacity in the middle. The split fountain places the 44% ink to the left of the center of the roller. This split position is the same as in FIG. 63. FIG. 65 illustrates split fountain artwork composed of inks of 30% opacity at the edges and 8% opacity in the middle. The split fountain places the 8% ink to the right of the center of the roller. This split position is the same as in FIG. 66. FIG. 66 illustrates split fountain artwork composed of inks of 8% opacity at the edges and 30% opacity in the middle. The split fountain places the 30% ink to the right of the center of the roller. This split position is the same as in FIG. 65. The composite artwork shown in FIG. 67 is created entirely from the available split fountain combinations described in FIGS. 59 through 62, and every visible split fountain transition is actually a false split fountain simulation created by overlap of two or more plates. Simulations of fountains containing three inks (from FIG. 60) or four inks (from FIG. 61) can be seen across the continuous horizontal wave patterns at the bottom of the artwork of FIG. 67. Finally, the paper airplane design in FIG. 67 shows all three simulated flat tones described in FIG. 59, though the actual press configuration only contains the split fountains shown in FIG. 58. Thus, FIG. 67 illustrates composite artwork produced by overprinting of FIGS. 63 through 66. FIG. 67 shows three simulated flat tones in the paper airplane and eight false split fountains, none of which exist in the real press setup. The waves at the bottom of the design simulate split fountain transitions involving three or four pure inks.

Figure 68:
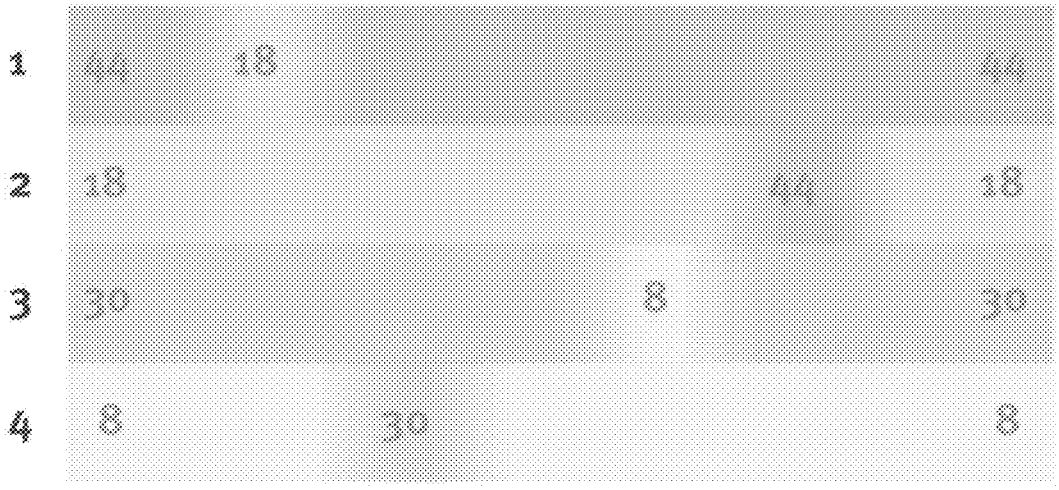
FIGS. 68-74 illustrate artwork demonstrating false split fountains based on changed split fountain position in accordance with example embodiments.

The example illustrated in FIG. 58 incorporates split fountains designed as opposing pairs, which allows for simulation of the flat tones shown in FIG. 59. However, there is no requirement that security artwork must include flat tones. FIG. 68 shows a different configuration containing the same four pure inks as shown in FIG. 58, but with a unique split fountain placement in every ink station.

Figure 69:
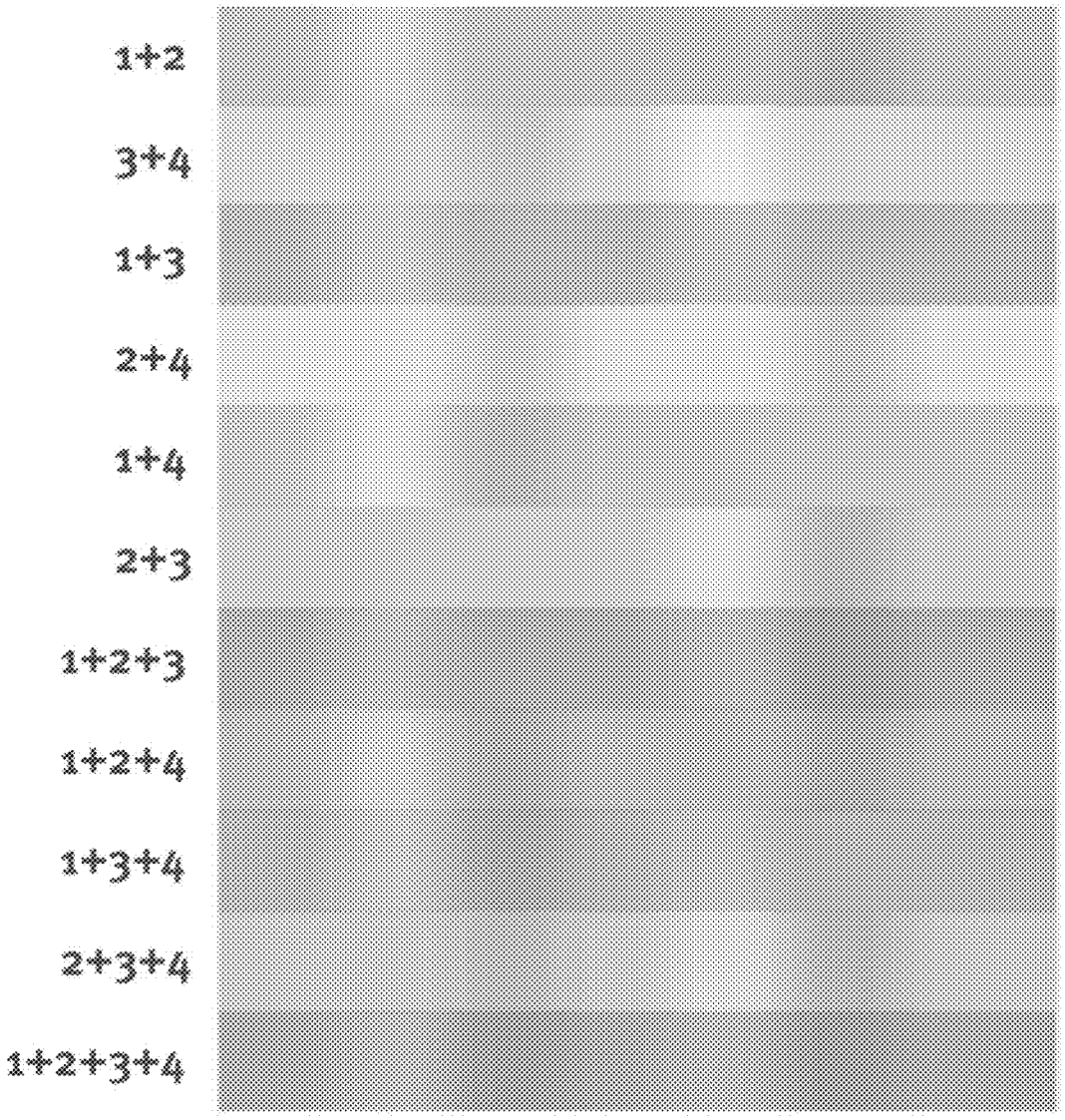

Unlike FIGS. 58 and 59, in FIG. 68 the middle ink is in a different location in every fountain, which disrupts the pairings required to simulate the presence of the flat tones shown in FIG. 59. Instead, the individual roller opacity distributions of FIG. 68 combine to produce the eleven false split fountains shown in FIG. 69 by overprinting two, three or four rollers. Thus, FIG. 68 illustrates opacities of pure inks delivered from each of four fountains on press, expressed as relative opacity percentages from 8% to 44%. Unlike FIG. 58, these fountains are not paired opposites and cannot simulate flat tones. In FIG. 69 the flat tones have been lost, but have been replaced with three additional false split fountains for a total of eleven false split fountain combinations. FIG. 69 also shows a complex system of lighter or darker bands that differ in placement between various roller combinations, to the extent that it becomes difficult to describe the patterns as simulating the presence of three, or four, or some other number of pure inks. Thus, FIG. 69 illustrates overlap of split fountain inks from FIG. 68 to create complex combinations of light and dark opacity. No flat tones are present. The eleven complex false splits shown here replace the combinations shown in FIGS. 59 through 62. To take advantage of this increased complexity to further disguise the press setup from counterfeiters, the placement and intensity of these bands should be paired with security artwork that is intended to complement and benefit from, rather than compete with or be interrupted by these uneven opacity distributions.

Figure 70:
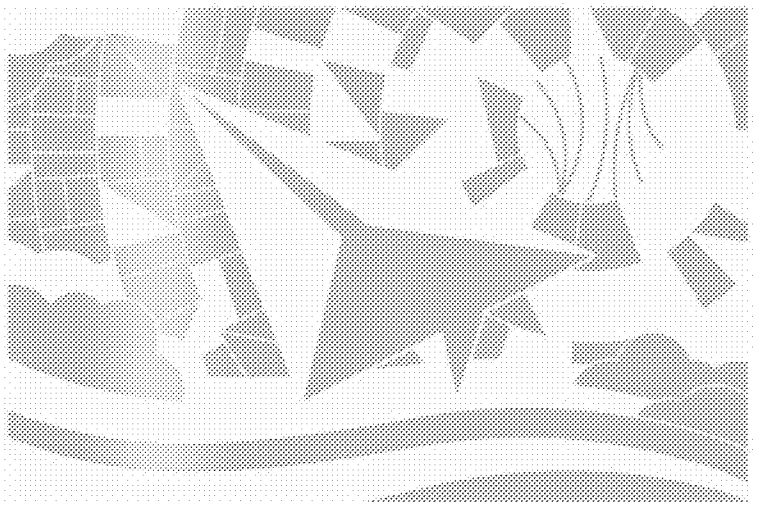
Figure 71:
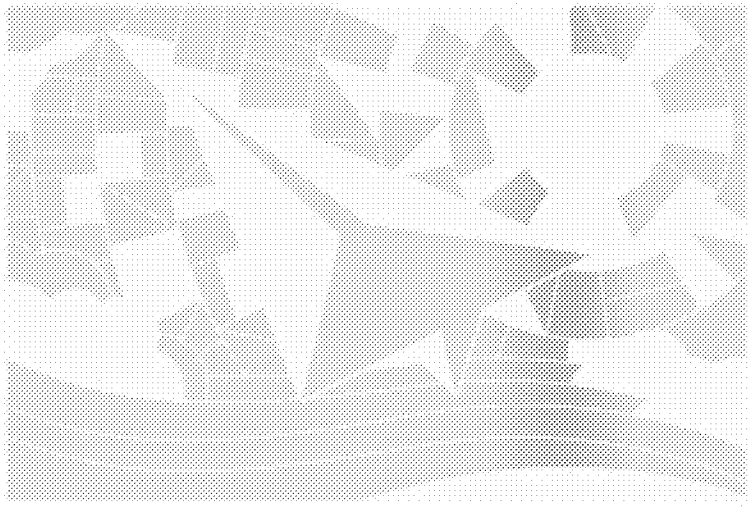
Figure 72:
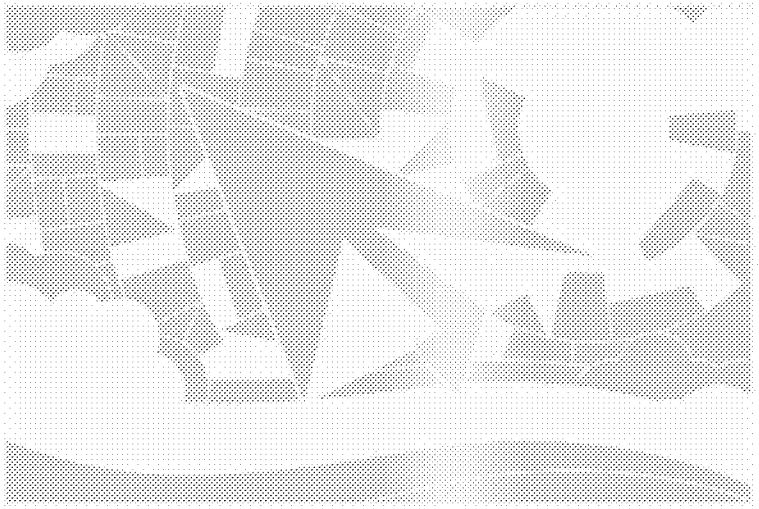
Figure 73:
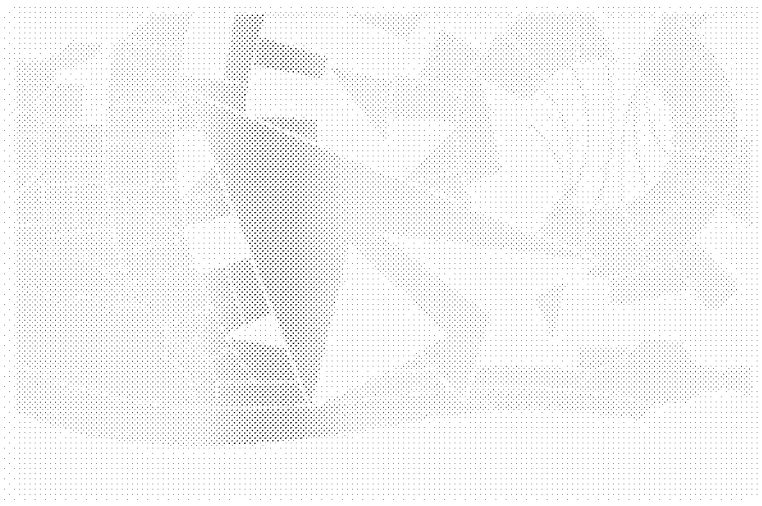
Figure 74:
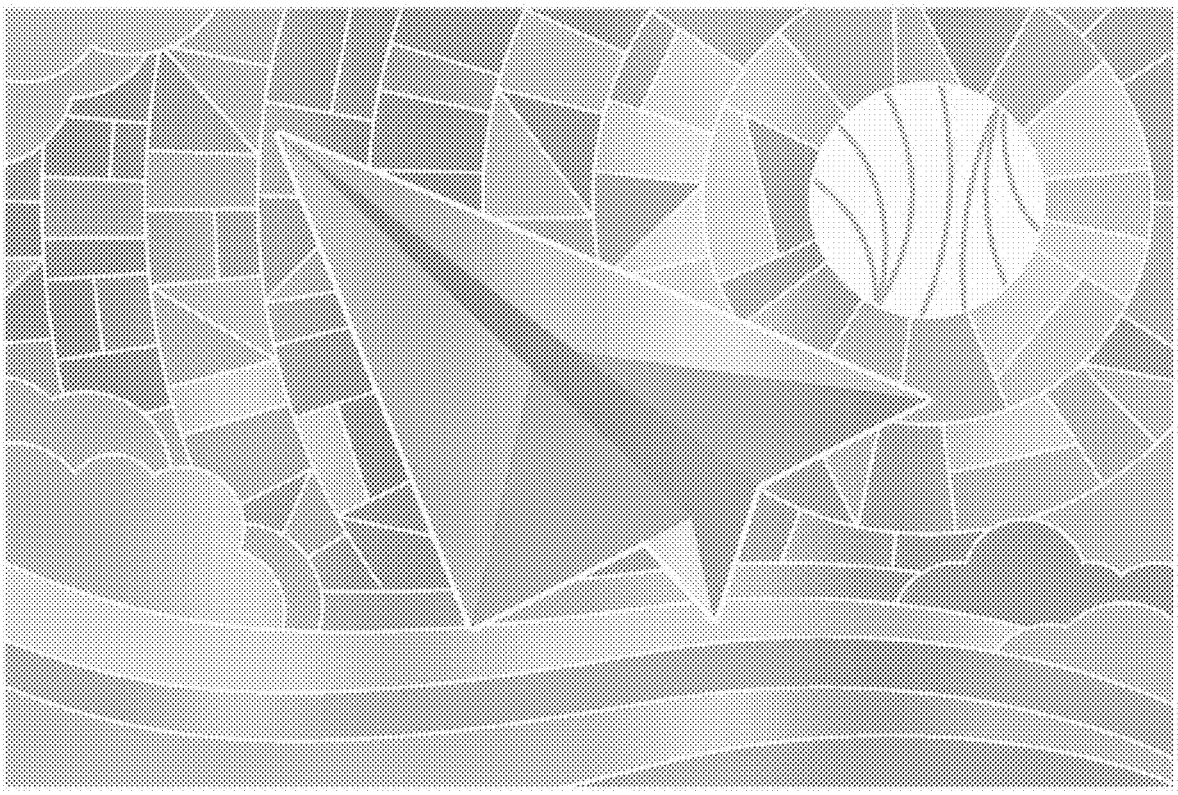

FIGS. 70 through 73 illustrate demonstration artwork that could be printed from the rollers shown in FIG. 68. FIG. 70 illustrates split fountain artwork composed of inks of 44% opacity at the edges and 18% opacity in the middle. The split fountain places the 18% ink far to the left of the center of the roller. Unlike FIGS. 63 and 64, the split fountain positions are different between FIGS. 70 and 71. FIG. 71 illustrates split fountain artwork composed of inks of 18% opacity at the edges and 44% opacity in the middle. The split fountain places the 44% ink far to the right of the center of the roller. Unlike FIGS. 63 and 64, the split fountain positions are different between FIGS. 70 and 71. FIG. 72 illustrates split fountain artwork composed of inks of 30% opacity at the edges and 8% opacity in the middle. The split fountain places the 8% ink slightly to the right of the center of the roller. Unlike FIGS. 65 and 66, the split fountain positions are different between FIGS. 72 and 73. FIG. 73 illustrates split fountain artwork composed of inks of 8% opacity at the edges and 30% opacity in the middle. The split fountain places the 30% ink slightly to the left of the center of the roller. Unlike FIGS. 65 and 66, the split fountain positions are different between FIGS. 72 and 73. FIG. 74 shows the full composite artwork composed only from the eleven combinations shown in FIG. 69. To see the additional artwork complexity possible when each ink station features a unique split position, compare FIG. 67 to FIG. 74, particularly in the area of the paper airplane. Thus, FIG. 74 illustrates composite artwork produced by overprinting of FIGS. 70 through 73. This image is composed entirely of the eleven complex false split fountains shown in FIG. 69. Compare to FIG. 67, especially the paper airplane and the waves at the bottom of the design.

To truly replicate the individual plate artwork shown in FIGS. 70 through 73, a counterfeiter would have to first reverse engineer the ink distributions shown in FIG. 68, starting only with the composite artwork in FIG. 74. Because of the complexity of such a task, attempts to replicate the artwork detail would likely be abandoned and the counterfeiter would be motivated to settle for a lower-quality method of halftone artwork simulation that could be easily detected microscopically.

The positioning of split fountains is the first of three split fountain hardware variables to be explored below, that can contribute to security designs resistant to reverse engineering. Within the monochromatic design paradigm, the examples demonstrated that changing the position of split fountains between ink stations can simulate several visual effects. These include flat tones, the presence of additional pure inks that are not a part of the press setup, and complex patterns of higher and lower opacity, each of which can be developed in conjunction with appropriate security artwork according to the priorities of the designer. However, split fountain positioning is just one of three hardware variables associated with split fountain printing that will be examined herein. Additional variables include the effects of varying the roller oscillation between fountains, and the split fountain transition between more than two pure inks in each station on press.

Security design strategies such as those described above, which can be used interrupt counterfeiting processes necessary for reverse engineering of document artwork, include the adoption of a monochromatic design gamut and the overprinting of multiple layers of translucent offset inks of the same color to generate areas of higher image density, instead of by widening lines. Split fountain printing can also be adapted for combating artwork reverse engineering. The exploration of effects of split fountain hardware variables will now focus on an evaluation of split fountain width. Hardware variables associated with split fountain printing, including split fountain placement across the roller width, split fountain transition width, and splits between more than two pure inks, can be used to combat reverse engineering.

Figure 75:
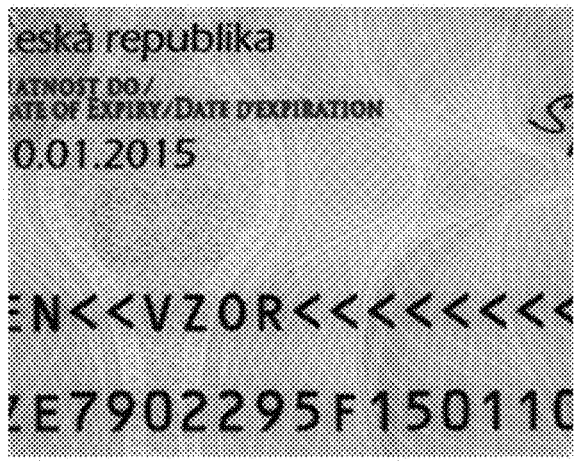
FIGS. 75 and 76 illustrate artwork demonstrating split fountain transitions occurring over different widths between different colors in accordance with example embodiments.
Figure 76:
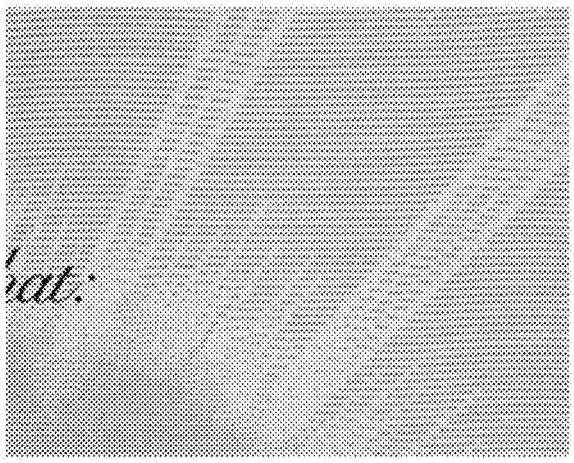

Split fountain printing encompasses several hardware variables, including split fountain transition width. Consider FIG. 75 and FIG. 76, which were captured at identical magnifications. FIG. 75 illustrates split fountain transition from pink to blue, occurring abruptly over a narrow horizontal distance in the center of the image. Compare to FIG. 76, which was captured at the same magnification. FIG. 76 illustrates split fountain transition from orange to gray, occurring gradually over a wide horizontal distance. Compare to FIG. 75, which was captured at the same magnification. In FIG. 75, the pink to blue transition is abrupt and occurs over a short horizontal distance, while the transition from orange to gray in FIG. 76 occurs over a wider horizontal distance. The difference is due to the split fountain configuration, including the degree of oscillator roller movement on press, which may be over a short distance (causing less color blending, as in FIG. 75) or a longer distance (causing more color blending, as in FIG. 76).

FIGS. 75 and 76 illustrate the conventional split fountain blending of two ink colors. Examples described herein illustrate how the variable of split fountain transition width will be repurposed to simulate monochromatic, multi-plate false split fountain effects that help conceal the true press setup. The examples presented below show the effects of changing the split fountain transition widths between ink stations. The first example (FIGS. 77 through 87) incorporates paired split fountains that can simulate three flat tones and eight false split fountains. The second example (FIGS. 88 through 96) does not use paired split fountains, and replaces the flat tones with three additional false split fountain effects.

FIG. 77 shows the distribution of inks across the four ink stations in a hypothetical printing press, using only inks of the same color but different opacities. The first station features a split fountain transition between pure inks of 8% opacity at the edges and 30% at the center of the fountain, and so on for the other stations. The same two ink opacities (8% and 30%) are used in opposite placements in the first two fountains, and the same two ink opacities (18% and 44%) are used in opposite placements in the third and fourth fountains. These simplified ink opacities are contrived to make the examples easier to understand, and do not represent real ink formulations. Thus, FIG. 77 illustrates opacities of pure inks in each of four split fountain ink stations, expressed as various combinations of inks of 8%, 18%, 30% and 44% opacity. The first two fountains feature the same split fountain transition widths but opposite ink placements, as do the third and fourth fountains. The split fountain transition is more gradual in the third and fourth fountains than in the first and second.

Although all four rollers in FIG. 77 contain a split fountain, the width of the transition between the pure inks is narrower in the first two fountains and wider in the second two fountains. The first two fountains in FIG. 77 show wider swaths of the pure inks because the split fountain transition occupies less of the fountain width, and the third and fourth fountains show narrower swaths of the pure inks because the transition area is wider. The security value becomes apparent when multiple fountains are overlapped to simulate plates that do not exist in that actual press setup, as described below.

In earlier examples, three flat tones were simulated by overprinting identical line artwork from two paired split fountain printing plates. Such example is repeated here, to illustrate that flat tones can be simulated even in press configurations that vary split fountain transition width.

In FIG. 77, the split fountain transition width is the same in the first two fountains and the same in the third and fourth fountains. Overprinting the first two fountains, or the third and fourth fountains, or all four fountains together produces one of the three flat tones shown in FIG. 78, though every fountain in FIG. 77 actually contains a split fountain. Thus, FIG. 78 illustrates overlap of paired split fountain inks from FIG. 77 to simulate flat tones. These flat tones depend on paired fountains in FIG. 77 being configured with the same split fountain transition width, but opposing ink placements.

Interesting effects can be created by overlapping two split fountains that feature different transition widths. For example, both the first and third fountains of FIG. 77 feature a lower opacity ink at the edges and a higher opacity ink in the middle, and both the second and fourth fountains feature a higher opacity ink at the edges and a lower opacity ink in the middle, but in each pair the transition widths are different. These combinations are shown in FIG. 79, and simulate a dynamic opacity transition speed. FIG. 79 illustrates overprinting of the first and third fountains, and the second and fourth fountains, from FIG. 77. These combinations simulate an opacity transition that appears to progress more or less rapidly in different areas of the roller width. The concept is explained in FIG. 80 using just the first and third fountains.

In FIG. 80, each pure ink occupies a portion of the roller width (marked with the letter "A") where it has not been blended with the other ink. Part of each individual fountain width is also allocated to the split fountain transition (marked "B"), where the pure inks are blended and neither pure ink is visible by itself. In the first fountain, more of the width is occupied by the pure inks ("A") and the split fountain transitions ("B") are narrower. In the third fountain, less of the width of the roller is occupied by the pure inks ("A"), leaving more room for wider split fountain transitions ("B").

Now consider the combined image in FIG. 80, where the width can be divided into three areas. Areas where both the first and third fountains print pure inks (both "A") are marked with the letter "C" in the combined image. Areas where both the first and third fountains print split fountain transitions (both "B") are marked with the letter "D" in the combined image. Finally, areas where the third fountain prints its split fountain transition (third fountain "B") and the first fountain prints its pure ink (first fountain "A") are marked with the letter "E" in the combined image.

In the combined image, pure ink areas marked "C" are composed of two areas of pure ink from fountains one and three ("A"), and show no opacity transition. The areas marked "D" where both split fountains intersect are defined by the width of "B" from the first fountain. The opacity changes more rapidly in the "D" combination areas than in either of the split fountain areas marked "B" because both split fountain opacity transitions are combining in an additive way. In the areas marked "E", one split is overprinted with a pure ink, resulting in an opacity change that appears more gradual than in the "D" areas where the two splits work together.

The overall visual effect is of no opacity transition ("C") to a gradual opacity transition driven by only one split fountain ("E") to a faster opacity transition driven by both split fountains moving in the same direction ("D"). This effect is a simulation of different roller oscillation speeds at different points across the fountain width. Conventional split fountains use only a single oscillator roller with a constant movement, so would be challenging to replicate the subtle visual effect shown in FIG. 80 using a single ink fountain without resorting to halftones. A similar exercise could be done with the second and fourth fountains shown in FIG. 79. Thus, FIG. 80 illustrates that in each of the individual fountains 1 and 3, "A" designates only pure ink and "B" designates the split fountain transition area. In the combination 1+3, "C" designates where both fountains print pure ink, "D" designates both fountains printing split fountain transitions, and "E" designates a pure ink overlapped with a split fountain. Compare to FIGS. 77 and 79.

Other combinations featuring opacity transitions moving in opposite directions instead of the same direction are illustrated in FIG. 81. These combinations include overprinting the first and fourth fountains, or the second and third. In FIG. 81, an increase in opacity in one fountain tends to correspond with a decrease in opacity in the other, but due to the differences in split fountain transition widths, the result is not a perfect flat tone (as in FIG. 78). Instead, subtle patterns of higher and lower opacities result. These subtle patterns contribute to the gamut of simulated patterns that can be derived from the actual press configuration shown in FIG. 77. Thus, FIG. 81 illustrates overprinting of the first and fourth fountains, and the second and third fountains, from FIG. 77. The pairs do not simulate precise flat tones because the split fountain widths are not identical.

FIG. 82 shows combinations of three of the four fountains shown in FIG. 77. Any combination of three fountains from FIG. 77 will include one of the flat tones from FIG. 78, plus another one of the individual plates from FIG. 77. The result is that the combinations shown in FIG. 82 do not exhibit any of the unusual split fountain simulation effects shown in FIGS. 79 and 81, and just look like darker, lower-contrast versions of the individual fountains shown in FIG. 77. Thus, FIG. 82 illustrates combinations of three of the fountains shown in FIG. 77. Individually, each of these combinations just looks like a darker version of one of the split fountains shown in FIG. 77.

FIGS. 78 through 82 show combinations of two, three or four of the ink distributions shown in FIG. 77, but do not address plate artwork. To conceal the actual press configuration shown in FIG. 77, a security design could be constructed entirely or primarily from the fountain combinations shown in FIGS. 78 through 82. Such a design limits the ability of counterfeiters to inspect the individual fountains shown in FIG. 77 in isolation, making it hard to inspect and segregate individual plate images, count the number of plates used, and/or redraw the individual plate artwork.

Figure 84:
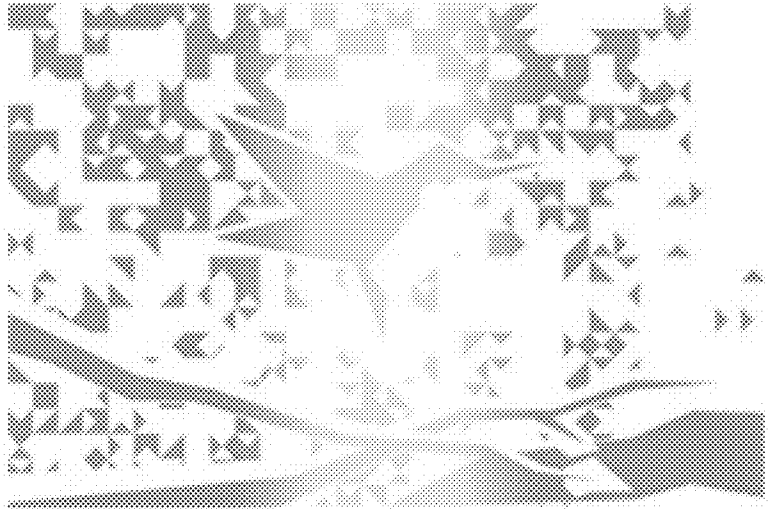
Figure 86:
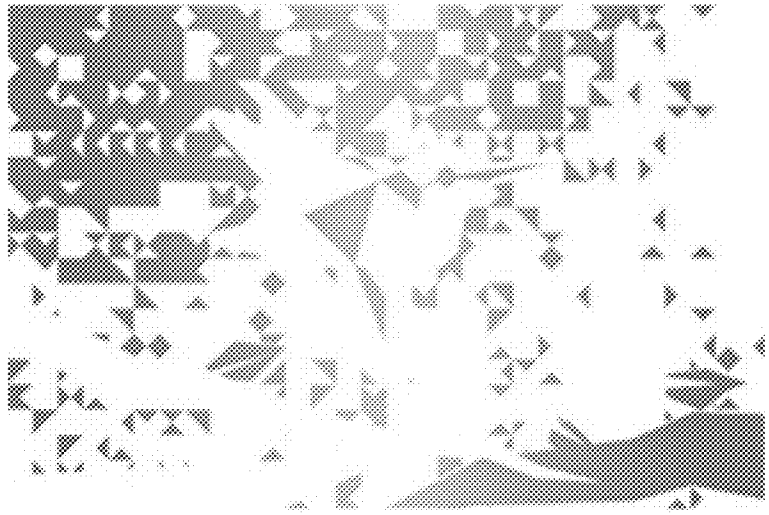
Figure 83:
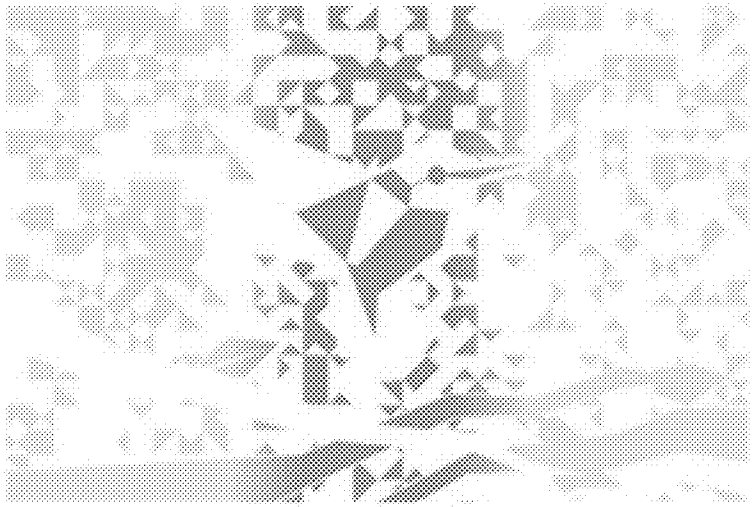
Figure 85:
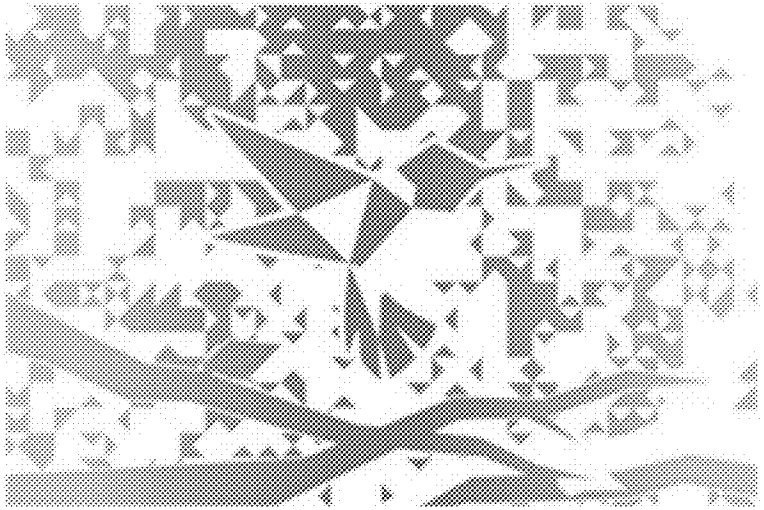

Some example plate artwork designs are shown in FIGS. 83 through 86, with each plate image inked from one of the split fountains shown in FIG. 77. The composite artwork shown in FIG. 87 is created primarily from overlaps of artwork on two, three or four plates, with artwork from a single plate displayed only in restricted areas to limit exploitation by counterfeiters. Thus, FIG. 87 illustrates composite artwork produced by overprinting FIGS. 83 through 86, including four actual split fountains, three simulated flat tones and eight simulated split fountains. The branches display several simulated split fountains, including some where the speed of opacity change appears variable. Several split fountain transitions are displayed across the width of the branches at the bottom of FIG. 87. Most of the visible splits are simulations that do not exist in the actual press configuration, and several simulate changing opacity transition speed as described in FIG. 80. FIG. 87 contains diverse elements that include parts of four actual plate images (from FIG. 77), three simulated flat tones (from FIG. 78) and eight false split fountains (from FIGS. 79, 81 and 82). Thus, FIG. 83 illustrates split fountain artwork composed of inks of 8% opacity at the edges and 30% opacity in the middle, from the first station in FIG. 77. The width of this split fountain is the same as the width of the split fountain shown in FIG. 84, and it has opposite ink placements compared to FIG. 84. FIG. 84 illustrates split fountain artwork composed of inks of 30% opacity at the edges and 8% opacity in the middle, from the second station in FIG. 77. The width of this split fountain is the same as the width of the split fountain shown in FIG. 83, and it has opposite ink placements compared to FIG. 83. FIG. 85 illustrates split fountain artwork composed of inks of 18% opacity at the edges and 44% opacity in the middle, from the third station in FIG. 77. The width of this split fountain is the same as the width of the split fountain shown in FIG. 86, and it has opposite ink placements compared to FIG. 86. FIG. 86 illustrates split fountain artwork composed of inks of 44% opacity at the edges and 18% opacity in the middle, from the fourth station in FIG. 77. The width of this split fountain is the same as the width of the split fountain shown in FIG. 85, and it has opposite ink placements compared to FIG. 85.

The example illustrated in FIGS. 77 through 87 includes some fountains configured as opposing pairs, allowing simulation of the flat tones shown in FIG. 78. Configuring the split fountains so that the width of each transition is unique prevents simulation of flat tones, but instead allows for three additional split fountain effects in place of the flat tones. As an alternative to FIG. 77, which included opposing pairs, FIG. 88 shows four fountains that each feature a custom split fountain transition width. For example, the opacity transition occurs over the shortest horizontal distance in the first fountain, and the longest horizontal distance in the fourth fountain. Thus, FIG. 88 illustrates a different split fountain configuration of the same inks shown in FIG. 77. Unlike FIG. 77, each station for producing FIG. 88 has its own unique split fountain transition width, so the paired fountains used to simulate flat tones are not present. The transition becomes progressively wider from the first fountain to the fourth. Compare to FIG. 77.

FIG. 89 illustrates an overlap of split fountain inks from FIG. 88. These eleven false split fountains replace the combinations in FIGS. 77 through 82 when the individual fountains are configured as in FIG. 88. Each combination features its own particular pattern of higher and lower simulated opacity transition speeds, as illustrated previously in FIG. 80.

The fountains in FIG. 88 can be overprinted to produce the eleven combinations shown in FIG. 89, which facilitates two distinct security advantages. First, designs created from the various overlaps in FIG. 89 include a gamut of false split fountain effects that work to conceal the configuration of the actual split fountains used in the press (FIG. 88). This masks the actual plate count and inhibits reverse engineering of the true press setup by counterfeiters. Second, each of the combinations in FIG. 89 features its own unique pattern of simulated split fountain transition speeds (similar to the one example detailed in FIG. 80) where the rate of the split fountain opacity transition appears to change in different horizontal areas of the fountain. Thus, FIG. 89 illustrates an overlap of split fountain inks from FIG. 88. These eleven false split fountains replace the combinations in FIGS. 77 through 82 when the individual fountains are configured as in FIG. 88. Each combination features its own particular pattern of higher and lower simulated opacity transition speeds, as illustrated previously in FIG. 80. A counterfeiter attempting to simulate one of the effects in FIG. 89 using a conventional approach in just one ink station could find the task challenging, because a single fountain can only accommodate a constant (fixed) oscillator roller movement. Though a counterfeiter could achieve such a simulation with halftones, counterfeit quality would be curtailed and microscopic detection of the counterfeit would be straightforward. A second artwork example, derived from the press configuration in FIG. 88, is shown in FIGS. 90 through 94.

Figure 90:
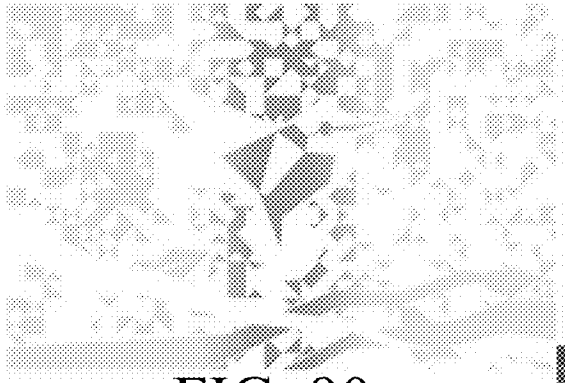
Figure 91:
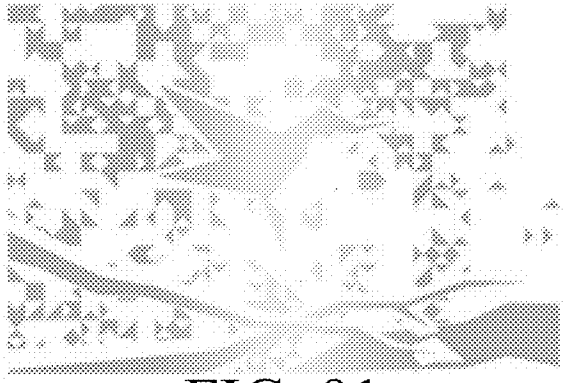
Figure 92:
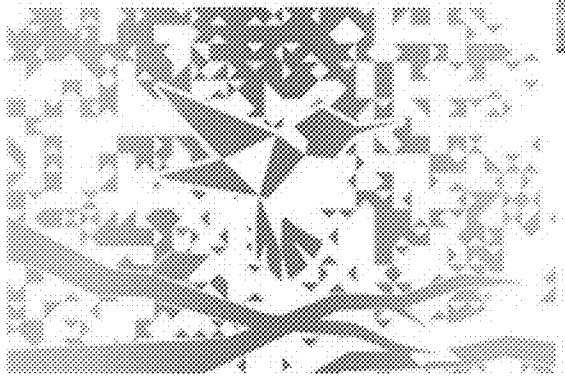
Figure 93:
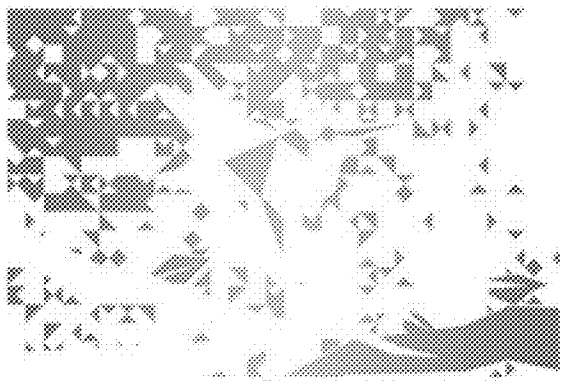
Figure 94:
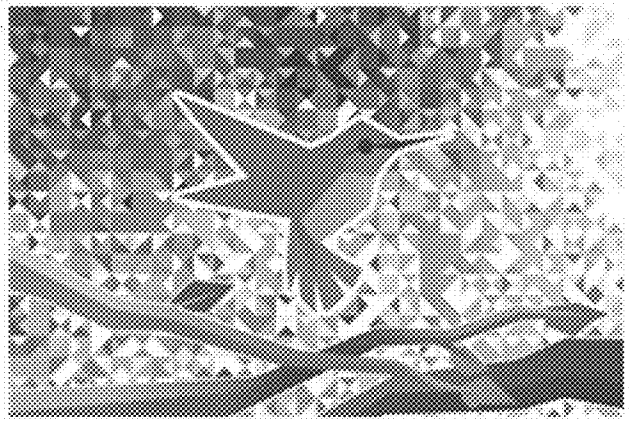

FIG. 90 illustrates split fountain artwork composed of inks of 8% opacity at the edges and 30% opacity in the middle, from the first station in FIG. 88. The width of the split fountain transition is narrower than in the plates shown in FIGS. 91 through 93. FIG. 91 illustrates split fountain artwork composed of inks of 30% opacity at the edges and 8% opacity in the middle, from the second station in FIG. 88. The width of the split fountain transition is narrower than in the plates shown in FIGS. 92 and 93, and wider than the plate shown in FIG. 90. FIG. 92 illustrates split fountain artwork composed of inks of 18% opacity at the edges and 44% opacity in the middle, from the third station in FIG. 88. The width of the split fountain transition is narrower than in the plate shown in FIG. 93, and wider than the plates shown in FIGS. 90 and 91. FIG. 93 illustrates split fountain artwork composed of inks of 44% opacity at the edges and 18% opacity in the middle, from the fourth station in FIG. 88. The width of the split fountain transition is wider than in the plates shown in FIGS. 90 through 92. FIG. 94 illustrates composite artwork produced by overprinting of FIGS. 90 through 93. Compare to FIG. 87, with particular focus on the simulated and actual split fountain effects in the branches at the bottom of the design.

The above examples illustrate an exploration of the width of split fountain transitions, as a split fountain hardware variable that can facilitate security designs resistant to reverse engineering. Within the monochromatic design paradigm, varying split fountain transition widths between ink fountains can simulate the presence of extra press stations in printed artwork, and conceal the actual press configuration from counterfeiters. Possible visual effects can include the false split fountains described above, but also the simulation of varying oscillator roller speed across the width of the image, which could be difficult for even skilled counterfeiters to attack without resorting to halftones. The techniques described herein can be combined to optimize both the position and width of split fountains. It is also possible to combine multiple pure inks in each split fountain, as will be described in further detail below.

The innovative security design strategies described herein can be used to interrupt reverse engineering of security document artwork, including the overprinting of translucent offset inks of the same color to prevent individual plate images from being isolated from other plate images, and the repurposing of split fountain printing to increase the complexity of monochromatic security designs. Another strategy relates to the split fountain variable of the inclusion of three or more inks (e.g., of different opacities) per fountain, and can be used as a monochromatic security design. However, strategies can also involve the introduction of color to mitigate artwork reverse engineering risks.

Security design strategies described herein can be used to conceal the plate artwork and press setup used to print a genuine security document. If a counterfeiter is unable to identify individual plate images, then accurate replication of the artwork on each plate is not possible. Monochromatic security design, customization of ink opacities, increasing print density by layering images instead of widening lines, and use of split fountain printing for opacity transitions instead of color blending are strategies that have been described above. The use of more than two pure inks in a single fountain will now be described.

Figure 95:
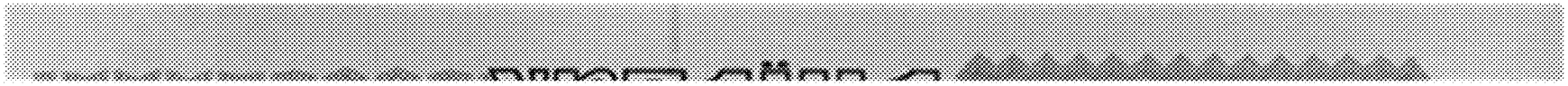
Figure 96:
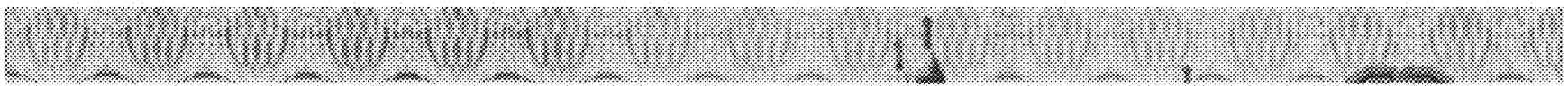

In conventional offset split fountain security printing, a seamless color transition is created between two or more inks that are blended on press, but printed from a single printing plate. In most split fountain security designs only two distinct inks are involved: one color at the left and right edges of the print, and a second color in the middle. Split fountains can also be configured with more than two ink colors. For example, each split fountain in FIGS. 95 and 96 contains three inks. FIG. 95 illustrates a security print containing a split fountain incorporating three ink colors, which transitions from green to pink to blue and back to green. FIG. 96 illustrates a security print containing two split fountain plates, each incorporating three ink colors. The first transitions from brown to pink to orange and back to brown, and the second transitions from green to blue to olive and back to green. Incorporation of even more colors is possible, subject to the mechanical limitations of the split fountain hardware on press.

Although FIGS. 95 and 96 illustrate split fountain color blends, split fountain printing can be used as a tool for creating opacity transitions instead of color transitions.

Examples described above present split fountains with only two inks of different opacities, but the first example below explores a configuration of three inks per ink station (see FIGS. 97 through 104), each with a different opacity. The second example (FIGS. 105 through 111) demonstrates how several design variables can be integrated at the same time.

Figure 97:
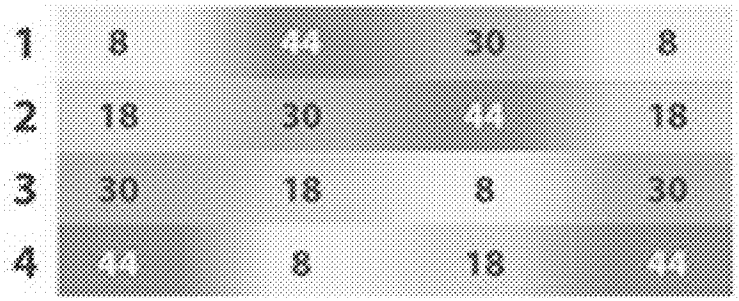
FIGS. 97 through 104 illustrate artwork demonstrating a split fountain configuration of three different opacity inks per ink station.

To stage the first example, FIG. 97 shows the distribution of three inks of the same color but of different opacities across the roller widths of each of four ink stations in an example offset printing press. For example, the first station prints an ink of 8% opacity at its left edge, inks of 44% opacity and 30% opacity in the center, and 8% again at the right edge. The split fountains feature identical placement and transition width, such that the split fountain hardware configuration is identical in all four ink stations.

The opacities shown in FIG. 97 are simplified for purposes of explanation. Real ink formulations can be identified and customized for actual printing workflows. Further, FIG. 97 shows just one possible arrangement of inks and split fountains. A large number of possible combinations of variables could be conceived that would produce a huge variety of visual effects, and the specifically provided examples are to demonstrate the various described concepts and are not intended to exhaustively present all possibilities.

Several facets of split fountain printing can be used for security purposes. As described above, the overprinting of certain split fountains can cause the apparent speed of the split fountain transition to change in different horizontal locations. In an example described earlier (e.g., see FIG. 80), the left and right sides of each split transition on press, and the left and right sides of the composite split fountain images in the print, can be designed to be mirror images of one another. In contrast, the configuration presented in FIG. 97 mimics an asymmetric split fountain effect where the left and right sides of the opacity transition appear to be of different widths. That the left and right halves of the split are unequal and occur over different distances presents a simulation problem that is subtly different from simulation of a symmetric color transition in a conventional split fountain, and further conceals the press configuration by masking one of the inks.

With further reference to FIG. 97, opacities of pure inks in each of four multiple split fountain ink stations are illustrated, expressed as various combinations of inks of 8% 18%, 30% and 44% opacity. Each simulates an asymmetric split fountain opacity transition that appears longer on one side than the other. Consider the first ink station. On the left, an ink of 8% opacity transitions to an ink of 44% opacity across about one third of the roller width. Two additional split fountains then transition the 44% opacity ink to an ink of 30% opacity and then to another ink of 8% opacity, but the full transition from 44% to 8% on the right side takes up about two thirds of the roller width. Although the speed of the opacity transition from 44% to 30% and the transition from 30% to 8% are not the same under close inspection, the general effect is of a rapid change from 8% to 44% on the left, and a more gradual change from 44% to 8% on the right. The 30% opacity ink blends into the center of the transition from 44% to 8%, producing the appearance of an asymmetrical split fountain that transitions quickly on its left side, but slowly on the right. The other three stations are similar; for example, the second station shows a long transition from 18% to 44% over the left two thirds of the width, but a short transition from 44% to 18% over the right third. As stated, the ink opacities used in the example are arbitrary, so a more purposeful selection of the specific ink formulations in each position could make the ink blend on the longer side of the split transition even more subtle.

Earlier examples (e.g., see FIGS. 77 and 78) described the use of paired ink stations with identical split fountain hardware configurations but opposite ink placements, such that overprinting the same plate artwork from each station in the pair could simulate three discrete flat tones across the full width of a printed design. In contrast, the distribution of ink opacities in the configuration shown in FIG. 97 cannot simulate flat tones across the full width using combinations of two plates (though all four plates together still approximate 100% opacity). Instead, the configuration shown in FIG. 97 allows the simulation of the seven discrete flat tones shown in FIG. 98, though most only span half of the roller width continuously, and only in specific locations that depend on which plate images are combined.

Figure 98:
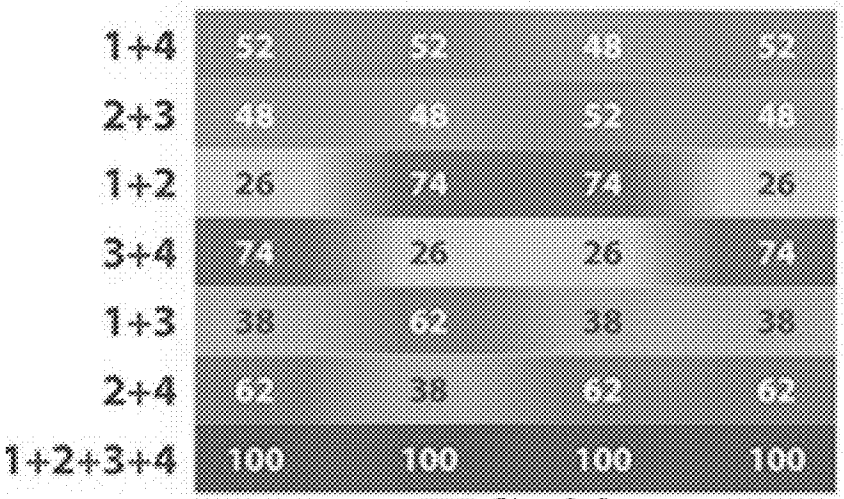
Figure 99:
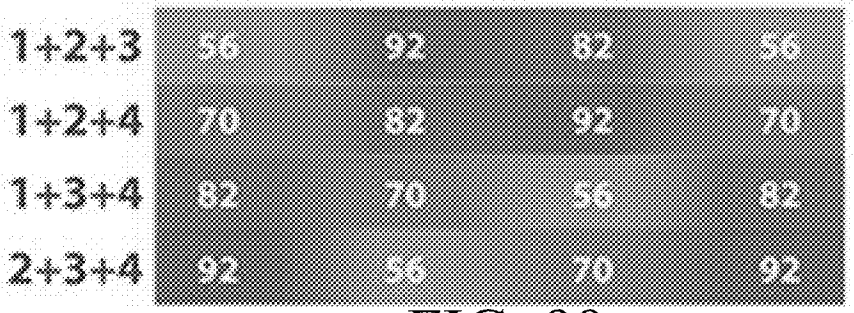

FIG. 98 illustrates overlaps of two and four of the plates from FIG. 97. The first two combinations simulate flat tones through the left half, the third and fourth simulate flat tones through the center, and the fifth and sixth simulate flat tones at the right. All four plates printed together simulate a flat tone across the full width. More specifically, FIG. 98 shows that overprinting the first and fourth stations simulates a flat tone of 52% (8%+44%) across the left half of the roller, and the overprinting of the second and third stations simulates a flat tone of 48% (18%+30%), also on the left side. Similarly, overprinting the first and second stations, or the third and fourth stations, produces flat tones of 74% and 26% through the center. Overprinting the first and third stations, or second and fourth stations, simulates flat tones of 38% and 62% across the right half. Finally, printing the same artwork from all four plates approximates 100% opacity, which is the only flat tone simulation in this configuration that spans the full roller width. The seven flat tone opacities simulated in FIG. 98 (26%, 38%, 48%, 52%, 62%, 74% and 100%) derive from the true press configuration in FIG. 97, which only contains inks of 8%, 18%, 30% and 44% opacity.

Where FIG. 94 illustrates combinations of two (or all four) plates that can simulate flat tones, FIG. 99 shows four combinations of three ink stations that simulate the presence of additional asymmetric split fountains, but cannot simulate flat tones in this configuration. FIG. 99 illustrates overlaps of three plates from FIG. 97. These combinations cannot simulate flat tones given the specific placement of inks in FIG. 97, but do simulate additional asymmetric opacity transitions like those shown in FIG. 97. More specifically, consider the overprinting of identical artwork from the first, second and third stations in FIG. 97, as shown at the top of FIG. 99. This combination produces a simulated opacity transition that progresses rapidly from 56% at the left to 92% over about a third of the width, and then takes the remaining two thirds of the width to transition first from 92% to 82%, and then from 82% to 56%. As described previously, the apparent speed of change from 92% to 82% is not quite the same as from 82% to 56%, but the 82% opacity ink tends to blend into the middle of the opacity decrease from 92% to 56%. The appearance mimics a rapid transition from 56% to 92% at the left, and a slower transition from 92% to 56% at the right. The plate combinations illustrated in FIG. 99 all feature a similar effect, with two combinations showing a faster opacity transition on the left side, and two showing a faster transition at the right.

Figure 101:
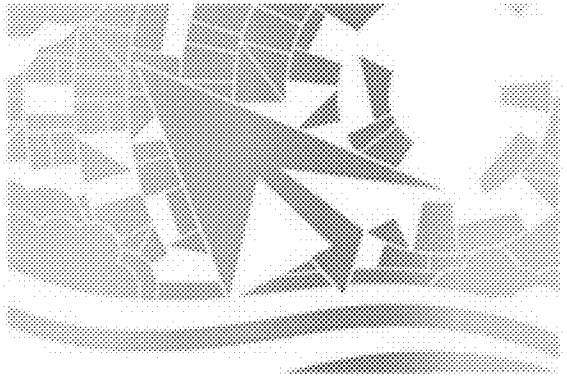
Figure 103:
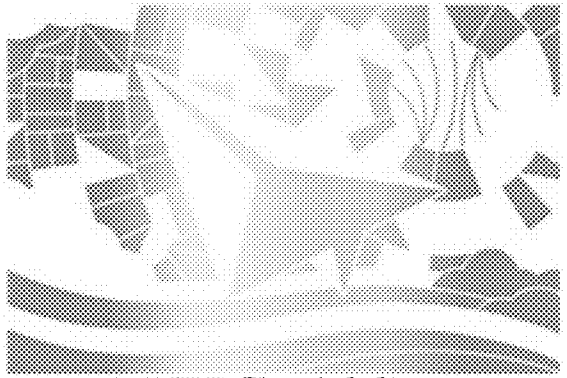
Figure 104:
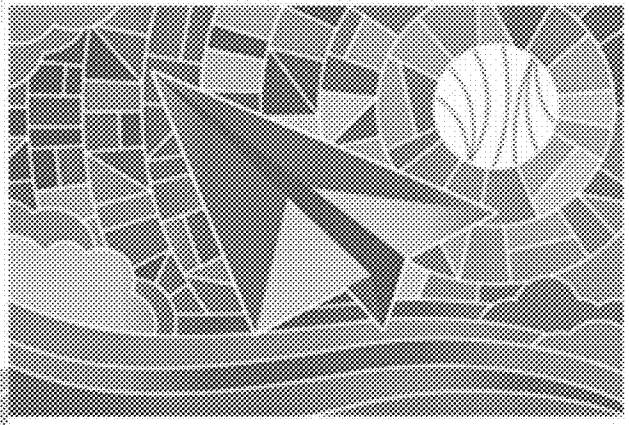
Figure 100:
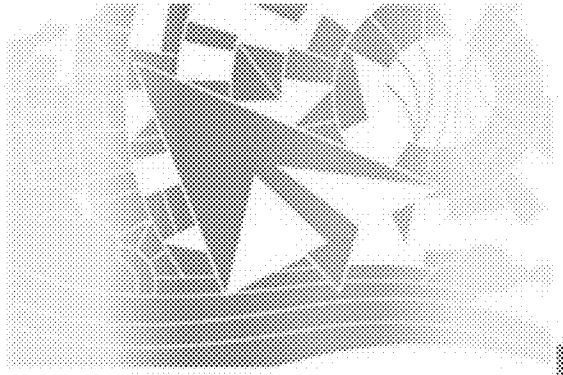
Figure 102:
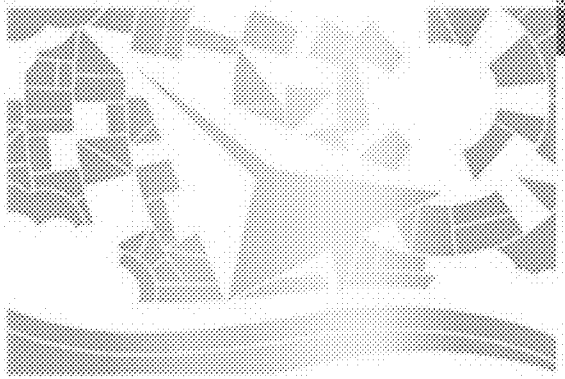

Four split fountain transitions involving three inks each (FIG. 97) and the combinations produced by their overlap (FIGS. 98 and 99) can be integrated into a design as shown in FIGS. 100 through 103, and the composite artwork in FIG. 104. FIG. 100 illustrates three-ink split fountain artwork composed of an ink of 8% opacity at the edges, and 44% and 30% opacities in the middle, from the first fountain in FIG. 97. The transition from 8% to 44% on the left appears to be faster than the transition from 44% to 8% on the right. FIG. 101 illustrates three-ink split fountain artwork composed of an ink of 18% opacity at the edges, and 30% and 44% opacities in the middle, from the second fountain in FIG. 97. The transition from 18% to 44% on the left appears to be slower than the transition from 44% to 18% on the right. FIG. 102 illustrates three-ink split fountain artwork composed of an ink of 30% opacity at the edges, and 18% and 8% opacities in the middle, from the third fountain in FIG. 97. The transition from 30% to 8% on the left appears to be slower than the transition from 8% to 30% on the right. FIG. 103 illustrates three-ink split fountain artwork composed of an ink of 44% opacity at the edges, and 8% and 18% opacities in the middle, from the fourth fountain in FIG. 97. The transition from 44% to 8% on the left appears to be faster than the transition from 8% to 44% on the right. FIG. 104 illustrates composite artwork produced by overprinting of FIGS. 100 through 103. The waves at the bottom contain several overt asymmetric split fountains that simulate both fast and slow opacity transition speeds between opacities of varying contrast. Compare to FIG. 111.

More specifically, each of the plate artwork designs in FIGS. 100 through 103 is associated with one of the split fountain stations shown in FIG. 97. The complete design in FIG. 104 is composed entirely of overprinted artwork from the eleven combinations shown in FIGS. 98 and 99, and it does not show any individual plate in isolation to inhibit reverse engineering. The variety of image densities displayed in different areas of FIG. 104 is a consequence of creative overprinting of only four plate images, but creates the illusion that many unique plates and spot inks were used. Working backwards from FIG. 104 to replicate the artwork in FIGS. 100 through 103 and the press setup shown in FIG. 97 would be complicated, since the design deliberately obfuscates the press setup.

The waves at the bottom of the artwork are the only part of the design that features long, horizontally continuous shapes, and have been included to allow some overt split fountain opacity transitions to be inspected. Although contiguous connected shapes were identified as a reverse engineering risk in prior work, in FIG. 104 they highlight the presence of split fountain transition effects that would be difficult to simulate using only one plate and no halftones. In FIG. 104, these effects include not just simulation of flat tones and simulated split fountain opacity transitions (FIGS. 98 and 99) that do not exist in the true press setup (FIG. 97), but also some asymmetric simulated opacity transitions that progress more rapidly on one side than the other. Although a counterfeiter could simulate these effects using a halftone process, such an approach sacrifices the line integrity of the solid artwork shapes and produces a counterfeit that is easy to detect with a magnifier.

As set forth above, a variety of techniques and variables have been described for creating security document artwork resistant to reverse engineering. A single technique can be featured and/or implemented in isolation, without consideration of other variables. Though security artwork resistant to reverse engineering can be developed using just one of the example techniques, the second example here (see FIGS. 105 through 111) illustrates the implementation of several techniques simultaneously.

Figure 105:
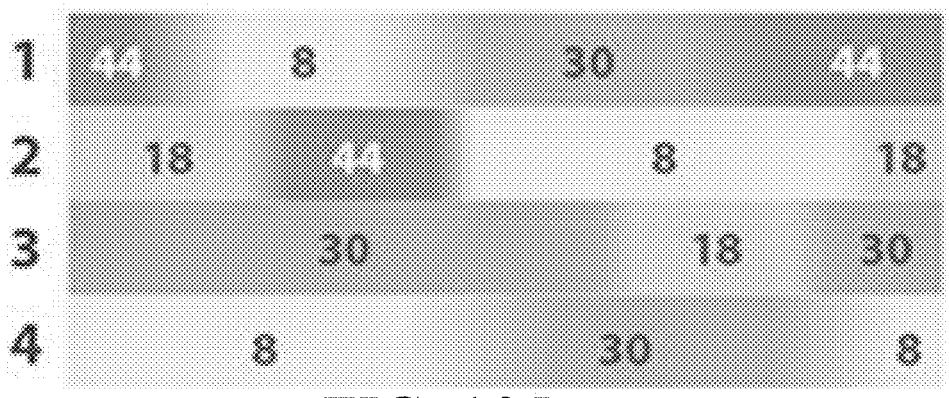
FIGS. 105 through 111 illustrate artwork demonstrating a split fountain configuration including variations per ink station based on different opacity inks, unique ink placements, split fountain locations, split fountain transition widths, numbers of splits, and numbers of pure inks.
Figure 106:
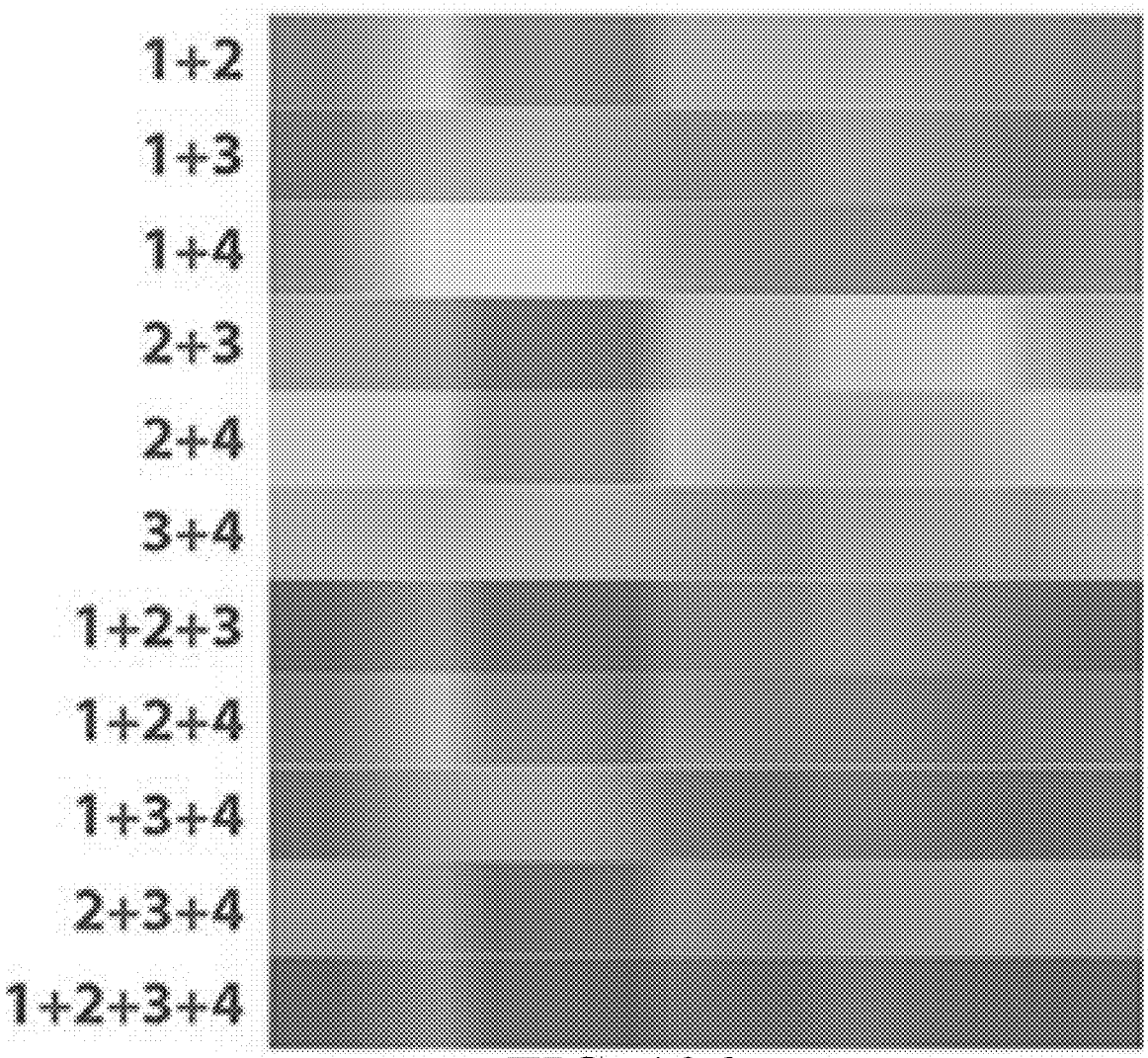

FIG. 105 illustrates opacities of pure inks in each of four multiple split fountain ink stations, expressed as various combinations of inks of 8% 18%, 30% and 44% opacity. Each station features its own unique ink placements and split fountain hardware configuration. Compare to FIG. 97. More specifically, FIG. 105 shows an alternative press configuration where each ink station is unique, and features its own configuration of ink opacities, ink placements, split fountain locations, split fountain transition widths and numbers of splits and pure inks. The configuration in FIG. 105 produces a gamut of visual effects when the ink stations are overprinted (FIG. 106), including overt and concealed split fountains, fast and slow simulated opacity transitions, and regions of both high and low opacity contrast. FIG. 106 illustrates overlap of split fountain inks from FIG. 105 to create complex combinations of light and dark opacity, including both abrupt and gradual opacity changes. No flat tones are present. The eleven complex false split fountain effects shown here replace the combinations shown in FIGS. 98 and 99. Individual plate artwork derived from the press configuration shown in FIG. 105 is shown in FIGS. 107 through 110, with the composite artwork as FIG. 111.

Figure 108:
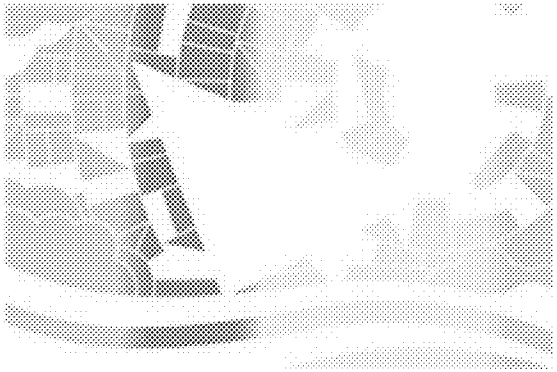
Figure 110:
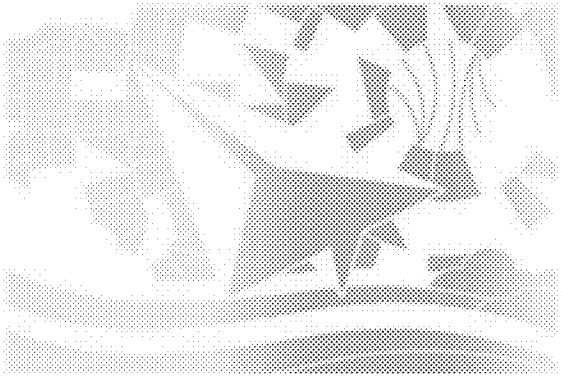
Figure 111:
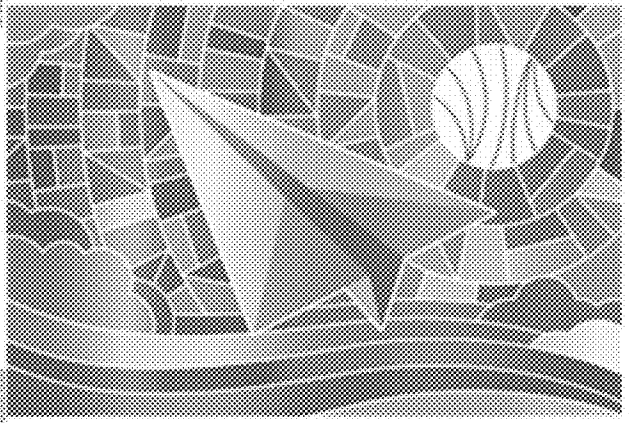
Figure 107:
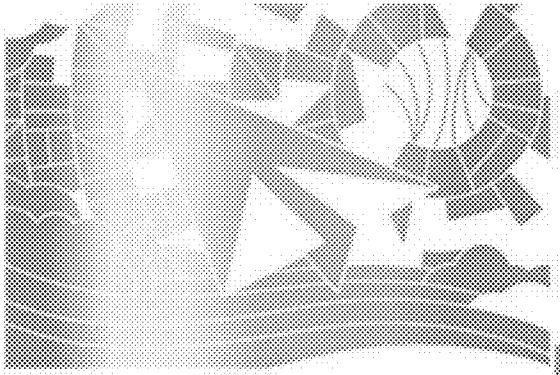
Figure 109:
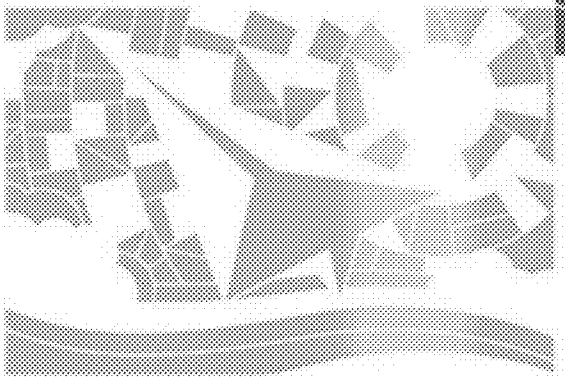

FIG. 107 illustrates three-ink split fountain artwork composed of an ink of 44% opacity at the edges, and 8% and 30% opacities in the middle, from the first fountain in FIG. 105. Compare the placement of the inks and the widths of the split fountain transitions to the other plates in FIGS. 108 through 110. FIG. 108 illustrates three-ink split fountain artwork composed of an ink of 18% opacity at the edges, and 44% and 8% opacities in the middle, from the second fountain in FIG. 105. Compare the placement of the inks and the widths of the split fountain transitions to the other plates in FIGS. 107, 109 and 110. FIG. 109 illustrates two-ink split fountain artwork composed of an ink of 30% opacity at the edges and 18% opacity in the middle, from the third fountain in FIG. 105. Compare the placement of the inks and the widths of the split fountain transitions to the other plates in FIGS. 107, 108 and 110. FIG. 110 illustrates two-ink split fountain artwork composed of an ink of 8% opacity at the edges and 30% opacity in the middle, from the fourth fountain in FIG. 105. Compare the placement of the inks and the widths of the split fountain transitions to the other plates in FIGS. 107 through 109. FIG. 111 illustrates composite artwork produced by overprinting of FIGS. 107 through 110. The contributing plates have been configured to create this dynamic, high contrast effect, which includes several overt asymmetric split fountains that simulate both fast and slow opacity transition speeds. Compare to FIG. 104. Compare FIG. 105 to FIG. 111 to see how the placement, nature and visibility of the opacity transitions in the composite artwork is a function of the press configuration, and how a press and inks can be configured to support a highly complex security artwork design.

Examples described herein can use monochromatic security design techniques that can make document artwork resistant to reverse engineering. Additional strategies regarding the prevention of artwork reverse engineering incorporate color elements into security document designs, allowing for expanded color design flexibility while retaining the security advantages of the monochromatic design techniques described herein.

It is to be understood that the above description is intended to be illustrative, and not restrictive. For example, the above-described embodiments (and/or aspects thereof) may be used in combination with each other or in different orders than that which is illustrated. In addition, many modifications may be made to adapt a particular situation or material to the teachings of the invention without departing from its scope. While certain aspects described herein are intended to define the parameters of the invention, they are by no means limiting, but are instead example embodiments. Many other embodiments will be apparent to those of skill in the art upon reviewing the above description.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

What is claimed is:

1. A method comprising:

providing ink, by a plurality of split fountains, to a plurality of printing plates each having a plate image corresponding to at least a portion of a composite image;

wherein a given one of the plurality of split fountains corresponds to a respective one of the plurality of printing plates and contains ink at a plurality of different opacity levels based on pigment of a same color, the given one of the plurality of split fountains being configured to provide to the respective one of the plurality of printing plates an arrangement of ink unique relative to other ones of the plurality of split fountains;

controlling oscillator rollers to set a width of an opacity level transition between the plurality of different opacity levels of the given one of the plurality of split fountains;

transferring the ink from the plurality of split fountains to the plurality of printing plates; and pressing the plurality of printing plates to a substrate to create the composite image.

2. The method of claim 1, further comprising creating the composite image from a combination of plate images based at least in part by compositing at least one unique opacity level from at least one of the plate images of the plurality of printing plates.

3. The method of claim 1, wherein the composite image comprises varying opacities based on layering opacity levels to achieve at least one composite opacity level in the composite image.

4. The method of claim 3, wherein the composite opacity level is outside a range of available opacity levels that any one of the plurality of split fountains is capable of producing.

5. The method of claim 1, further comprising layering a plurality of opacity level transitions to achieve a composite opacity level transition in the composite image.

6. The method of claim 5, further comprising configuring hardware of the split fountains to achieve the composite opacity level transition to disguise individual opacity transition levels of at least one split fountain, based on complementary split fountains having same constituent opacity levels having arrangements based on additively complementary locations.

7. The method of claim 1, wherein at least two of the plurality of split fountains contain at least one ink of a same opacity level to obscure which particular one of the plurality of printing plates produced a given portion of the composite image corresponding to that same opacity level.

8. The method of claim 1, wherein the plurality of printing plates is configured to create the composite image comprising a plurality of segregated shapes separated by white space, and wherein each of the plurality of segregated shapes has an opacity level different from nearby shapes.

9. The method of claim 8, wherein the plurality of segregated shapes includes identical artwork whose opacity level changes as a function of its horizontal location according to at least one split fountain unique arrangement.

10. The method of claim 8, wherein each of the plurality of segregated shapes is comprised of ink from at least two of the plurality of printing plates.

11. The method of claim 8, wherein each of the plurality of segregated shapes includes an erratic edge contour that extends at least partially into white space bordering that segregated shape to produce irregular overlap between segregated shapes.

12. A method comprising:

controlling a plurality of oscillator rollers to set widths of opacity level transitions of a plurality of split fountains, wherein a given one of the plurality of split fountains contains a plurality of inks of different opacity levels based on pigment of a same color;

transferring ink from the plurality of split fountains to a plurality of printing plates, wherein a given one of the plurality of printing plates has a plate image corresponding to at least a portion of a composite image; and pressing the plurality of printing plates to a substrate to create the composite image;

wherein the plurality of printing plates is configured to generate the composite image to have a greater number of different opacity levels than the different opacity levels contained in the plurality of split fountains.

13. The method of claim 12, wherein plate images of the plurality of printing plates are configured to generate the composite image to include an overt false simulated ink opacity transition that does not correspond to any unique ink arrangements of any of the plurality of split fountains.

14. The method of claim 13, wherein the simulated ink opacity transition is a simulated constant opacity flat tone which appears to be generated from a non-split ink station and which has an opacity level unlike any individual one of the plurality of inks fed to the plurality of split fountains, based on compositing plate images from at least two split fountain configurations that are complementary pairs.

15. The method of claim 14, wherein the simulated ink opacity transition is based on a combination of the simulated constant opacity flat tone composited with at least one additional opacity transition corresponding to at least one additional physical split fountain.

16. The method of claim 13, wherein the simulated ink opacity transition includes an opacity transition unlike any physical split fountain configuration, based on an overlap of at least two split fountain transitions that are not from opposing pairs of split fountains.

17. The method of claim 13, wherein the simulated ink opacity transition includes an apparent transition between a greater number of different opacity level inks than physical inks contained in any physical split fountain.

18. The method of claim 13, wherein the simulated ink opacity transition includes an apparent dynamic opacity transition speed different than any physical split fountain.

19. The method of claim 18, wherein the apparent dynamic opacity transition speed is faster than constituent plate image opacity transitions, based on overprinting of physical split fountain opacity transitions moving in a same direction.

20. The method of claim 18, wherein the apparent dynamic opacity transition speed is slower than constituent plate image opacity transitions, based on overprinting of physical split fountain opacity transitions moving in opposite directions.

21. The method of claim 18, wherein the apparent dynamic opacity transition speed varies in the composite image, based on overprinting of plate images including constituent opacity transitions having same and opposite moving directions.

22. The method of claim 13, wherein the simulated ink opacity transition is asymmetrical based on different opacity transitions on left and right halves of the simulated ink opacity transition.

23. The method of claim 13, wherein the simulated ink opacity transition includes an apparent opacity transition contrast different than a contrast of plate images generated by any individual physical split fountain.

24. The method of claim 13, wherein every visible split fountain transition visible in the composite image is a simulated ink opacity transition to conceal a physical split fountain configuration of any of the plurality of split fountains.

25. The method of claim 13, further comprising simulating, by a number n of physical split fountains, the presence of S simulated ink opacity transitions that each differ from a non-simulated ink opacity transition obtained directly from any one of the n physical split fountains individually, according to the expression $$S = \sum_{k=2}^{n} \left( \frac{n!}{k!(n-k)!} \right).$$

26. The method of claim 12, further comprising configuring the plurality of split fountains based on at least two split fountains having different split fountain transition widths according to oscillation of the plurality of oscillator rollers.

27. The method of claim 12, further comprising configuring the plurality of split fountains based on at least two split fountains having different split fountain transition locations.

28. The method of claim 12, further comprising configuring the plurality of split fountains based on at least two split fountains having different numbers of split fountain transitions according to a number of pure inks of different opacity levels deployed in a given split fountain.

29. A method comprising:

controlling, by a plurality of oscillator rollers, widths of a plurality of opacity level transitions of a plurality of split fountains, wherein a given one of the plurality of split fountains contains a plurality of inks of different opacity levels based on pigment of a same color and configured to generate the plurality of opacity level transitions;

transferring ink from the plurality of split fountains to a plurality of printing plates, wherein a given one of the plurality of printing plates has a plate image corresponding to at least a portion of a composite image; and pressing the plurality of printing plates to a substrate to create the composite image;

wherein the printing plates are configured to generate the composite image to include at least one simulated opacity level transition different from any one of the different opacity levels that the plurality of split fountains are physically configured to generate.

* * * * *